US011839798B2

(12) United States Patent
Parsons et al.

(10) Patent No.: US 11,839,798 B2
(45) **Date of Patent: *Dec. 12, 2023**

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Robert R. Parsons, Scottsdale, AZ (US); Bradley D. Schweigert, Cave Creek, AZ (US); Michael R. Nicolette, Scottsdale, AZ (US); Matthew T. Andrews, Tempe, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/114,309

(22) Filed: Feb. 27, 2023

(65) Prior Publication Data

US 2023/0249037 A1 Aug. 10, 2023

Related U.S. Application Data

(63) Continuation-in-part of application No. 17/951,399, filed on Sep. 23, 2022, and a continuation of (Continued)

(51) Int. Cl.
*A63B 53/04* (2015.01)
*A63B 60/02* (2015.01)

(52) U.S. Cl.
CPC ..... *A63B 53/0466* (2013.01); *A63B 53/04* (2013.01); *A63B 60/02* (2015.10); (Continued)

(58) Field of Classification Search
CPC ..... A63B 53/0466; A63B 60/02; A63B 53/04; A63B 2053/0491; A63B 53/0408; (Continued)

(56) References Cited

U.S. PATENT DOCUMENTS 1,133,129 A 3/1915 Govan
1,269,745 A 6/1918 Robertson
(Continued)

FOREIGN PATENT DOCUMENTS

CN 1572343 A 2/2005
CN 1608696 A 4/2005
(Continued)

OTHER PUBLICATIONS

PCT/US15/42484: International Search Report and Written Opinion dated Oct. 19, 2015 (12 Pages).
(Continued)

*Primary Examiner* — Sebastiano Passaniti

(57) ABSTRACT

Embodiments of golf club heads and methods to manufacture golf club heads are generally described herein. In one example, a golf club head may include a body portion having a first material with a first density, a wall portion extending into the body portion from an inner surface of a bottom portion of the body portion, a weight portion having a second material with a second density different from the first density, a weight port extending into the body portion from the bottom portion between the wall portion and a face portion and configured to receive the weight portion, and a polymer material between the weight port and the wall portion. The height of the polymer material is less than or equal to the weight-port height. Other examples and embodiments may be described and claimed.

20 Claims, 26 Drawing Sheets

Related U.S. Application Data application No. 17/876,746, filed on Jul. 29, 2022, now Pat. No. 11,617,925, said application No. 17/951,399 is a continuation of application No. 17/685,566, filed on Mar. 3, 2022, now Pat. No. 11,484,756, application No. 18/114,309 is a continuation-in-part of application No. 17/586,971, filed on Jan. 28, 2022, and a continuation-in-part of application No. 17/528,436, filed on Nov. 17, 2021, and a continuation-in-part of application No. 17/407,025, filed on Aug. 19, 2021, said application No. 17/407,025 is a continuation of application No. 17/225,414, filed on Apr. 8, 2021, now Pat. No. 11,117,028, application No. 18/114,309 is a continuation-in-part of application No. 17/198,770, filed on Mar. 11, 2021, now Pat. No. 11,707,651, said application No. 17/586,971 is a continuation of application No. 17/149,954, filed on Jan. 15, 2021, now Pat. No. 11,266,888, said application No. 17/198,770 is a continuation of application No. 16/807,591, filed on Mar. 3, 2020, now Pat. No. 10,960,274.

(60) Provisional application No. 63/289,908, filed on Dec. 15, 2021, provisional application No. 63/232,767, filed on Aug. 13, 2021, provisional application No. 63/166,859, filed on Mar. 26, 2021, provisional application No. 63/117,182, filed on Nov. 23, 2020, provisional application No. 63/057,252, filed on Jul. 27, 2020, provisional application No. 63/010,036, filed on Apr. 14, 2020, provisional application No. 62/963,430, filed on Jan. 20, 2020, provisional application No. 62/957,757, filed on Jan. 6, 2020, provisional application No. 62/897,015, filed on Sep. 6, 2019, provisional application No. 62/873,773, filed on Jul. 12, 2019, provisional application No. 62/837,592, filed on Apr. 23, 2019, provisional application No. 62/820,728, filed on Mar. 19, 2019, provisional application No. 62/816,418, filed on Mar. 11, 2019.

(52) U.S. Cl.
CPC ..... *A63B 53/045* (2020.08); *A63B 53/0408* (2020.08); *A63B 53/0412* (2020.08); *A63B 53/0433* (2020.08); *A63B 53/0437* (2020.08); *A63B 2053/0491* (2013.01)

(58) Field of Classification Search
CPC ..... A63B 53/0412; A63B 53/0433; A63B 53/0437; A63B 53/045
USPC ..... 473/324–350, 287–292
See application file for complete search history.

(56) References Cited

U.S. PATENT DOCUMENTS 1,306,029 A 6/1919 Robertson
1,534,600 A 4/1925 Mattern
1,538,312 A 5/1925 Neish
3,556,533 A 1/1971 Hollis
3,652,094 A 3/1972 Glover
3,826,512 A 7/1974 Palmer
4,085,934 A 4/1978 Churchward
4,553,755 A 11/1985 Yamada
5,106,094 A 4/1992 Desbiolles et al.
5,219,408 A 6/1993 Sun
5,333,861 A 8/1994 Mills
5,351,958 A 10/1994 Helmstetter
5,467,983 A 11/1995 Chen
5,499,819 A 3/1996 Nagamoto
5,518,243 A 5/1996 Redman
5,524,331 A 6/1996 Pond
5,624,331 A 4/1997 Lo et al.
5,649,873 A 7/1997 Fuller
5,788,584 A 8/1998 Parente et al.
5,863,261 A 1/1999 Eggiman
5,941,782 A 8/1999 Cook
5,971,868 A 10/1999 Kosmatka
5,997,415 A 12/1999 Wood
6,146,287 A 11/2000 Rugge et al.
6,254,494 B1 7/2001 Hasebe et al.
6,280,349 B1 8/2001 Cook
6,296,576 B1 10/2001 Capelli
6,306,048 B1 10/2001 McCabe et al.
6,354,962 B1 3/2002 Galloway et al.
6,368,234 B1 4/2002 Galloway
6,383,090 B1 5/2002 O'Doherty et al.
6,398,666 B1 6/2002 Evans et al.
6,409,612 B1 6/2002 Evans et al.
6,435,977 B1 8/2002 Helmstetter et al.
6,506,127 B2 1/2003 Helmstetter et al.
6,533,679 B1 3/2003 McCabe et al.
6,607,451 B2 8/2003 Kosmatka et al.
6,620,056 B2 9/2003 Galloway et al.
6,623,377 B2 9/2003 Evans et al.
6,638,182 B2 10/2003 Kosmatka
6,729,971 B2 5/2004 Caldwell
6,773,360 B2 8/2004 Willett et al.
6,800,040 B2 10/2004 Galloway et al.
6,811,496 B2 11/2004 Wahl et al.
6,852,038 B2 2/2005 Yabu
6,863,626 B2 3/2005 Evans et al.
6,932,719 B2 8/2005 Yabu
6,969,326 B2 11/2005 Shiell et al.
6,979,270 B1 12/2005 Allen
6,986,715 B2 1/2006 Mahaffey
6,991,560 B2 1/2006 Tseng
6,997,821 B2 2/2006 Galloway et al.
7,014,570 B2 3/2006 Evans et al.
7,037,214 B2 5/2006 Nakahara et al.
7,083,530 B2 8/2006 Wahl et al.
7,101,289 B2 9/2006 Gibbs et al.
7,125,344 B2 10/2006 Hocknell et al.
7,137,907 B2 11/2006 Gibbs et al.
7,147,757 B2 12/2006 Luyken et al.
7,153,220 B2 12/2006 Lo
7,166,040 B2 1/2007 Hoffman et al.
7,186,190 B1 3/2007 Beach et al.
7,214,142 B2 5/2007 Meyer et al.
7,223,180 B2 5/2007 Willett et al.
7,226,364 B2 6/2007 Helmstetter
7,258,625 B2 8/2007 Kawaguchi et al.
7,258,626 B2 8/2007 Gibbs et al.
7,261,646 B2 8/2007 Shiell et al.
7,281,994 B2 10/2007 Shiell et al.
7,303,486 B2 12/2007 Imamoto
7,338,388 B2 3/2008 Schweigert et al.
7,347,794 B2 3/2008 Schweigert
7,367,897 B2 5/2008 Poynor
7,407,447 B2 8/2008 Beach et al.
7,410,425 B2 8/2008 Willett et al.
7,410,426 B2 8/2008 Willett et al.
7,419,441 B2 9/2008 Hoffman et al.
7,422,528 B2 9/2008 Gibbs et al.
7,435,190 B2 10/2008 Sugimoto
7,448,960 B2 11/2008 Gibbs et al.
7,448,963 B2 11/2008 Beach et al.
7,448,964 B2 11/2008 Schweigert et al.
7,494,425 B2 2/2009 Shiell et al.
7,527,565 B1 5/2009 Ehlers et al.
7,530,904 B2 5/2009 Beach et al.
7,540,811 B2 6/2009 Beach et al.
7,568,985 B2 8/2009 Beach et al.
7,572,193 B2 8/2009 Yokota
7,575,524 B2 8/2009 Willett et al.
7,578,753 B2 8/2009 Beach et al.
7,584,531 B2 9/2009 Schweigert et al.
7,591,738 B2 9/2009 Beach et al.

(56) References Cited

U.S. PATENT DOCUMENTS

| | | | |
|---|---|---|---|
| 7,611,424 | B2 | 11/2009 | Nagai et al. |
| 7,621,823 | B2 | 11/2009 | Beach et al. |
| 7,632,194 | B2 | 12/2009 | Beach et al. |
| 7,641,568 | B2 | 1/2010 | Hoffman et al. |
| 7,658,686 | B2 | 2/2010 | Soracco |
| 7,713,140 | B2 | 5/2010 | Gibbs et al. |
| 7,713,142 | B2 | 5/2010 | Hoffman et al. |
| 7,717,804 | B2 | 5/2010 | Beach et al. |
| 7,717,805 | B2 | 5/2010 | Beach et al. |
| 7,731,603 | B2 | 6/2010 | Beach et al. |
| 7,744,484 | B1 | 6/2010 | Chao |
| 7,798,203 | B2 | 9/2010 | Schweigert et al. |
| 7,806,781 | B2 | 10/2010 | Imamoto |
| 7,811,178 | B2 | 10/2010 | Davis |
| 7,846,041 | B2 | 12/2010 | Beach et al. |
| 7,871,339 | B2 | 1/2011 | Sanchez et al. |
| 7,927,229 | B2 | 4/2011 | Jertson et al. |
| 7,963,861 | B2 | 6/2011 | Beach et al. |
| 7,967,700 | B2 | 6/2011 | Stites |
| 8,007,369 | B2 | 8/2011 | Soracco |
| 3,016,691 | A1 | 9/2011 | Stites |
| 8,012,038 | B1 | 9/2011 | Beach et al. |
| 8,012,041 | B2 | 9/2011 | Gibbs et al. |
| 8,070,623 | B2 | 12/2011 | Stites et al. |
| 8,088,025 | B2 | 1/2012 | Wahl et al. |
| 8,096,896 | B2 | 1/2012 | Schiell et al. |
| 8,172,697 | B2 | 5/2012 | Cackett et al. |
| 8,192,303 | B2 | 6/2012 | Ban |
| 8,197,357 | B1 | 6/2012 | Rice et al. |
| 8,202,175 | B2 | 6/2012 | Ban |
| 8,216,087 | B2 | 7/2012 | Breier et al. |
| 8,226,498 | B2 | 7/2012 | Stites et al. |
| 8,235,843 | B1 | 8/2012 | Rice et al. |
| 8,257,196 | B1 | 9/2012 | Abbott et al. |
| 8,262,506 | B2 | 9/2012 | Watson et al. |
| 8,262,507 | B1 | 9/2012 | Willett et al. |
| 8,287,402 | B2 | 10/2012 | Shiell et al. |
| 8,353,783 | B2 | 1/2013 | Soracco |
| 8,353,787 | B2 | 1/2013 | Meyer et al. |
| 8,371,957 | B2 | 2/2013 | Schweigert et al. |
| 8,376,876 | B2 | 2/2013 | Gibbs et al. |
| 8,403,769 | B2 | 3/2013 | Stites |
| 8,414,422 | B2 | 4/2013 | Peralta et al. |
| 8,430,763 | B2 | 4/2013 | Beach et al. |
| 8,444,506 | B2 | 5/2013 | Watson et al. |
| 8,480,512 | B2 | 7/2013 | Oldknow et al. |
| 8,485,919 | B2 | 7/2013 | Rice et al. |
| 8,540,590 | B2 | 9/2013 | Tsukada et al. |
| 8,562,457 | B2 | 10/2013 | Beach et al. |
| 8,568,248 | B2 | 10/2013 | DeShiell et al. |
| 8,602,912 | B2 | 12/2013 | Stites |
| 8,608,587 | B2 | 12/2013 | Henrikson et al. |
| 8,628,431 | B2 | 1/2014 | Schweigert et al. |
| 8,651,975 | B2 | 2/2014 | Soracco |
| 8,657,701 | B2 | 2/2014 | Boyd et al. |
| 8,657,703 | B2 | 2/2014 | Wada et al. |
| 8,663,026 | B2 | 3/2014 | Blowers et al. |
| 8,696,489 | B2 | 4/2014 | Gibbs et al. |
| 8,777,778 | B2 | 7/2014 | Solheim et al. |
| 8,784,232 | B2 | 7/2014 | Jertson et al. |
| 8,790,196 | B2 | 7/2014 | Solheim et al. |
| 8,814,724 | B2 | 8/2014 | Kato |
| 8,814,725 | B2 | 8/2014 | Wahl et al. |
| 8,845,454 | B2 | 9/2014 | Boyd et al. |
| 8,858,362 | B1 | 10/2014 | Leposky et al. |
| 8,888,607 | B2 | 11/2014 | Harbert et al. |
| 8,900,069 | B2 | 12/2014 | Beach et al. |
| 8,926,449 | B2 | 1/2015 | Sato |
| 8,979,671 | B1 | 3/2015 | Demille et al. |
| 9,089,746 | B2 | 7/2015 | Schweigert |
| 9,101,809 | B2 | 8/2015 | Gibbs et al. |
| 9,168,436 | B2 | 10/2015 | Slaughter et al. |
| 9,199,140 | B1 | 12/2015 | Schweigert et al. |
| 9,242,152 | B2 | 1/2016 | Cole et al. |
| 9,327,173 | B2 | 5/2016 | Mizutani |
| 9,352,197 | B2 | 5/2016 | Parsons et al. |
| 9,393,471 | B2 | 7/2016 | Beno et al. |
| 9,399,157 | B2 | 7/2016 | Greensmith et al. |
| 9,399,158 | B2 | 7/2016 | Parsons et al. |
| 9,403,069 | B2 | 8/2016 | Boyd et al. |
| 9,440,123 | B2 | 9/2016 | Beno et al. |
| 9,452,325 | B2 | 9/2016 | DeShiell et al. |
| 9,452,327 | B2 | 9/2016 | Willett et al. |
| 9,550,096 | B2 | 1/2017 | Parsons et al. |
| 9,555,294 | B2 | 1/2017 | Henrikson et al. |
| 9,555,295 | B2 | 1/2017 | Schweigert et al. |
| 9,561,410 | B2 | 2/2017 | Bennett et al. |
| 9,630,070 | B2 | 4/2017 | Parsons et al. |
| 9,636,554 | B2 | 5/2017 | Parsons et al. |
| 9,662,547 | B2 | 5/2017 | Parsons et al. |
| 9,669,270 | B2 | 6/2017 | Schweigert et al. |
| 9,682,295 | B1 | 6/2017 | Dawson et al. |
| 9,700,764 | B2 | 7/2017 | Carter |
| 9,782,643 | B2 | 10/2017 | Parsons et al. |
| 9,795,842 | B1 | 10/2017 | Parsons et al. |
| 9,795,843 | B2 | 10/2017 | Parsons et al. |
| 9,802,087 | B2 | 10/2017 | Schweigert et al. |
| 9,814,945 | B2 | 11/2017 | Parsons et al. |
| 9,814,954 | B2 | 11/2017 | Westrum et al. |
| 9,821,200 | B1 | 11/2017 | Parsons et al. |
| 9,821,201 | B1 | 11/2017 | Parsons et al. |
| 9,833,667 | B1 | 12/2017 | Parsons et al. |
| 9,839,817 | B1 | 12/2017 | Johnson et al. |
| 9,839,821 | B2 | 12/2017 | DeShiell et al. |
| 9,861,867 | B2 | 1/2018 | Parsons et al. |
| 9,895,582 | B2 | 2/2018 | Schweigert et al. |
| 9,895,583 | B2 | 2/2018 | Parsons et al. |
| 9,914,029 | B2 | 3/2018 | Parsons et al. |
| 9,981,160 | B2 | 5/2018 | Parsons et al. |
| 9,987,526 | B2 | 6/2018 | Parsons et al. |
| 9,999,814 | B2 | 6/2018 | Parsons et al. |
| 10,010,770 | B2 | 7/2018 | Parsons et al. |
| 10,052,532 | B2 | 8/2018 | Parsons et al. |
| 10,052,535 | B1 | 8/2018 | Westrum et al. |
| 10,076,688 | B1 | 9/2018 | Harbert et al. |
| 10,099,093 | B2 | 10/2018 | Parsons et al. |
| 10,143,899 | B2 | 12/2018 | Schweigert et al. |
| 10,213,659 | B2 | 2/2019 | Parsons et al. |
| 10,232,234 | B2 | 3/2019 | Parsons et al. |
| 10,252,123 | B2 | 4/2019 | Parsons et al. |
| 10,293,220 | B2 | 5/2019 | Schweigert et al. |
| 10,293,221 | B2 | 5/2019 | Parsons et al. |
| 10,328,319 | B2 | 6/2019 | Nakamura |
| 10,335,645 | B2 | 7/2019 | Parsons et al. |
| 10,376,754 | B2 | 8/2019 | Parsons et al. |
| 10,384,102 | B2 | 8/2019 | Parsons et al. |
| 10,413,787 | B2 | 9/2019 | Parsons et al. |
| 10,420,989 | B2 | 9/2019 | Parsons et al. |
| 10,420,990 | B2 | 9/2019 | Parsons et al. |
| 10,434,389 | B2 | 10/2019 | Morales et al. |
| 10,441,855 | B2 | 10/2019 | Parsons et al. |
| 10,532,257 | B2 | 1/2020 | Schweigert et al. |
| 10,543,407 | B2 | 1/2020 | Parsons et al. |
| 10,583,336 | B2 | 3/2020 | Parsons et al. |
| 10,617,917 | B2 | 4/2020 | Parsons et al. |
| 10,617,918 | B2 | 4/2020 | Parsons et al. |
| 10,653,928 | B2 | 5/2020 | Parsons et al. |
| 10,695,623 | B2 | 6/2020 | Parsons et al. |
| 10,695,624 | B2 | 6/2020 | Parsons et al. |
| 10,709,942 | B2 | 7/2020 | Parsons et al. |
| 10,722,764 | B2 | 7/2020 | Parsons et al. |
| 10,722,765 | B2 | 7/2020 | Schweigert et al. |
| 10,729,945 | B2 | 8/2020 | Stokke et al. |
| 10,786,712 | B2 | 9/2020 | Parsons et al. |
| 10,821,334 | B2 | 11/2020 | Schweigert et al. |
| 10,843,051 | B2 | 11/2020 | Parsons et al. |
| 10,898,766 | B2 | 1/2021 | Parsons et al. |
| 10,898,768 | B2 | 1/2021 | Parsons et al. |
| 10,926,142 | B2 | 2/2021 | Parsons et al. |
| 10,960,274 | B2 | 3/2021 | Parsons et al. |
| 10,960,275 | B2 | 3/2021 | Parsons et al. |
| 10,967,231 | B2 | 4/2021 | Parsons et al. |
| 11,117,027 | B2 | 9/2021 | Hoffman et al. |
| 11,117,028 | B2 | 9/2021 | Parsons et al. |

(56) References Cited

U.S. PATENT DOCUMENTS

| | | | | |
|---|---|---|---|---|
| 11,266,888 | B2 | 3/2022 | Kroloff et al. | |
| 11,617,925 | B2 * | 4/2023 | Parsons | A63B 53/0466 29/592 |
| 2002/0019265 | A1 | 2/2002 | Allen | |
| 2002/0028714 | A1 | 3/2002 | Kosmatka | |
| 2003/0027662 | A1 | 2/2003 | Werner et al. | |
| 2003/0148818 | A1 | 8/2003 | Myrhum et al. | |
| 2003/0199335 | A1 | 10/2003 | Bissonnette et al. | |
| 2004/0033846 | A1 | 2/2004 | Caldwell | |
| 2004/0087388 | A1 | 5/2004 | Beach et al. | |
| 2004/0192468 | A1 | 9/2004 | Onoda et al. | |
| 2004/0198532 | A1 | 10/2004 | Caldwell et al. | |
| 2004/0266550 | A1 | 12/2004 | Gilbert et al. | |
| 2005/0096154 | A1 | 5/2005 | Chen | |
| 2005/0209021 | A1 | 9/2005 | Hoffman et al. | |
| 2005/0250596 | A1 | 11/2005 | Chuang | |
| 2006/0052181 | A1 | 3/2006 | Serrano et al. | |
| 2006/0100031 | A1 | 5/2006 | Lan | |
| 2006/0194644 | A1 | 8/2006 | Nishio | |
| 2007/0054753 | A1 | 3/2007 | Beach et al. | |
| 2007/0099720 | A1 | 5/2007 | Gillig | |
| 2007/0129161 | A1 | 6/2007 | Matsunaga et al. | |
| 2008/0004129 | A1 | 1/2008 | Lin et al. | |
| 2008/0004133 | A1 | 1/2008 | Schweigert | |
| 2008/0248896 | A1 | 10/2008 | Hirano | |
| 2009/0029795 | A1 | 1/2009 | Schweigert et al. | |
| 2009/0264218 | A1 | 10/2009 | Willett et al. | |
| 2010/0144461 | A1 | 6/2010 | Ban | |
| 2010/0323812 | A1 | 12/2010 | Boyd et al. | |
| 2010/0331102 | A1 | 12/2010 | Golden et al. | |
| 2012/0021849 | A1 | 1/2012 | Gibbs et al. | |
| 2012/0064994 | A1 | 3/2012 | Wada et al. | |
| 2013/0190100 | A1 * | 7/2013 | Oldknow | A63B 69/3632 473/226 |
| 2013/0296070 | A1 | 11/2013 | Stites et al. | |
| 2015/0126305 | A1 | 5/2015 | Stokke et al. | |
| 2015/0231458 | A1 | 8/2015 | Petersen et al. | |
| 2015/0290503 | A1 | 10/2015 | Su | |
| 2016/0038799 | A1 | 2/2016 | Cruz et al. | |
| 2017/0007892 | A1 | 1/2017 | Schweigert et al. | |
| 2018/0296887 | A1 | 10/2018 | Motokawa | |

FOREIGN PATENT DOCUMENTS

| | | | |
|---|---|---|---|
| CN | 203108126 | U | 8/2013 |
| JP | H0241003 | U | 3/1990 |
| JP | 2002535056 | A | 10/2002 |
| JP | 2005287679 | A | 10/2005 |
| JP | 2006223331 | A | 8/2006 |
| JP | 2007136068 | A | 6/2007 |
| JP | 2008161597 | A | 7/2008 |
| JP | 3158662 | U | 4/2010 |
| JP | 2010069106 | A | 4/2010 |

OTHER PUBLICATIONS

PCT/US16/17474: International Search Report and Written Opinion dated May 12, 2016 (9 Pages).
PCT/US17/28402: International Search Report and Written Opinion dated Jul. 18, 2017 (10 Pages).
PCT/US17/55155: International Search Report and Written Opinion dated Jan. 25, 2018 (9 Pages).
PCT/US2015/042282: International Search Report and Written Opinion dated Oct. 13, 2015 (12 Pages).
PCT/US2017/013513: International Search Report and Written Opinion dated Mar. 17, 2017 (18 Pages).
PCT/US2019/026099: International Search Report and Written Opinion dated May 7, 2019 (7 pages).
PCT/US2020/021869: International Search Report and Written Opinion dated May 14, 2020 (12 Pages).

* cited by examiner

GOLF CLUB HEADS AND METHODS TO MANUFACTURE GOLF CLUB HEADS

CROSS REFERENCE

This application is a continuation-in-part of application Ser. No. 17/198,770, filed Mar. 11, 2021, which is a continuation of application Ser. No. 16/807,591, filed Mar. 3, 2020, now U.S. Pat. No. 10,960,274, which claims the benefit of U.S. Provisional Application No. 62/837,592, filed Apr. 23, 2019, U.S. Provisional Application No. 62/873,773, filed Jul. 12, 2019, U.S. Provisional Application No. 62/897,015, filed Sep. 6, 2019, U.S. Provisional Application No. 62/820,728, filed Mar. 19, 2019, U.S. Provisional Application No. 62/816,418, filed Mar. 11, 2019, and U.S. Provisional Application No. 62/957,757, filed Jan. 6, 2020.

This application is a continuation-in-part of application Ser. No. 17/586,971, filed Jan. 28, 2022, which is a continuation of application Ser. No. 17/149,954, filed Jan. 15, 2021, now U.S. Pat. No. 11,266,888, which claims the benefit of U.S. Provisional Application No. 62/963,430, filed Jan. 20, 2020.

This application is a continuation-in-part of application Ser. No. 17/407,025, filed Aug. 19, 2021, which is a continuation of application Ser. No. 17/225,414, filed Apr. 8, 2021, now U.S. Pat. No. 11,117,028, which claims the benefit of U.S. Provisional Application No. 63/057,252, filed Jul. 27, 2020, and claims the benefit of U.S. Provisional Application No. 63/010,036, filed Apr. 14, 2020.

This application is a continuation-in-part of application Ser. No. 17/528,436, filed Nov. 17, 2021, which claims the benefit of U.S. Provisional Application No. 63/117,182, filed Nov. 23, 2020.

This application is a continuation-in-part of application Ser. No. 17/951,399, filed Sep. 23, 2022, which is a continuation of application Ser. No. 17/685,566, filed Mar. 3, 2022, now U.S. Pat. No. 11,484,756, which claims the benefit of U.S. Provisional Application No. 63/166,859, filed Apr. 26, 2021

This application is a continuation of application Ser. No. 17/876,746, filed Jul. 29, 2022, which claims the benefit of U.S. Provisional Application No. 63/289,908, filed Dec. 15, 2021, and claims the benefit of U.S. Provisional Application No. 63/232,767, filed Aug. 13, 2021

The disclosures of the above-listed applications are incorporated herein by reference in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to sports equipment, and more particularly, to golf club heads and methods to manufacture golf club heads.

BACKGROUND

In golf, various factors may affect the distance and direction that a golf ball may travel. In particular, the center of gravity (CG) and/or the moment of inertia (MOI) of a golf club head may affect the launch angle, the spin rate, and the direction of the golf ball at impact. Such factors may vary significantly based the type of golf swing.

Figure 1:
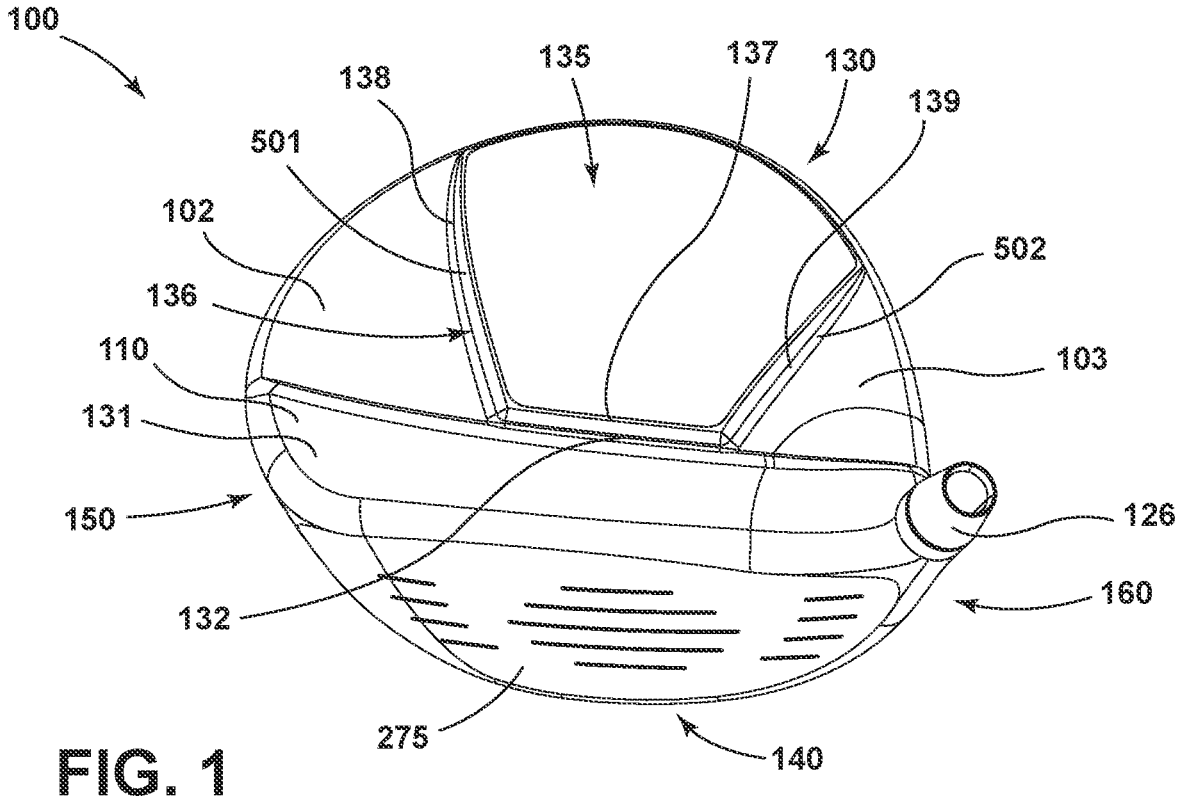
FIGS. 1, 2, 3, 4, 5, 6, 7, 8, 9, 10, 11, 12, and 13 illustrate a top perspective view, a bottom perspective view, a front view, a rear view, a top view, a bottom view, a heel side view, a toe side view, a cross-sectional view taken along section 9-9 of FIG. 5, a cross-sectional view taken along section 10-10, an exploded toe side view, an exploded rear view, and an exploded rear perspective view of an example golf club head according to an embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures are not necessarily drawn to scale. For example, the dimensions of some of the elements in the figures may be exaggerated relative to other elements to help improve understanding of embodiments of the present disclosure.

DESCRIPTION

In general, golf club heads, golf clubs, and methods to manufacture golf club heads and golf clubs are described herein. The following U.S. Patents and Patent Publications, which are collectively referred to herein as "the incorporated by reference patent documents," are incorporated by reference herein in their entirety: U.S. Pat. Nos. 11,103,755; 11,000,742; 10,981,037; 10,967,231; 10,960,275; 10,960,274; 10,926,142; 10,898,768; 10,898,766; 10,843,051; 10,821,334; 10,786,712; 10,722,765; 10,722,764; 10,709,942; 10,695,624; 10,695,623; 10,653,928; 10,617,918; 10,617,917; 10,583,336; 10,543,407; 10,532,257; 10,441,855; 10,420,990; 10,420,989; 10,413,787; 10,384,102; 10,376,754; 10,335,645; 10,293,221; 10,293,220; 10,252,123; 10,232,234; 10,213,659; 10,195,501; 10,143,899; 10,099,093; 10,052,532; 10,010,770; 9,999,814; 9,987,526; 9,981,160; 9,914,029; 9,895,583; 9,895,582; 9,861,867; 9,833,667; 9,821,201; 9,821,200; 9,814,945; 9,802,087; 9,795,843; 9,795,842; 9,782,643; 9,669,270; 9,662,547; 9,636,554; 9,630,070; 9,555,295; 9,550,096; 9,399,158; 9,352,197; and 9,199,140; and U.S. Patent Publications 20210228949; 20210220710; 20210205673; 20210197040; 20210197039; 20210138320; 20210128996; 20210121747; 20200346080; 20200206589; and 20180250560. The apparatus, methods, and articles of manufacture described herein are not limited in this regard.

In the example of FIGS. 1-13, a golf club head 100 may include a body portion 110 with a top portion 130, a crown portion 135, a bottom portion 140, a toe portion 150, a heel portion 160, a front portion 170, and a rear portion 180. The bottom portion 140 may include a skirt portion 190 defined as a side portion of the golf club head 100 between the top portion 130 and the bottom portion 140 excluding the front portion 170 and extending across a periphery of the golf club head 100 from the toe portion 150, around the rear portion 180, and to the heel portion 160. Alternatively, the golf club head 100 may not include the skirt portion 190. The front portion 170 may include a face portion 275 to engage a golf ball. The face portion 275 may be integral to the body portion 110 or may be a separate face portion that is coupled (e.g., welded) to the front portion 170 to enclose an opening in the front portion 170. The body portion 110 may also include a hosel portion configured to receive a shaft portion (not illustrated). The hosel portion may be similar in many respects to any of the hosel portions described herein. The hosel portion may include an interchangeable hosel sleeve 126 and a fastener 127. Alternatively, the body portion 110 may include a bore instead of the hosel portion. The body portion 110 may be made partially or entirely of an aluminum-based material, a magnesium-type material, a steel-based material, a titanium-based material, any combination thereof, or any other suitable material. In another example the body portion 110 may be made partially or entirely of a non-metal material such as a ceramic material, a composite material, any combination thereof, or any other suitable material. The apparatus, methods, and articles of manufacture described herein are not limited in this regard.

The golf club head 100 may have a club head volume greater than or equal to 300 cubic centimeters ($cm^3$ or cc). In one example, the golf club head 100 may be about 460 cc. Alternatively, the golf club head 100 may have a club head volume less than or equal to 300 cc. In particular, the golf club head 100 may have a club head volume between 100 cc and 200 cc. The club head volume of the golf club head 100 may be determined by using the weighted water displacement method (i.e., Archimedes Principle). For example, procedures defined by golf standard organizations and/or governing bodies such as the United States Golf Association (USGA) and/or the Royal and Ancient Golf Club of St. Andrews (R&A) may be used for measuring the club head volume of the golf club head 100. Although FIG. 1 may depict a particular type of club head (e.g., a driver-type club head), the apparatus, methods, and articles of manufacture described herein may be applicable to other types of club head (e.g., a fairway wood-type club head, a hybrid-type club head, an iron-type club head, a putter-type club head, etc.). The apparatus, methods, and articles of manufacture described herein are not limited in this regard.

Figure 8:
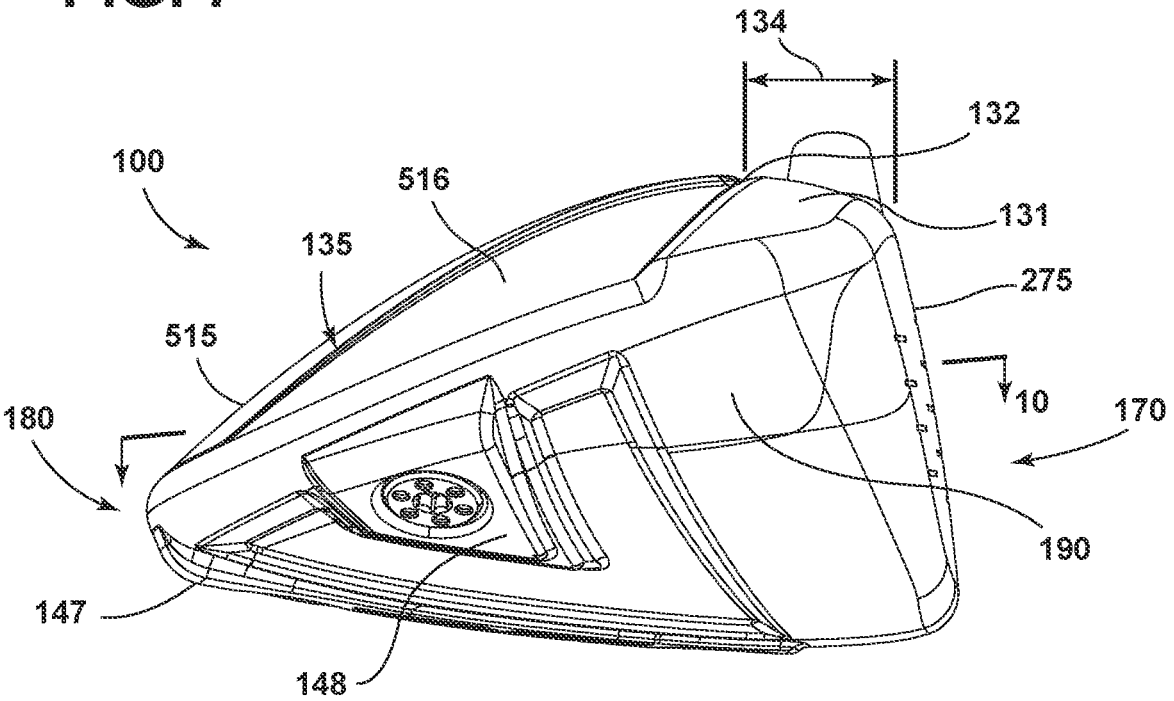

The top portion 130 may include a forward portion 131 extending a distance 134 between the front portion 170 and the crown portion 135, as illustrated in FIG. 8. In one example, the forward portion 131 may extend a distance 134 of at least 8 mm (millimeters) in a front-to-rear direction, resulting in the crown portion 135 being positioned at least 8 mm rearward of the face portion 275. In another example, the forward portion 131 may extend a distance 134 of at least 12 mm in a front-to-rear direction. In another example, the forward portion 131 may extend a distance 134 of at least 16 mm in a front-to-rear direction. In yet another example, the forward portion 131 may extend a distance 134 of at least 20 mm in a front-to-rear direction. In still another example, the forward portion 131 may extend a distance 134 of between and including 12 mm and 20 mm in a front-to-rear direction. While the above examples may describe particular distances, the apparatus, methods, and articles of manufacture described herein may include a forward portion extending a distance less than 12 mm in a front-to-rear direction. The apparatus, methods, and articles of manufacture described herein are not limited in this regard.

The forward portion 131 may enhance structural integrity of the golf club head 100 and resist rearward deflection of the front portion 170 during impact with a golf ball. The forward portion 131 may transfer an impact force to the crown portion 135 during an impact with a golf ball. The forward portion 131 may distribute an impact force along a surface of the crown portion that abuts a junction 132 formed between the crown portion 135 and the forward portion 131 of the top portion 130. The forward portion 131 may be an integral portion of the body portion 110. In examples where the body portion 110 is formed through a metal (e.g. titanium) casting process, the forward portion 131 may be formed as an integral portion of the body portion during the casting process. The apparatus, methods, and articles of manufacture described herein are not limited in this regard.

The crown portion 135 may be a separate piece that may be attached to the top portion 130. The crown portion 135 may enclose an opening 1201 in the top portion 130. The crown portion 135 may include a heel-side perimeter 1131, a front perimeter 1132, a rear perimeter 1151, and a toe-side perimeter 1133. The apparatus, methods, and articles of manufacture described herein are not limited in this regard.

Figure 12:
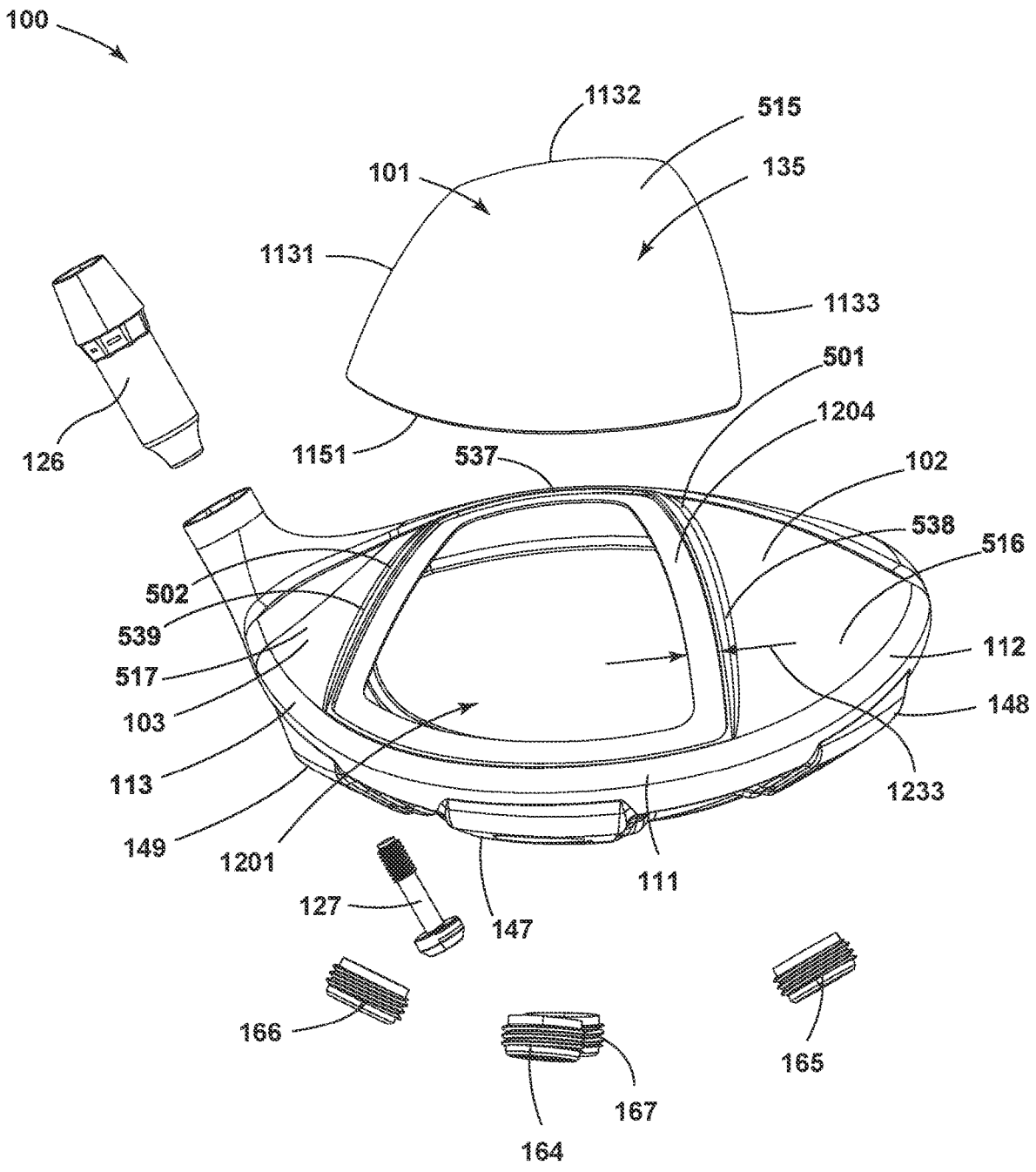
Figure 13:
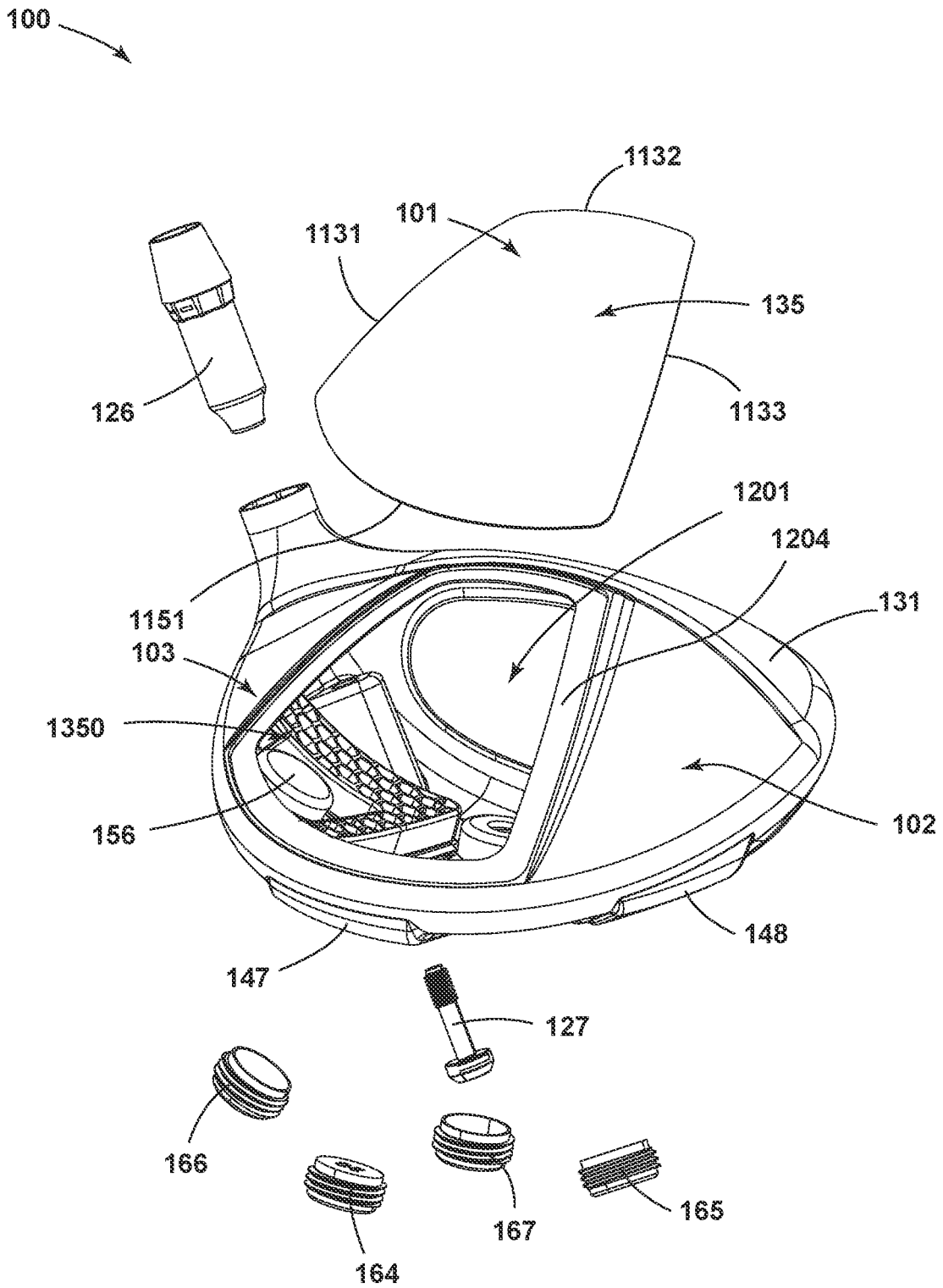

As illustrated in FIGS. 12 and 13, for example, the top portion 130 of the golf club head 100 may include an opening 1201 prior to installation of the crown portion 135. The crown portion 135 may be constructed from one or more materials, and those materials may be the same or different from the material of the body portion 110. In one example, the crown portion 135 may be at least partially constructed from a composite material such as a fiber-based composite material. The crown portion 135 may be attached to a shoulder portion 1204 of the top portion 130. The shoulder portion 1204 may extend along an entire perimeter of the opening 1201 in the top portion 130 or a portion of the opening in the top portion 130. The shoulder portion 1204 may support the crown portion 135. The shoulder portion 1204 may provide a surface suitable for joining (e.g. adhering) the crown portion 135 to the top portion. In one example, the shoulder portion 1204 may extend a distance 1233 of at least 2 mm inward toward the opening 1201 in the top portion 130. In another example, the shoulder portion 1204 may extend a distance 1233 of at least 6 mm. In yet another example, the shoulder portion 1204 may extend a distance 1233 of at least 8 mm. In still another example, the shoulder portion 1204 may extend a distance 1233 of between and including 2 mm and 8 mm. While the above examples may describe particular distances, the apparatus, methods, and articles of manufacture described herein may include a shoulder portion 1204 that extends a distance 1233 less than 2 mm inward toward the opening in the top portion 130. The shoulder portion 1204 may be a continuous portion encircling the opening 1201 in the top portion 130. Alternately, the shoulder portion 1204 may include one or more discrete shoulder portions arranged to support the crown portion 135. In another example, the shoulder portion 1204 may include a plurality of tabs arranged to support the crown portion 135. In still another example, the shoulder portion 1204 may be omitted, and the crown portion 135 may be adhered to an outer surface of the top portion 130 or to an inner surface of the top portion 130. In yet another example, the shoulder portion 1204 may be omitted, and the crown portion 135 may include a protrusion extending from a bottom surface of the crown portion 135 that provides an interference fit with a perimeter edge of the opening 1201 in the top portion 130. The apparatus, methods, and articles of manufacture described herein are not limited in this regard.

In one example, the crown portion 135 may have a thickness of less than 1.0 mm. In another example, the crown portion 135 may have a thickness of less than 0.75 mm. In yet another example, the crown portion 135 may have a thickness of less than or equal to 0.65 mm. The crown portion 135 may be made of a composite material. While the above examples may describe particular thicknesses, the apparatus, methods, and articles of manufacture described herein may have a thickness greater than or equal to 1.0 mm. The apparatus, methods, and articles of manufacture described herein are not limited in this regard.

In one example, the crown portion 135 may form at least 45% of an exterior surface area of the top portion 130. In another example, the crown portion 135 may form at least 55% of an exterior surface area of the top portion 130. In yet another example, the crown portion 135 may form at least 65% of an exterior surface area of the top portion 130. While the above examples may describe particular percentages, the crown portion 135 may form less than 45% of the exterior surface area of the top portion 130. The apparatus, methods, and articles of manufacture described herein are not limited in this regard.

A top stiffening portion 136 may enhance stiffness of the top portion 130. The top stiffening portion 136 may compensate for the presence of one or more relatively less stiff, thin, or lightweight regions elsewhere in the top portion 130 or crown portion 135. The top stiffening portion 136 may enhance overall stiffness of the golf club head 100. The top stiffening portion 136 may limit rearward deflection of the face portion 275 and/or forward portion 131 toward the rear portion 180 in response to the face portion 275 impacting a golf ball. The top stiffening portion 136 may resist physical compression of the crown portion 135 in a front-to-rear direction in response to the face portion 275 impacting a golf ball, which may reduce risk of cracking or delaminating of the crown portion 135 in examples where the crown portion 135 is constructed of two or more layers of composite material. The top stiffening portion 136 may be a raised portion of the top portion 130. The top stiffening portion 136 may be part of a contoured portion of the top portion 130. The top stiffening portion 136 may serve as a visual alignment aid for a golfer aligning a golf shot. The top stiffening portion 136 may improve acoustic response of the golf club head 100 in response to the face portion 275 impacting a golf ball. The top stiffening portion 136 may have a thickness greater than another region of the top portion 130 or the crown portion 135. The top stiffening portion 136 may have a thickness greater than an average thickness of the crown portion 135. The top stiffening portion 136 may be integral to the top portion 130. The top stiffening portion 136 may be one or more separate portions adhered or joined to the top portion 130 to provide structural reinforcement. The apparatus, methods, and articles of manufacture described herein are not limited in this regard.

As mentioned above, the top portion 130 may include one or more top stiffening portions. In one example, the top stiffening portion 136 may include a first top stiffening portion 137, a second top stiffening portion 138, and a third top stiffening portion 139, as illustrated in FIG. 1. The first top stiffening portion 137 may be located adjacent to the forward portion 131 of the top portion 130. The first top stiffening portion 137 may have a thickness greater than an average thickness of the crown portion 135. In one example, the first top stiffening portion 137 may have a thickness of greater than 2 mm. In another example, the first top stiffening portion 137 may have a thickness of greater than or equal to 2.1 mm. In another example, the first top stiffening portion 137 may have a thickness of greater than or equal to 2.2 mm. In still another example, the first top stiffening portion 137 may have a thickness of greater than or equal to 2.4 mm. While the above examples may describe particular thickness, the apparatus, methods, and articles of manufacture described herein may include the first top stiffening portion 137 with a thickness of less than or equal to 2 mm. In one example, the first top stiffening portion 137 may have a length of at least 1.25 cm in a heel-to-toe direction. In another example, the first top stiffening portion 137 may have a length of at least 2 cm in a heel-to-toe direction. In yet another example, the first top stiffening portion 137 may have a length of at least 3 cm in a heel-to-toe direction. In still yet another example, the first top stiffening portion 137 may have a length of at least 4 cm in a heel-to-toe direction. In another example, the first top stiffening portion 137 may have a length of between and including 4 and 4.5 cm in a heel-to-toe direction. While the above examples may describe particular lengths, the apparatus, methods, and articles of manufacture describe herein may include the first top stiffening portion 137 having a length of less than 3 cm. The first top stiffening portion 137 may reduce aerodynamic drag of the golf club head 100. The apparatus, methods, and articles of manufacture described herein are not limited in this regard.

The second top stiffening portion 138 may extend from the first top stiffening portion 137 toward the rear portion 180. The second top stiffening portion 138 may extend from the first top stiffening portion 137 toward the rear portion 180 and toward the toe portion 150. The second top stiffening portion 138 may extend from a toe-side end of the first top stiffening portion 137 to a rear perimeter of the crown portion 135. The second top stiffening portion 138 may extend from the first top stiffening portion 137 toward a weight port region on the bottom portion 140. The second top stiffening portion 138 may extend from the first top stiffening portion 137 toward a weight port region on the bottom portion 140, where the weight port region is closer to the toe portion 150 than other weight port regions on the bottom portion. The second top stiffening portion 138 may taper in width in a front-to-rear direction. The apparatus, methods, and articles of manufacture described herein are not limited in this regard.

The second top stiffening portion 138 may serve as a support structure between the forward portion 131 and the rear portion 180. The second top stiffening portion 138 may oppose rearward deflection of the forward portion 131 in response to the face portion 275 impacting a golf ball. The second top stiffening portion 138 may have a thickness greater than an average thickness of the crown portion 135. The second top stiffening portion 138 may have a thickness of greater than 2 mm. The second top stiffening portion 138 may have a thickness of greater than or equal to 2.1 mm. The second top stiffening portion 138 may have a thickness of greater than or equal to 2.2 mm. While the above examples may describe particular thicknesses, the apparatus, methods, and articles of manufacture described herein may include the second top stiffening portion 138 with a thickness of less than or equal to 2 mm. In one example, the second top stiffening portion 138 may have a length of at least 2 cm. In another example, the second top stiffening portion 138 may have a length of at least 4 cm. While the above examples may describe particular lengths, the apparatus, methods, and articles of manufacture describe herein may include a second top stiffening portion 138 having a length less than 2 cm. The second top stiffening portion 138 may reduce aerodynamic drag of the golf club head. The apparatus, methods, and articles of manufacture described herein are not limited in this regard.

The third top stiffening portion 139 may extend from the first top stiffening portion 137 toward the rear portion 180. The third top stiffening portion 139 may extend from the first top stiffening portion 137 toward the rear portion 180 and toward the heel portion 160. The third top stiffening portion 139 may extend from a heel-side end of the first top stiffening portion 137 to a rear perimeter of the crown portion 135. The third top stiffening portion 139 may extend from the first top stiffening portion 137 toward a weight port region on the bottom portion 140. The third top stiffening portion 139 may extend from the first top stiffening portion 137 toward a weight port region on the bottom portion 140, where the weight port region is closer to the heel portion 160 than other weight port regions on the bottom portion. The third top stiffening portion 139 may taper in width in a front-to-rear direction. The apparatus, methods, and articles of manufacture described herein are not limited in this regard.

The third top stiffening portion 139 may serve as a support structure between the forward portion 131 and the rear portion 180. The third top stiffening portion 139 may oppose rearward deflection of the forward portion 131 in response to the face portion 275 impacting a golf ball. The third top stiffening portion 139 may have a thickness greater than an average thickness of the crown portion 135. The third top stiffening portion 139 may have a thickness of greater than 2 mm. The third top stiffening portion 139 may have a thickness of greater than or equal to 2.1 mm. The third top stiffening portion 139 may have a thickness of greater than or equal to 2.2 mm. While the above examples may describe particular thicknesses, the apparatus, methods, and articles of manufacture described herein may include the third top stiffening portion 139 with a thickness of less than or equal to 2 mm. The third top stiffening portion 139 may have a length of at least 2 cm. The third top stiffening portion 139 may have a length of at least 4 cm. The third top stiffening portion 139 may reduce aerodynamic drag of the golf club head. While the above example may describe a particular number of top stiffening portions, the apparatus, methods, and articles of manufacture described herein may include more or fewer top stiffening portions. The apparatus, methods, and articles of manufacture described herein are not limited in this regard.

Figure 7:
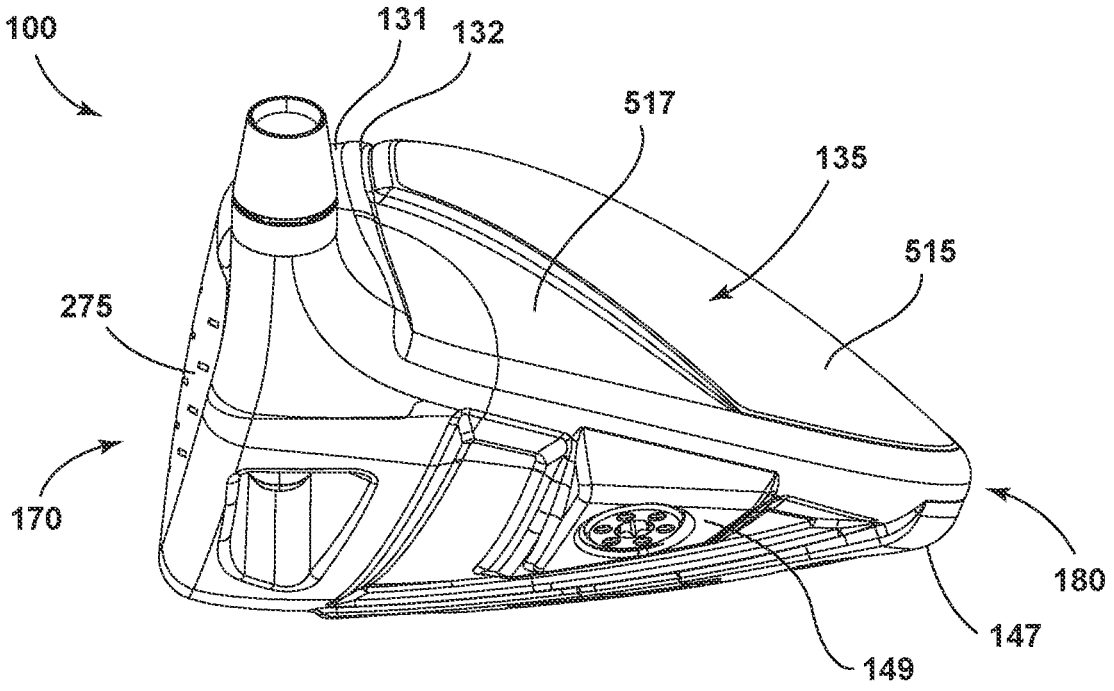

The top portion 130 may include a central top portion 101, a toe-side top portion 102, and a heel-side top portion 103. The central top portion 101 may be a raised and located between the heel-side top portion 103 and the toe-side top portion 102. The central top portion 101 may have a maximum height greater than a maximum height of the toe-side top portion 102, as illustrated in FIG. 8. The central top portion 101 may have a maximum height greater than a maximum height of the heel-side top portion 103, as illustrated in FIG. 7. The central top portion 101 may serve as a visual alignment aid. The central top portion 101 may improve aerodynamic performance of the golf club head 100. The central top portion 101 may stiffen the top portion 130 and reduce deflection (e.g. bulging) of the top portion 130 in response to the face portion 275 impacting a golf ball. Reducing bulging of the top portion 130 may be desirable to reduce shear stress on a joint (e.g. an adhesive bond) between the crown portion 135 and the shoulder portion 1204 of the opening 1201 in the top portion 130. The apparatus, methods, and articles of manufacture described herein are not limited in this regard.

The central top portion 101 may include a thin portion. The toe-side top portion 102 may include a thin portion. The heel-side top portion 103 may include a thin portion. Thin portions may be desirable to reduce overall mass of the top portion 130, which may lower the CG of the golf club head 100. The apparatus, methods, and articles of manufacture described herein are not limited in this regard.

The top portion 130 may include a plurality of contoured surfaces. The plurality of contoured surfaces may generate turbulent flow across the top portion 130 of the golf club head 100 during a golf swing. The plurality of contoured surfaces may reduce aerodynamic drag of the golf club head 100. The plurality of contoured surfaces may enhance rigidity of the golf club head 100. The plurality of contoured surfaces may enhance structural integrity of the golf club head 100. The apparatus, methods, and articles of manufacture described herein are not limited in this regard An outer surface 515 of the central top portion 101 may be elevated above an outer surface 516 of the toe-side top portion 102. The outer surface 515 area of the central top portion 101 may be elevated above an outer surface 517 of the heel-side top portion 103. The apparatus, methods, and articles of manufacture described herein are not limited in this regard. The apparatus, methods, and articles of manufacture described herein are not limited in this regard The top portion 130 may include a first contoured transition region 501 located between the central top portion 101 and the toe-side top portion 102. The crown portion 135 may include a second contoured transition region 502 located between the central top portion 101 and the heel-side top portion 103. The location of the first contoured transition region 501 may coincide with the location of the second top stiffening portion 138. The location of the second contoured transition region 502 may coincide with the location of the third top stiffening portion 139. Together, the central top portion 101, toe-side top portion 102, heel-side top portion 103, first contoured transition region 501, and second contoured transition region 502 may form a multi-level top portion 130. Together, the central top portion 101, toe-side top portion 102, heel-side top portion 103, first contoured transition region 501, and second contoured transition region 502 may form a multi-thickness top portion 130. The apparatus, methods, and articles of manufacture described herein are not limited in this regard.

Figure 5:
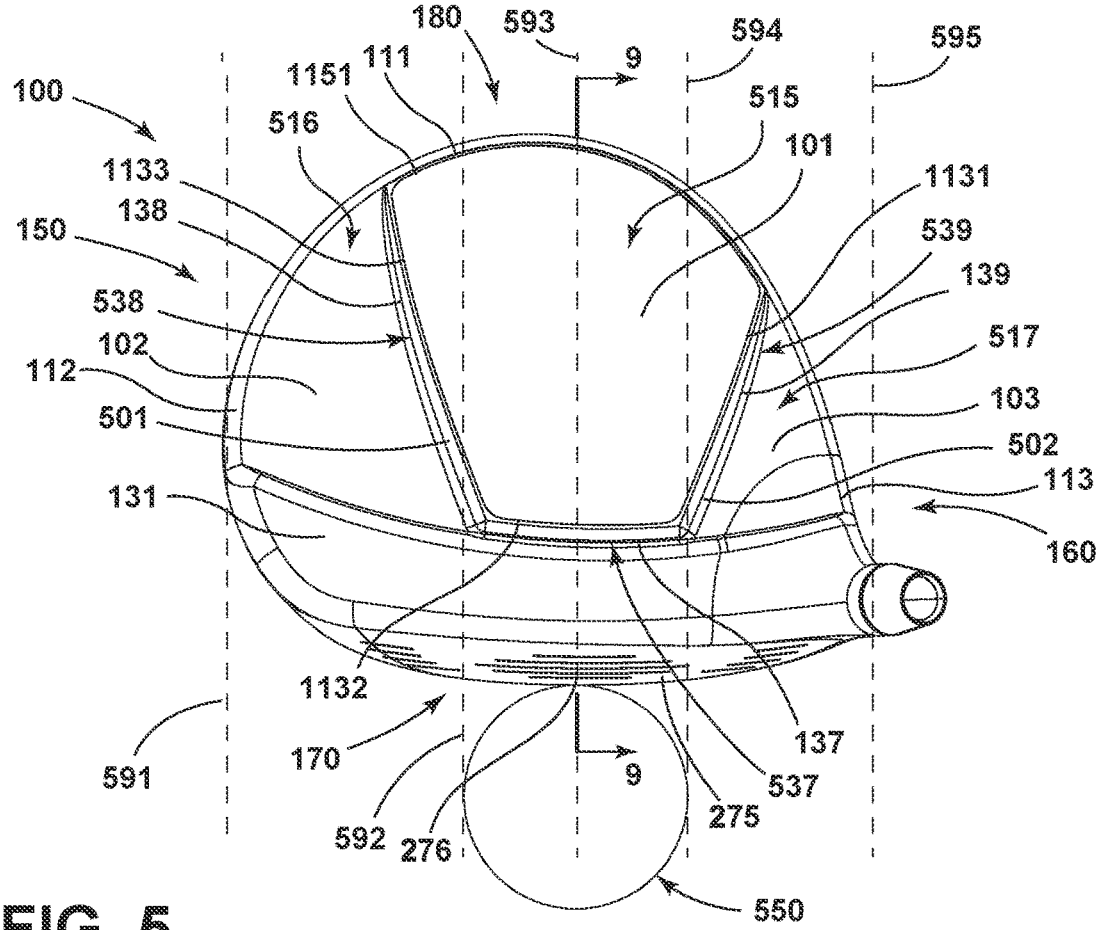
Figure 9:
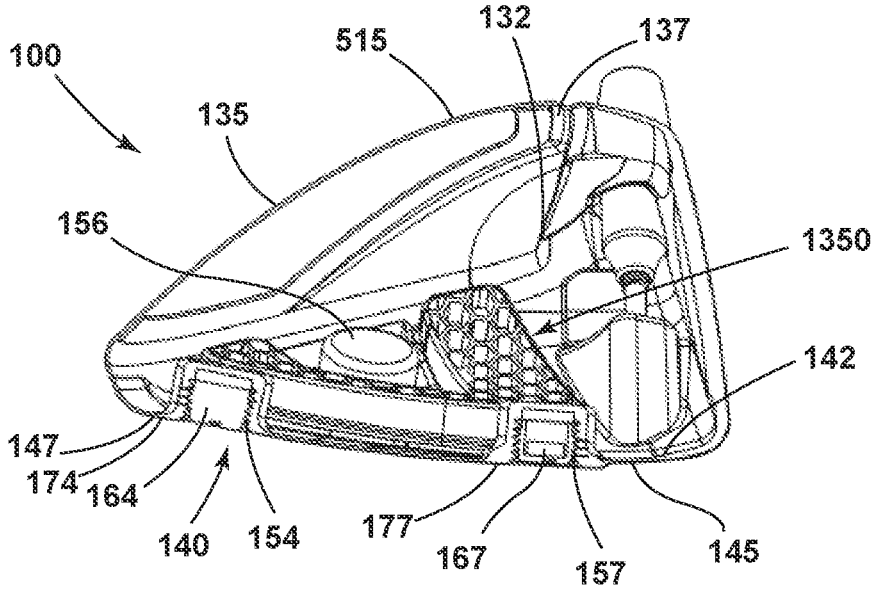

FIG. 9 depicts a cross-sectional toe side view of the example golf club head of FIG. 1 taken at section line 9-9 of FIG. 5. The outer surface 515 of the central top portion 101 may be elevated above an outer surface 517 of the heel-side top portion 103. In one example, the outer surface 515 of the central top portion 101 may be elevated above an outer surface 517 of the heel-side top portion 103 by a height of greater than or equal to 0.5 mm. In another example, the outer surface 515 of the central top portion 101 may be elevated above an outer surface 517 of the heel-side top portion 103 by a height of greater than or equal to 1.0 mm. In yet another example, the outer surface 515 of the central top portion 101 may be elevated above an outer surface 517 of the heel-side top portion 103 by a height of greater than or equal to 2.0 mm. The apparatus, methods, and articles of manufacture described herein are not limited in this regard.

The outer surface 515 of the central top portion 101 may be elevated above an outer surface 516 of the toe-side top portion 102. In one example, the outer surface 515 of the central top portion 101 may be elevated above an outer surface 516 of the toe-side top portion 102 by a height of greater than or equal to 0.5 mm. In another example, the outer surface 515 of the central top portion 101 may be elevated above an outer surface 516 of the toe-side top portion 102 by a height of greater than or equal to 1.0 mm. In yet another example, the outer surface 515 of the central top portion 101 may be elevated above an outer surface 516 of the toe-side top portion 102 by a height of greater than or equal to 2.0 mm. While the above examples may describe particular heights, the apparatus, methods, and articles of manufacture described herein may include outer surfaces with a difference in height of less than 0.5 mm. The apparatus, methods, and articles of manufacture described herein are not limited in this regard.

As illustrated in FIG. 7, the outer surface 517 of the heel-side top portion 103 may be recessed below the forward portion 131 proximate to the junction 132. Likewise, as illustrated in FIG. 8, the outer surface 516 of the toe-side top portion 102 may be recessed below the forward portion 131 proximate the junction 132. In one example, the outer surface 517 of the heel-side top portion 103 may be recessed below the forward portion 131 proximate to the junction 132 by a distance of greater than or equal to 0.5 mm. In another example, the outer surface 517 of the heel-side top portion 103 may be recessed below the forward portion 131 proximate to the junction 132 by a distance of greater than or equal to 1.0 mm. In yet another example, the outer surface 516 of the toe-side top portion 102 may be recessed below the forward portion 131 proximate the junction 132 by a distance of greater than or equal to 0.5 mm. The outer surface 516 of the toe-side top portion 102 may be recessed below the forward portion 131 proximate the junction 132 by a distance of greater than or equal to 1.0 mm. While the above examples may describe particular distances, the apparatus, methods, and articles of manufacture described herein may include outer surfaces recessed by distances of less than 0.5 mm. The apparatus, methods, and articles of manufacture described herein are not limited in this regard.

The central top portion 101 may be bounded by the first contoured transition region 501, the second contoured transition region 502, a rear perimeter 1151, and a front perimeter 1132, as illustrated in FIGS. 5 and 12. The central top portion 101 may be bounded by the first contoured transition region 501, the second contoured transition region 502, a rear body perimeter 111, and a front perimeter 1132, as illustrated in FIG. 5. The central top portion 101 may be bounded by the first top stiffening portion 137, the second top stiffening portion 138, the third top stiffening portion 139, and the rear perimeter 1151, as illustrated in FIG. 5. The apparatus, methods, and articles of manufacture described herein are not limited in this regard.

A front region of the central top portion 101 may have a symmetrical shape relative to a central vertical plane 593 that intersects the geometric center (e.g., at or proximate to a "sweet spot" of the golf club head 100) on the face portion 275 and is normal to a front vertical plane. A front portion of the central top portion 101 may have a nonsymmetrical shape relative to the central vertical plane 593 that intersects the geometric center on the face portion 275 and is normal to the front vertical plane. The apparatus, methods, and articles of manufacture described herein are not limited in this regard.

In one example, the second top stiffening portion 138 and third top stiffening portion 139 may diverge in a front-to-rear direction, as illustrated in FIG. 5. The central top portion 101 may have an irregular polygon-like shape (e.g., a quadrilateral-like shape). The distance between the second top stiffening portion 138 and third top stiffening portion 139 at or proximate to the front portion 170 may be less than the distance between the second top stiffening portion 138 and third top stiffening portion 139 at or proximate to the rear portion 180. In another example, the second top stiffening portion 138 and third top stiffening portion 139 may converge in a front-to-rear direction. A distance between the second top stiffening portion 138 and third top stiffening portion 139 at or proximate to the front portion 170 may be greater than a distance between the second top stiffening portion 138 and third top stiffening portion 139 at or proximate to the rear portion 180. In yet another example, the second top stiffening portion 138 and third top stiffening portion 139 may converge and then diverge in a front-to-rear direction. In another example, the second top stiffening portion 138 and third top stiffening portion 139 may diverge and then converge in a front-to-rear direction. In still another example, the second top stiffening portion 138 and third top stiffening portion 139 may be substantially parallel in a front-to-rear direction. The distance between the second top stiffening portion 138 and third top stiffening portion 139 at or proximate to the front portion 170 may be equal or substantially the same as the distance between the second top stiffening portion 138 and third top stiffening portion 139 at or proximate to the rear portion 180. The apparatus, methods, and articles of manufacture described herein are not limited in this regard.

In one example, as illustrated in FIG. 1, the central top portion 101 may be raised relative to the toe-side top portion 102 and the heel-side top portion 103, resulting in a central top portion 101 that is elevated. Variations in relative heights of the central top portion 101, toe-side top portion 102, and heel-side top portion 103 may improve aerodynamic performance by reducing a drag coefficient associated with the golf club head 100. Variations in relative heights of the central top portion 101, toe-side top portion 102, and heel-side top portion 103 may provide a visual alignment aid. Variations in relative heights of the central top portion 101, toe-side top portion 102, and heel-side top portion 103, together with contoured transition regions (first contoured transition region 501, second contoured transition region 502) with integral ribs, may enhance structural integrity of the top portion 130. In another example, the central top portion 101 may be depressed relative to the toe-side top portion 102 and the heel-side top portion 103. The apparatus, methods, and articles of manufacture described herein are not limited in this regard.

The total surface area of the top portion 130 may include surface areas of the central top portion 101, toe-side top portion 102, heel-side top portion 103, first contoured transition region 501, second contoured transition region 502, and the forward portion 131. In one example, the surface area of the central top portion 101 may be less than or equal to 40% of the total surface area of the top portion 130. In another example, the surface area of the central top portion 101 may be at least 10% of the total surface area of the top portion 130. In another example, the surface area of the central top portion 101 may be at least 20% of the total surface area of the top portion 130. In yet another example, the surface area of the central top portion 101 may be at least 30% of the total surface area of the top portion 130. In still yet another example, the surface area of the central top portion 101 may be at least 40% of the total surface area of the top portion 130. In still yet another example, the surface area of the central top portion 101 may be at least 50% of the surface area of the top portion 130. In another example, the surface area of the central top portion 101 may be at least 60% of the total surface area of the top portion 130. In still yet another example, the surface area of the central top portion 101 may be at least 70% of the total surface area of the top portion 130. In still yet another example, the surface area of the central top portion 101 may be at least 80% of the total surface area of the top portion 130. In still yet another example, the surface area of the central top portion 101 may be at least 90% of the total surface area of the top portion 130. The apparatus, methods, and articles of manufacture described herein are not limited in this regard.

The toe-side top portion 102 may be bounded by the first contoured transition region 501, a toe-side body perimeter 112, and the forward portion 131. In one example, the surface area of the toe-side top portion 102 may be at least 5% of the total surface area of the top portion 130. In another example, the surface area of the toe-side top portion 102 may be at least 10% of the total surface area of the crown portion 135. In yet another example, the surface area of the toe-side top portion 102 may be at least 15% of the total surface area of the top portion 130. In still yet another example, the surface area of the toe-side top portion 102 may be at least 20% of the surface area of the top portion 130. In still yet another example, the surface area of the toe-side top portion 102 may be at least 25% of the total surface area of the top portion 130. In still yet another example, the surface area of the toe-side top portion 102 may be at least 30% of the total surface area of the top portion 130. In still yet another example, the surface area of the toe-side top portion 102 may be at least 35% of the total surface area of the top portion 130. In still yet another example, the surface area of the toe-side top portion 102 may be at least 40% of the total surface area of the top portion 130. The apparatus, methods, and articles of manufacture described herein are not limited in this regard.

The heel-side top portion 103 may be bounded by the second contoured transition region 502, a heel-side body perimeter 113, and the forward portion 131. In one example, the surface area of the heel-side top portion 103 may be at least 5% of the total surface area of the top portion 130. In another example, the surface area of the heel-side top portion 103 may be at least 10% of the total surface area of the top portion 130. In yet another example, the surface area of the heel-side top portion 103 may be at least 15% of the total surface area of the top portion 130. In still yet another example, the surface area of the heel-side top portion 103 may be at least 20% of the total surface area of the top portion 130. In still yet another example, the surface area of the heel-side top portion 103 may be at least 25% of the total surface area of the top portion 130. In still yet another example, the surface area of the heel-side top portion 103 may be at least 30% of the total surface area of the top portion 130. The apparatus, methods, and articles of manufacture described herein are not limited in this regard.

In one example, the outer surface 515 area of the central top portion 101 may be greater than or equal to 40% of a total outer surface area of the top portion 130, the outer surface 516 area of the toe-side top portion 102 may be less than or equal to 30% of the total outer surface area of the top portion 130, and the outer surface 517 area of the heel-side top portion 103 be less than or equal to 15% of the total outer surface area of the top portion 130. In another example, the area of the outer surface 515 of the central top portion 101 may be greater than or equal to 50% of a total outer surface area of the top portion 130, the outer surface area of the toe-side top portion 102 may be greater than or equal to 15% of the total outer surface area of the top portion 130, and the outer surface area of the heel-side top portion 103 be greater than or equal to 5% of the total outer surface area of the top portion 130. In another example, the area of the outer surface 515 of the central top portion 101 may be greater than or equal to 30% of a total outer surface area of the top portion 130, the outer surface area of the toe-side top portion 102 may be greater than or equal to 10% of the total outer surface area of the top portion 130, and the outer surface area of the heel-side top portion 103 be greater than or equal to 5% of the total outer surface area of the top portion 130. The apparatus, methods, and articles of manufacture described herein are not limited in this regard.

FIG. 5 depicts a top view of the example golf club head 100 of FIG. 1 with a golf ball 550 proximate to the face portion 275. The golf ball 550 may be in contact with and aligned with a geometric center 276 of the face portion 275. The golf ball 550 may have a diameter of about 1.68 inches. A central vertical plane 593 bisects the golf ball 550 and the golf club head 100. A toe-side bounding plane 591 bounds a toe-side of the golf club head 100. A heel-side bounding plane 595 bounds a heel-side of the golf club head 100. A toe-side dividing plane 592 divides the toe-side of the golf club head and bounds a toe-side of the golf ball 550. A heel-side dividing plane 594 divides the heel-side of the golf club head and bounds a heel-side of the golf ball 550. The top portion 130 may include a perimeter that includes a toe-side perimeter, heel-side perimeter, front perimeter, and rear perimeter. The apparatus, methods, and articles of manufacture described herein are not limited in this regard.

The top portion 130 of the golf club head 100 may include a plurality of integral ribs. The integral ribs may form the top stiffening portion 136. The integral ribs (e.g., generally illustrated as central integral rib 537, toe-side integral rib 538, and heel-side integral rib 539) may provide embedded structural supports within the top portion 130. Each integral rib may be located in a top stiffening region adjacent to one or more thin portions. The top portion 130 may have contoured transition regions (e.g., generally illustrated as first contoured transition region 501 and second contoured transition region 502) between the thin portions and the thicker top stiffening portions where the integral ribs reside. Contoured transition regions may prevent or mitigate unwanted stress concentrations within the top portion 130 by avoiding distinct edges between thin portions and adjacent thicker portions (e.g., such as first top stiffening portion 137, second top stiffening portion 138, or third top stiffening portion 139). Stress concentrations may be undesirable as they may result in cracking or delaminating of layers of the top portion 130 during use of the golf club head 100. For example, in an alternative embodiment having non-integral ribs attached to either an inner or outer surface of the top portion 130, a distinct edge may exist at a junction formed between a non-integral rib and a surface of the top portion 130, and that edge may introduce an unwanted stress concentration. After numerous ball strikes, presence of the stress concentration may result in cracking of the top portion 130 proximate to the non-integral rib. This physical deterioration of the top portion 130 may negatively impact performance of the golf club head 100. For instance, as the top portion 130 physically deteriorates, shot-to-shot variability may increase. Shot-to-shot variability may be unacceptable to an individual who requires consistent performance from the golf club head 100. Physical deterioration of the top portion 130 may also negatively affect appearance of the golf club head 100. For the sake of long-term durability, consistency, and appearance, it is therefore desirable to have a top portion 130 with contoured transition regions (first contoured transition region 501, second contoured transition region 502) between the thin portions and the thicker portions containing integral ribs. The apparatus, methods, and articles of manufacture described herein are not limited in this regard.

The top portion 130 may include a toe-side integral rib 538. The toe-side integral rib 538 may extend from the front perimeter 1132 of the crown portion 135 to the rear perimeter 1151 of the crown portion. The toe-side integral rib 538 may extend rearward from the forward portion 131. The toe-side integral rib 538 may extend rearward from a starting location between the central vertical plane 593 and the toe-side dividing plane 592 and terminate at an ending location between the toe-side bounding plane 591 and the toe-side dividing plane 592. The apparatus, methods, and articles of manufacture described herein are not limited in this regard.

In one example, the toe-side integral rib 538 may have a maximum thickness between and including 1.0 mm and 2.0 mm. In another example, the toe-side integral rib 538 may have a maximum thickness greater than or equal to 1.0 mm. In another example, the toe-side integral rib 538 may have a maximum thickness greater than or equal to 2.0 mm. In another example, the toe-side integral rib 538 may have a maximum thickness greater than or equal to 2.1 mm. In yet another example, the toe-side integral rib 538 may have a maximum thickness greater than or equal to 2.2 mm. In yet another example, the toe-side integral rib 538 may have a maximum thickness greater than or equal to 2.4 mm. While the above examples may describe particular thicknesses, the apparatus, methods, and article of manufacture described herein may include the toe-side integral rib 538 with a maximum thickness of less than 2 mm. The apparatus, methods, and articles of manufacture described herein are not limited in this regard.

The top portion 130 may include a heel-side integral rib 539. The heel-side integral rib 539 may extend from a front perimeter 1132 of the crown portion 135 to a rear perimeter 1151 of the crown portion. The heel-side integral rib 539 may extend rearward from the forward portion 131. The heel-side integral rib 539 may extend rearward from a starting location between the central vertical plane 593 and the heel-side dividing plane 594 and terminate at an ending location between the heel-side bounding plane 595 and the heel-side dividing plane 594. The apparatus, methods, and articles of manufacture described herein are not limited in this regard.

In one example, the heel-side integral rib 539 may have a maximum thickness between and including 1.0 mm and 2.0 mm. In another example, the heel-side integral rib 539 may have a maximum thickness greater than or equal to 1.0 mm. In another example, the heel-side integral rib 539 may have a maximum thickness greater than or equal to 2.0 mm. In another example, the heel-side integral rib 539 may have a maximum thickness greater than or equal to 2.1 mm. In yet another example, the heel-side integral rib 539 may have a maximum thickness greater than or equal to 2.4 mm. While the above examples may describe particular thicknesses, the apparatus, methods, and article of manufacture described herein may include the heel-side integral rib 539 with a maximum thickness of less than 2 mm. The apparatus, methods, and articles of manufacture described herein are not limited in this regard.

The top portion 130 may include a central integral rib 537. The central integral rib 537 may extend along the front perimeter 1132 of the crown portion 135. The central integral rib 537 may extend from the toe-side integral rib 538 to the heel-side integral rib 539. The central integral rib 537 may extend from a forward-most end of the toe-side integral rib 538 to a forward-most end of the heel-side integral rib 539. The central integral rib 537 may extend a distance of at least 3 centimeters beside the junction 132 formed between the front perimeter 1132 of the crown portion 135 and the forward portion 131 of the top portion 130. The central integral rib 537 may be located between the toe-side dividing plane 592 and the heel-side dividing plane 594. The central integral rib 537 and the face portion 275 may have parallel curves. In one example, the central integral rib 537 may have a maximum thickness greater than or equal to 2.0 mm. In another example, the central integral rib 537 may have a maximum thickness greater than or equal to 2.1 mm. In yet another example, the central integral rib 537 may have a maximum thickness greater than or equal to 2.4 mm. While the above examples may describe particular thicknesses, the apparatus, methods, and article of manufacture described herein may include the central integral rib 537 with a maximum thickness of less than 2 mm. The apparatus, methods, and articles of manufacture described herein are not limited in this regard.

The integral ribs (e.g., generally illustrated as central integral rib 537, toe-side integral rib 538, and heel-side integral rib 539) may enhance the flexural strength of the top portion 130. The integral ribs may enhance the compressive strength of the top portion 130. The integral ribs may reduce outward deflection (e.g., bulging) of the top portion 130 in response to an impact force transferred from the body portion 110 to the crown portion 135 during impact with a golf ball. The integral ribs may reduce deflection of the crown portion 135 inward toward in the interior cavity of the golf club head 100 in response to a downward force applied to an outer surface of the crown portion 135. Inward deflection of the crown portion 135 may be easier to accurately measure in a test environment than outward deflection. In certain instances, resistance to inward deflection may correlate to resistance to outward deflection. Inward deflection may be measured by applying a downward force to an outer surface of the crown portion and measuring physical deflection of the crown portion with a suitable measuring device. In one example, when a downward force of 200 pound-force (lbf) is applied to the central top portion 101, the central top portion 101 may deflect less than 0.025 inch. In another example, when a downward force of 200 lbf is applied to the central top portion 101, the central top portion 101 may deflect less than 0.015 inch. In another example, when a downward force of 200 lbf is applied to the central top portion 101, the central top portion 101 may deflect less than 0.012 inch. The apparatus, methods, and articles of manufacture described herein are not limited in this regard.

Certain rules or regulations imposed by the USGA or other governing bodies may limit a spring-like effect of certain designs, materials, or constructions of golf club heads. To ensure the golf club head 100 conforms to certain rules and regulations, it may therefore be desirable to minimize spring-like effects of certain aspects of the club head. For instance, it may be desirable to minimize a spring-like effect of the top portion 130 by reinforcing the crown portion to minimize deflection during use. The integral ribs may allow the top portion 130 to resist deflection better than a similar lightweight crown portion that lacks integral ribs. In one example, the top portion 130 with integral ribs may only deflect inward about 0.012 inch whereas a crown portion without integral ribs may deflect about 0.020 inch in response to applying a downward force of 200 lbf to the respective crown portions. The apparatus, methods, and articles of manufacture described herein are not limited in this regard.

As illustrated in FIG. 5, the toe-side integral rib 538 and the heel-side integral rib 539 may diverge in a front-to-rear direction along the top portion 130. In another example, the toe-side integral rib 538 and heel-side integral rib 539 may converge in a front-to-rear direction along the top portion 130. In yet another example, a toe-side integral rib 538 and a heel-side integral rib 539 may converge and then diverge in a front-to-rear direction along the top portion 130. In another example, the toe-side integral rib 538 and heel-side integral rib 539 may be substantially parallel in a front-to-rear direction along the top portion 130. The toe-side integral rib 538 may include one or more curved portions along its length. Similarly, the heel-side integral rib 539 may include one or more curved portions along its length. The apparatus, methods, and articles of manufacture described herein are not limited in this regard.

An outer surface of the top portion 130 may have an anti-glare finish. An outer surface of the top portion 130 may have a medium or low gloss appearance to reduce the amount of light reflected upward at an individual's eyes when aligning the golf club head 100 with a golf ball and performing a golf shot. A relative gloss value may be determined by projecting a beam of light at a fixed intensity and angle onto the outer surface of the top portion 130 and measuring the amount of light reflected at an equal but opposite angle upward at the individual. On a measurement scale, a specular reflectance of 0 gloss units (GU) may be associated with a perfectly matte surface, and a specular reflectance of 100 GU may be associated with a highly polished black glass material. Providing a top portion 130 with a relatively low specular reflectance may be desirable to reduce distraction perceived by the individual of the golf club head 100, which may reduce mishits and thereby improve performance. In one example, an outer surface of the top portion 130 may have a specular reflectance of less than 55 GU. In another example, the outer surface of the top portion 130 may have a specular reflectance of less than 40 GU. In yet another example, the outer surface of the top portion 130 may have a specular reflectance of less than 25 GU. In still another example, the outer surface of the top portion 130 may have a specular reflectance of less than 10 GU. While the above examples may describe particular specular reflectance, the apparatus, methods, and article of manufacture may include the outer surface of the top portion 130 with a specular reflectance greater than or equal to 55 GU. The apparatus, methods, and articles of manufacture described herein are not limited in this regard.

In some examples, the outer surface of the top portion 130 may include an antireflective coating 133. In one example, the antireflective coating 133 may have a specular reflectance of less than 55 GU. In another example, the antireflective coating 133 may have a specular reflectance of less than 40 GU. In yet another example, the antireflective coating 133 may have a specular reflectance of less than 25 GU. In still another example, the antireflective coating 133 may have a specular reflectance of less than 10 GU. The apparatus, methods, and articles of manufacture described herein are not limited in this regard.

Figure 6:
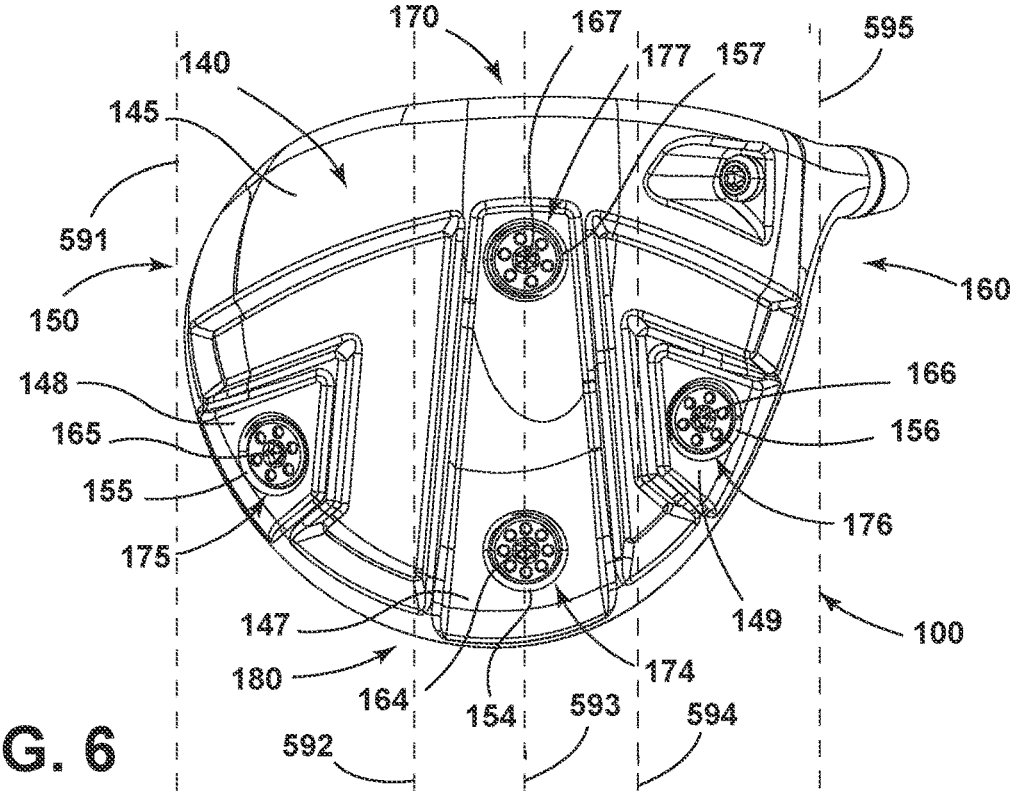

The golf club head 100 may include a plurality of weigh port regions. Each weight port region may include a weight port. Each weight port may include a weight. As illustrated in FIG. 6, a first weight port region 174 may be located closer to the rear portion 180 than the front portion 170. A second weight port region 175 may be located closer to the toe portion 150 than the heel portion 160. A third weight port region 176 may be located closer to the heel portion 160 than the toe portion 150. A fourth weight port region 177 may be located closer to the front portion 170 than the rear portion 180. The apparatus, methods, and articles of manufacture described herein are not limited in this regard.

The first weight port region 174 may include a first weight port 154 containing a first weight portion 164. The second weight port region 175 may include a second weight port 155 containing a second weight portion 165. The third weight port region 176 may include a third weight port 156 containing a third weight portion 166. The fourth weight port region 177 may include a fourth weight port 157 containing a fourth weight portion 167. The apparatus, methods, and articles of manufacture described herein are not limited in this regard.

The set of weight portions (e.g., generally illustrated as a first weight portion 164, a second weight portion 165, a third weight portion 166, and a fourth weight portion 167) may have similar or different masses. By using weight portions having similar or different masses in each of the weight ports, the overall mass in a weight port region and/or the mass distribution in the weight port regions may be adjusted to generally optimize and/or adjust the swing weight, center of gravity, moment of inertia, and/or an overall feel of the golf club head 100 for an individual using the golf club head 100. In one example, the set of weight portions may collectively have a mass of at least 8 grams. In another example, the set of weight portions may collectively have a mass of at least 12 grams. In yet another example, the set of weight portions may collectively have a mass of between and including 8 grams and 13 grams. In still yet another example, the set of weight portions may collectively have a mass of between and including 12 grams and 16 grams. In still yet another example, the set of weight portions may collectively have a mass of between and including 15 grams and 19 grams. In still yet another example, the set of weight portions may collectively have a mass of between and including 18 grams and 22 grams. While the above examples may describe particular masses, the apparatus, methods, and articles of manufacture described herein may include the set of weight portions to have an aggregate mass of less than 8 grams or an aggregate mass of greater than 19 grams. The apparatus, methods, and articles of manufacture described herein are not limited in this regard.

The bottom portion 140 of the golf club head 100 may have in inner surface 142 and an outer surface 145. The golf club head 100 may include one or more raised portions protruding outward from the outer surface 145. Each raised portion may include a weight port region. Each weight port region may include a weight port. Each weight port may include a weight portion. The apparatus, methods, and articles of manufacture described herein are not limited in this regard.

Figure 2:
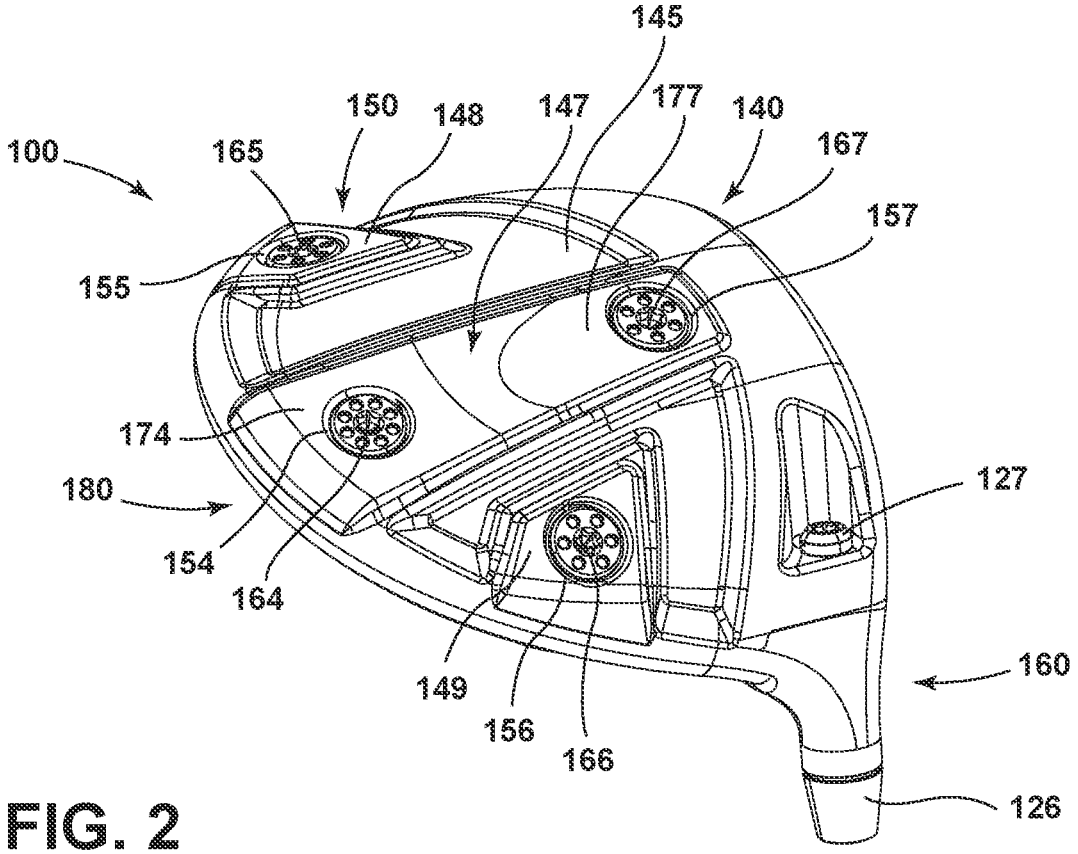
Figure 3:
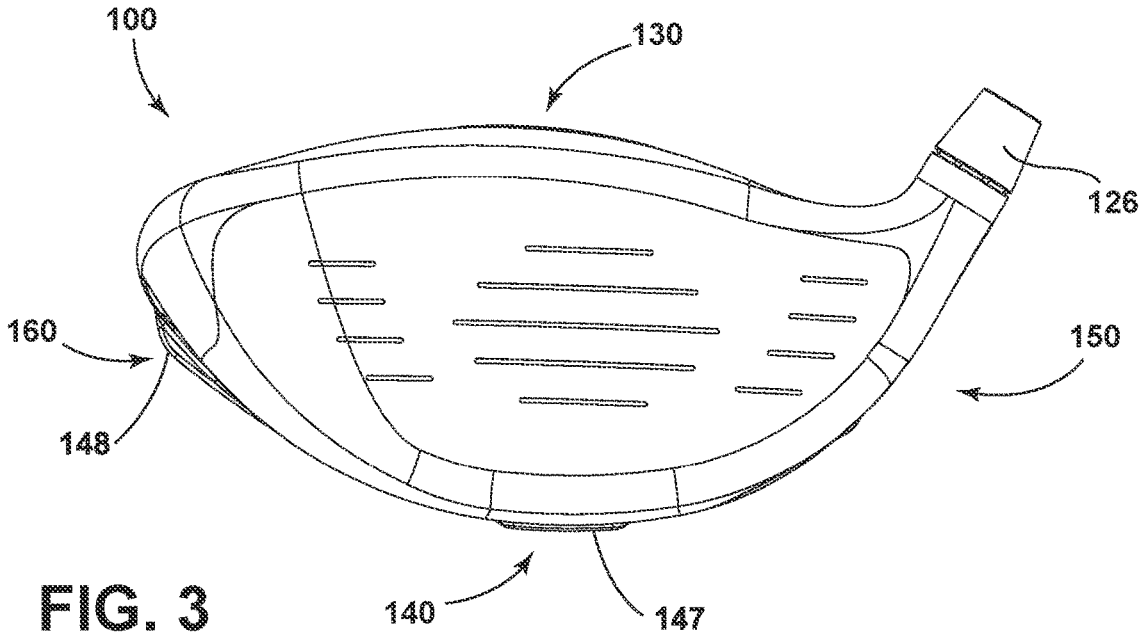
Figure 4:
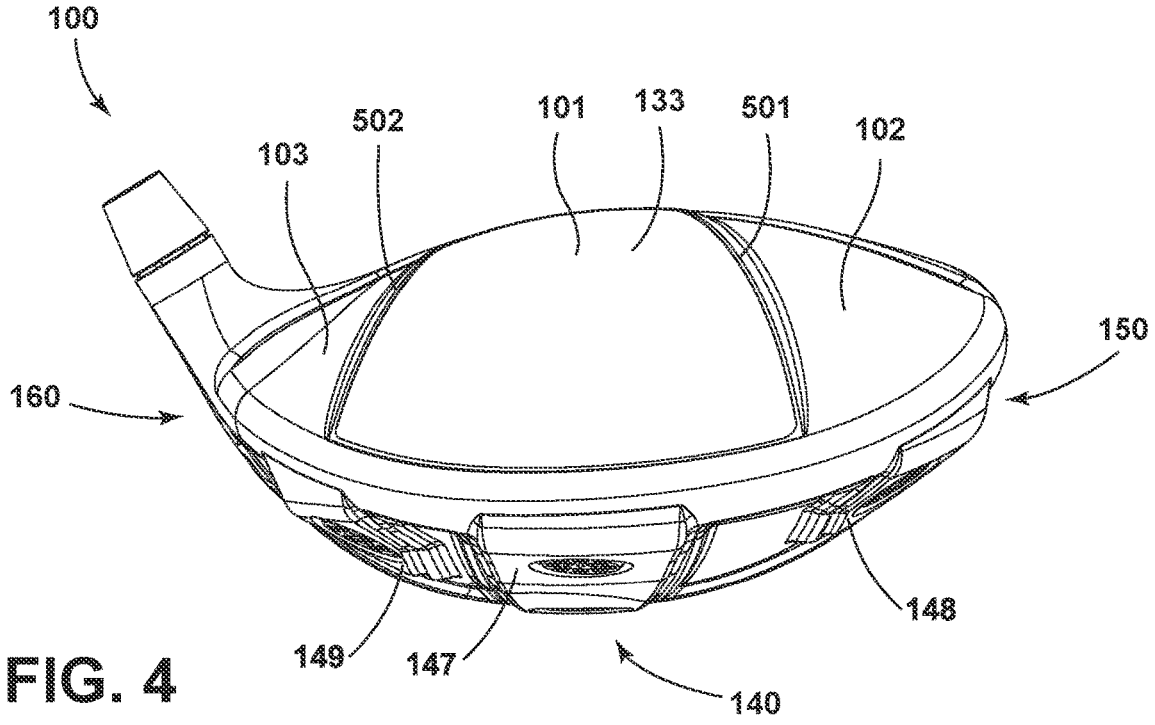

The golf club head 100 may include a central protrusion 147 extending from the outer surface 145 of the bottom portion 140. The central protrusion 147 may extend from the rear portion 180 toward the front portion 170, as illustrated in FIG. 2. The central vertical plane 593 may pass through the central protrusion 147. The central vertical plane 593 may bisect the central protrusion 147. The central protrusion 147 may be located between the toe-side dividing plane 592 and the heel-side dividing plane 594, as illustrated in FIG. 6. The central protrusion 147 may include the first weight port region 174. The central vertical plane 593 may pass through the first weight port 154 and the first weight portion 164. The central vertical plane 593 may bisect the first weight port 154 and the first weight portion 164. The central protrusion 147 may include the fourth weight port region 177. The central vertical plane 593 may pass through the fourth weight port 157 and the fourth weight portion 167. The central vertical plane 593 may bisect the fourth weight port 157 and the fourth weight portion 167. The central protrusion 147 may allow placement of weight portions (e.g. first weight portion 164, fourth weight portion 167) a greater distance from a center point of the golf club head 100 to increase perimeter weighting and MOI without increasing club head volume. The apparatus, methods, and articles of manufacture described herein are not limited in this regard.

The golf club head 100 may include a toe-side protrusion 148 extending from the outer surface 145 of the bottom portion 140. The toe-side protrusion 148 may be located between the toe-side dividing plane 592 and the toe-side bounding plane 591. The toe-side protrusion 148 may be located closer to the rear portion 180 than the front portion 170. The toe-side protrusion 148 may include the second weight port region 175. The toe-side protrusion 148 may allow placement of the second weight portion 165 a greater distance from the center point of the golf club head 100 to increase perimeter weighting and MOI without increasing club head volume. The apparatus, methods, and articles of manufacture described herein are not limited in this regard.

The golf club head 100 may include a heel-side protrusion 149 extending from the outer surface 145 of the bottom portion 140. The heel-side protrusion 149 may be located between the heel-side dividing plane 594 and the heel-side bounding plane 595. The heel-side protrusion 149 may be located closer to the rear portion 180 than the front portion 170. The heel-side protrusion 149 may include the third weight port region 176. The heel-side protrusion 149 may allow placement of the third weight portion 166 a greater distance from the center point of the golf club head 100 to increase perimeter weighting and MOI without increasing club head volume. The apparatus, methods, and articles of manufacture described herein are not limited in this regard.

The golf club head 100 may include an insert 1350. The insert 1350 may be a vibration-dampening insert. The insert 1350 may be a sound-enhancing insert that attenuates certain frequencies. The insert 1350 may include a filler material. As illustrated in FIG. 9, the insert 1350 may be located on the inner surface 142 of the bottom portion 140 of the golf club head 100. The insert 1350 may be adjacent to one or more of the weight port regions. The insert 1350 may surround one or more of the weight ports. The insert 1350 may abut one or more of the weight port regions. The insert 1350 may abut the third weight port region 176. The insert 1350 may be closer to the heel portion 160 than the toe portion 150. The apparatus, methods, and articles of manufacture described herein are not limited in this regard.

Figure 10:
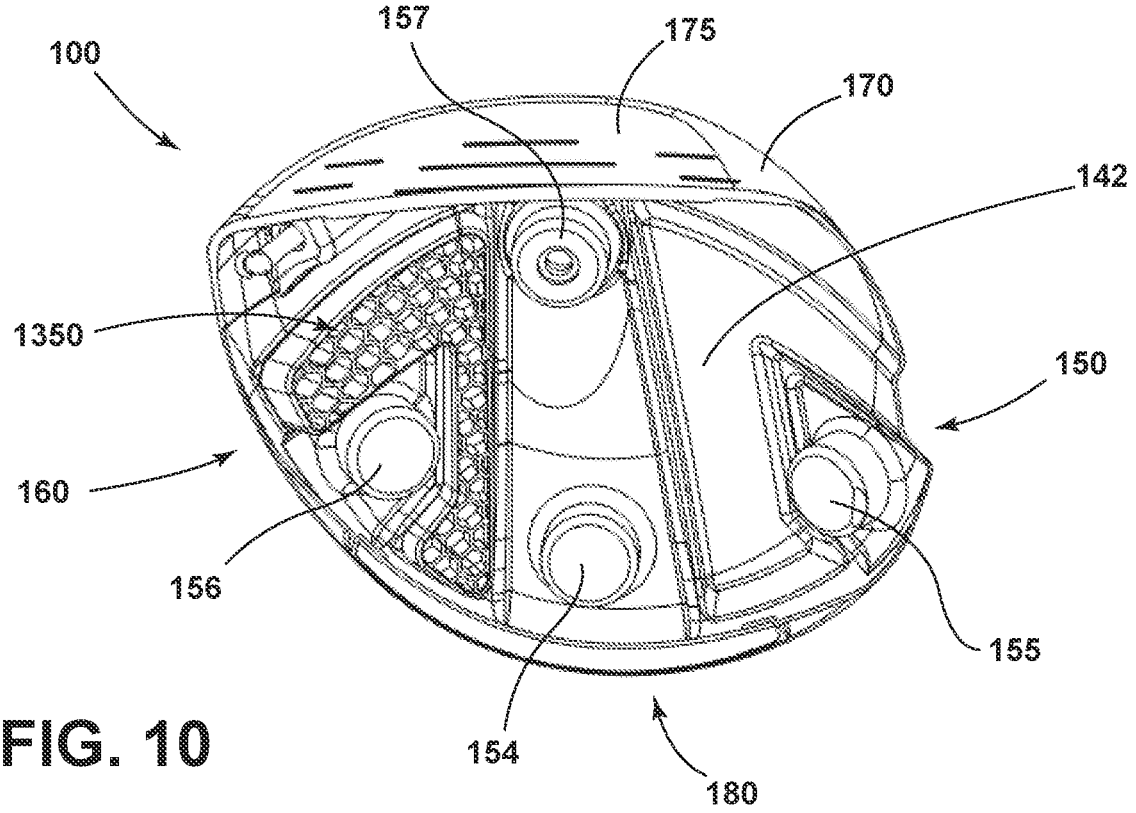
Figure 11:
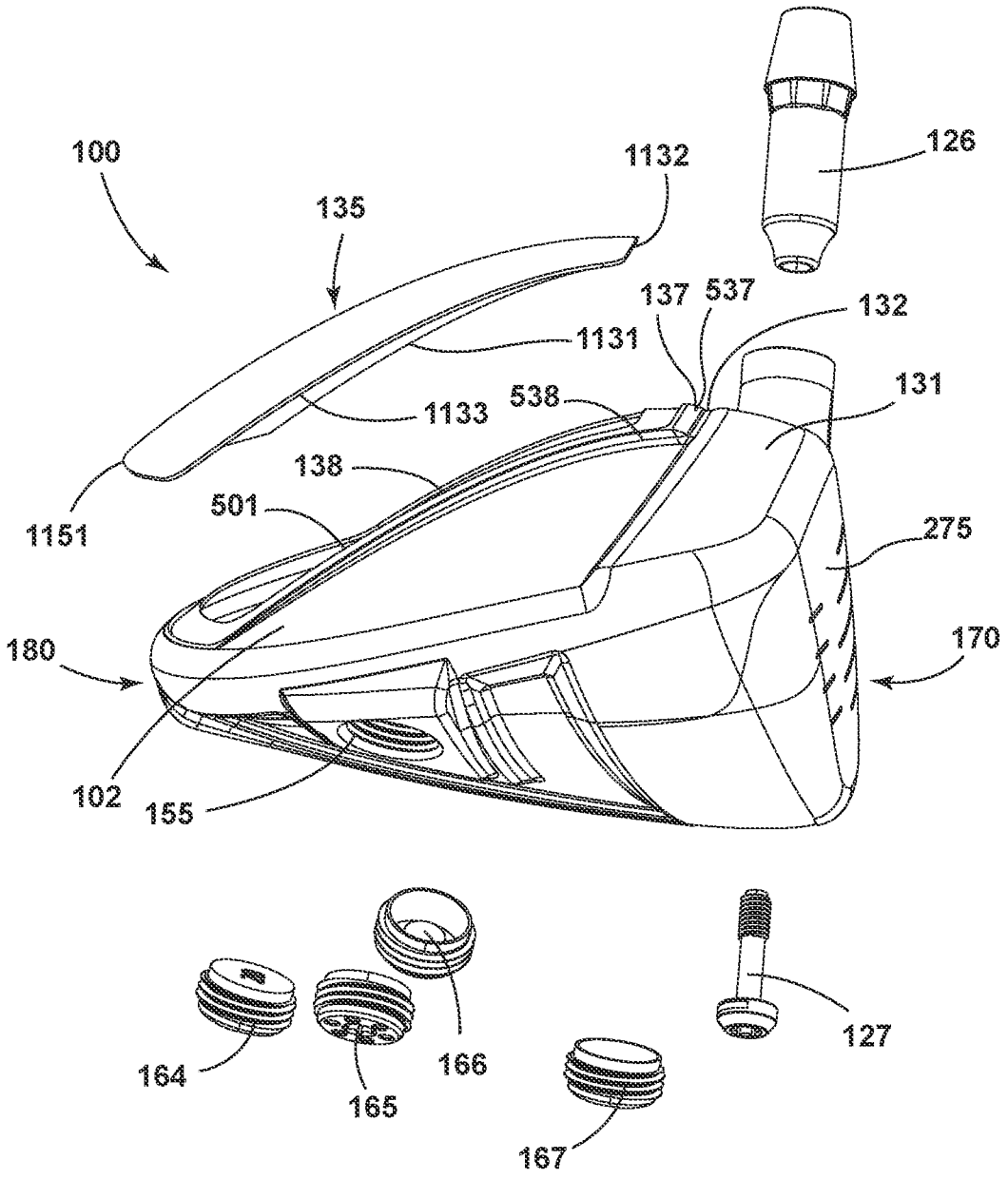

The insert 1350 may be located between the central vertical plane 593 and the heel-side bounding plane 595. The insert 1350 may be located between the heel-side dividing plane 594 and the heel-side bounding plane 595. The insert 1350 may be located between the central protrusion 147 and the heel-side bounding plane 595. The insert 1350 may be located between the heel-side integral rib 539 and the inner surface 142 of the bottom portion 140. The insert 1350 may extend from a front side of the third weight port 156 to a rear side of the third weight port, as illustrated in FIG. 10. The insert 1350 may surround or partially surround the third weight port 156. The insert 1350 may include a plurality of hexagonal recesses. The hexagonal recesses may define a honeycomb pattern. The apparatus, methods, and articles of manufacture described herein are not limited in this regard.

The filler material may be an elastic polymer or elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), and/or other suitable types of materials to absorb shock, isolate vibration, and/or dampen noise. In another example, the filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, and/or an ethylene copolymer having high compression and low resilience similar to thermoset polybutadiene rubbers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience. In yet another example, the filler material may be a thermoset material such as epoxy. The apparatus, methods, and articles of manufacture described herein are not limited in this regard.

Figure 14:
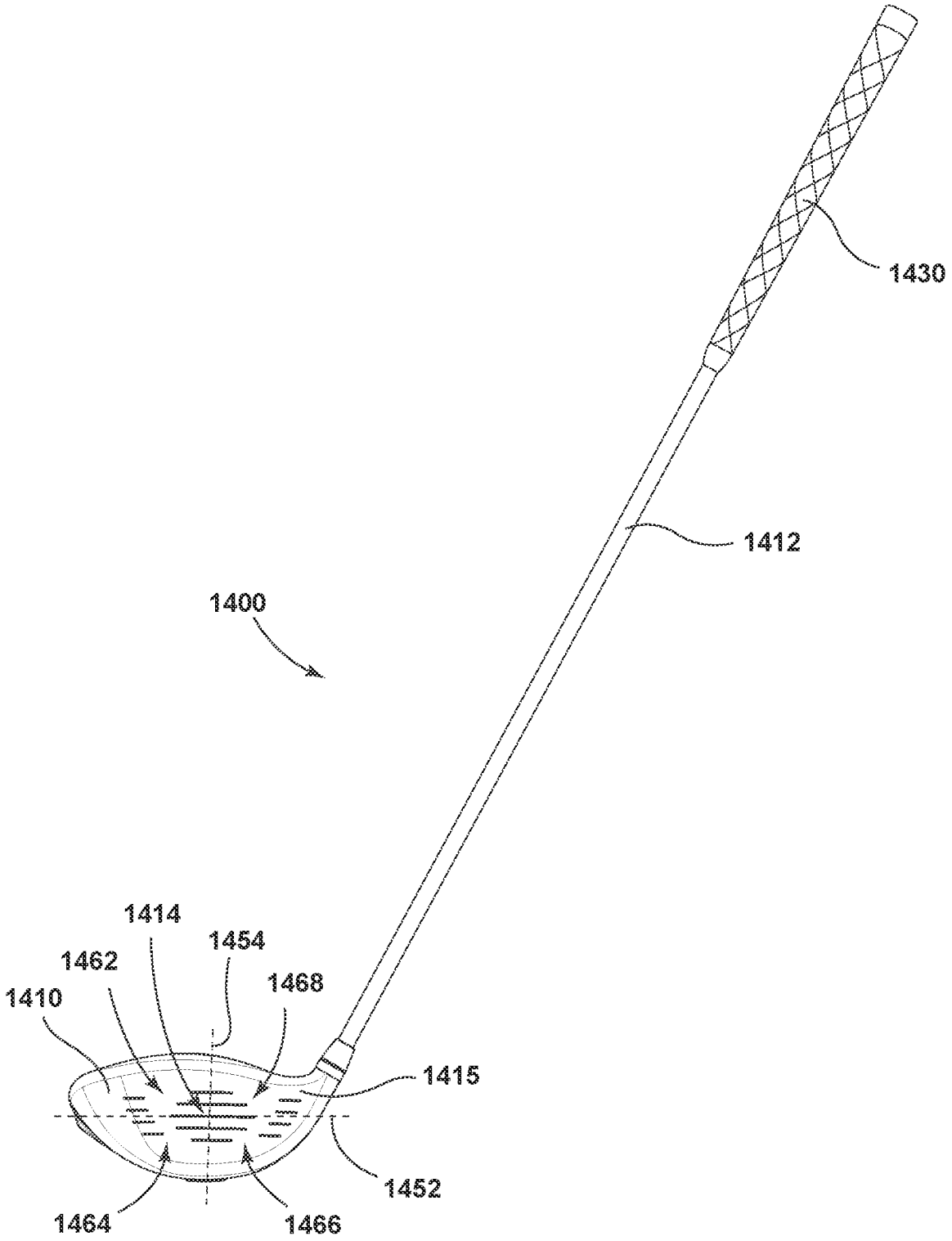
FIG. 14 illustrates a golf club including an example golf club head according to an embodiment of the apparatus, methods, and articles of manufacture described herein.
Figure 15:
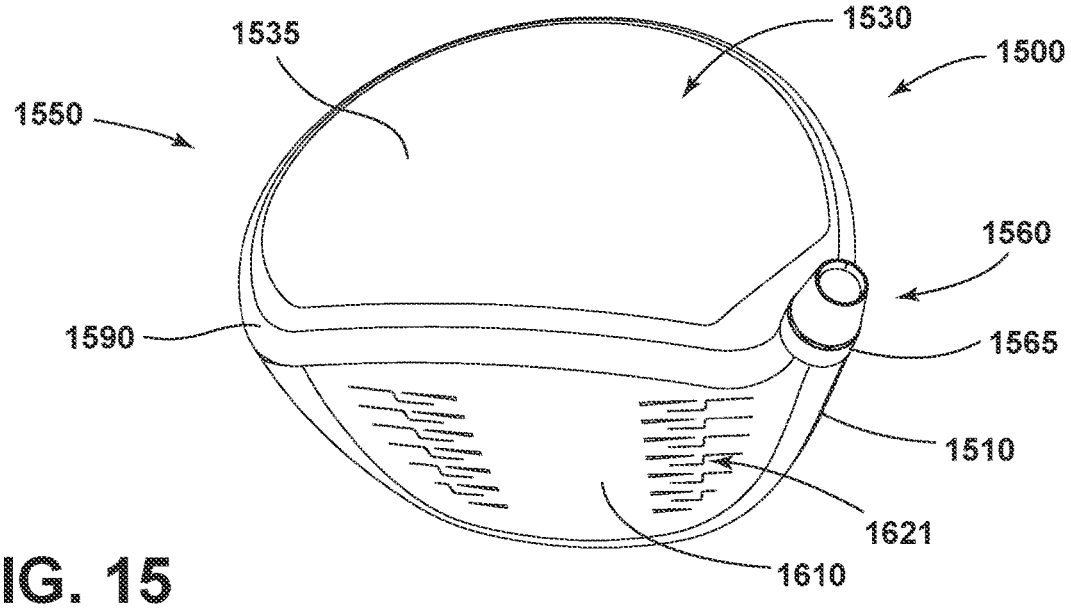
FIGS. 15, 16, 17, 18, and 19 illustrate a front and top perspective view, a side cross-sectional view taken at line 17-17 of FIG. 18, an enlarged view of area 17 of FIG. 16, a top cross-sectional view, an enlarged view of area 19 of FIG. 18, and a method of manufacturing, respectively, of an example golf club according to an embodiment of the apparatus, methods, and articles of manufacture described herein.
Figure 16:
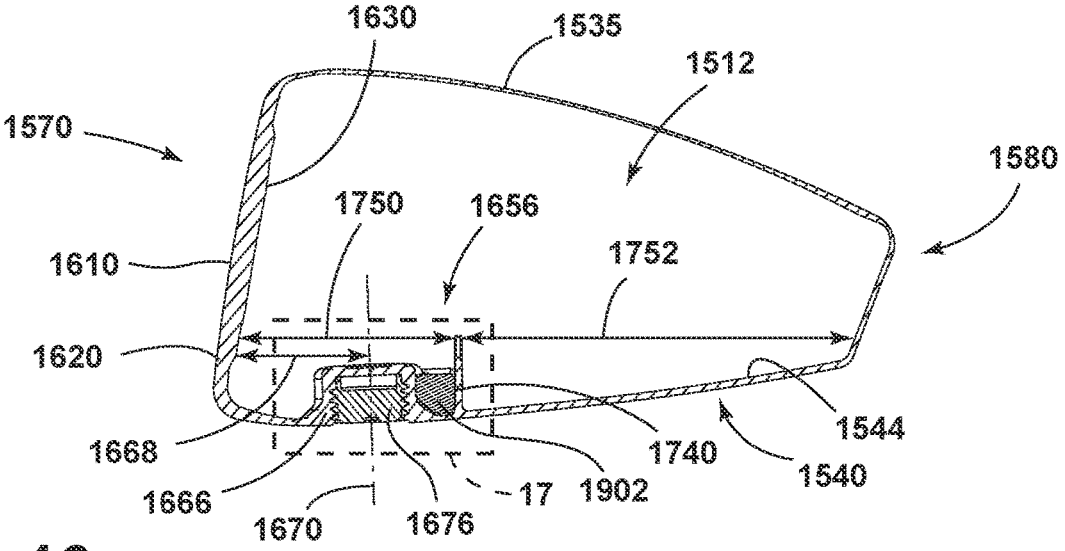
Figure 17:
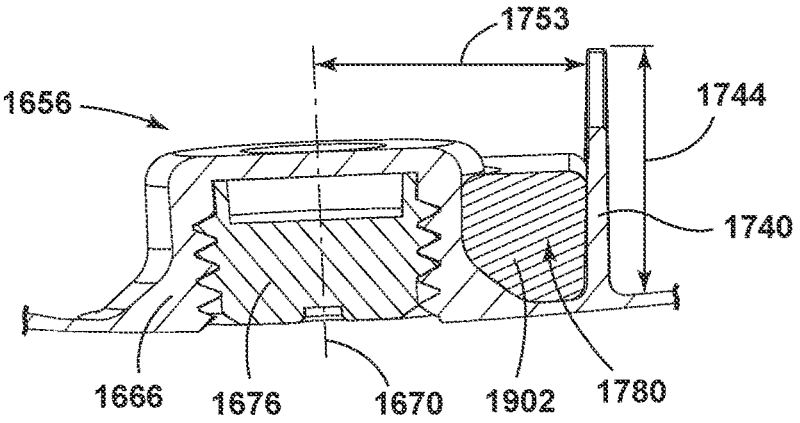
Figure 18:
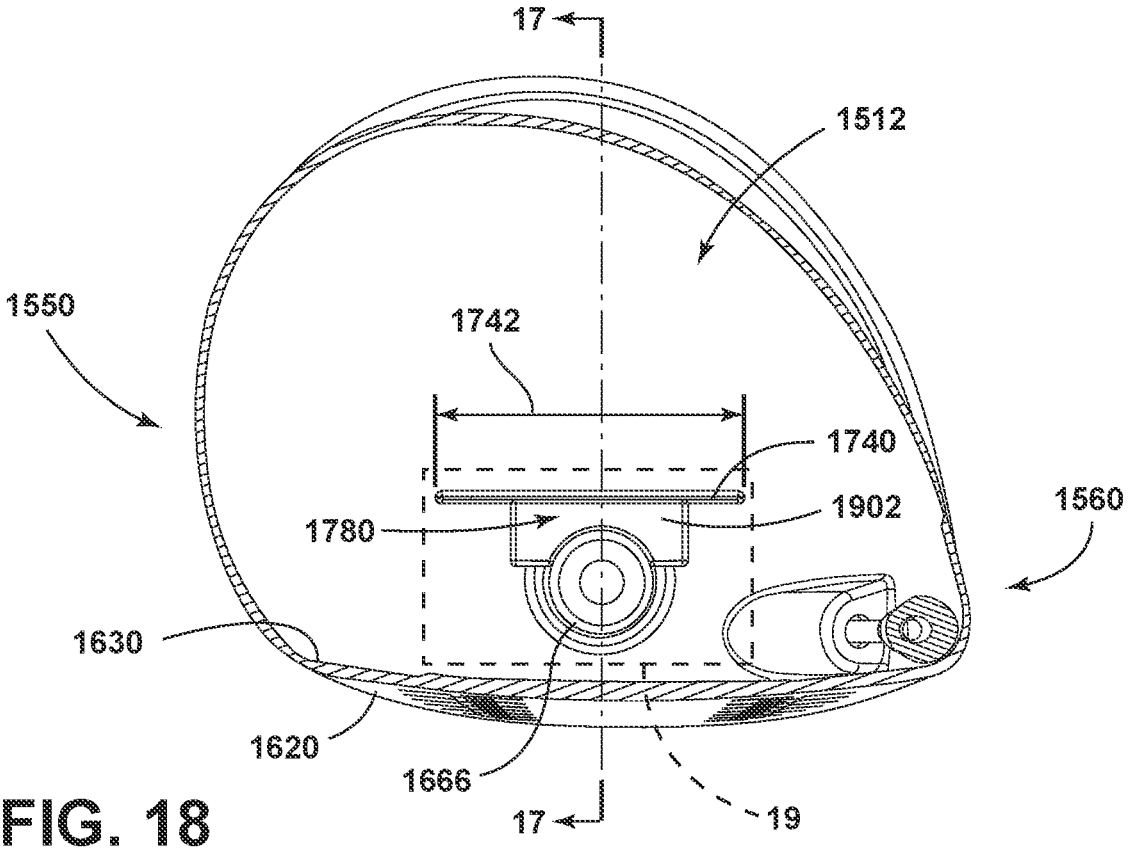

Any of the golf club heads described herein may be part of a golf club. In one example, as illustrated in FIG. 14, a golf club 1400 may include a golf club head 1410 and a shaft 1412 coupled to the golf club head 1410. The shaft 1412 may be attached to the golf club head 1410 at one end and to a golf club grip 1430 at the opposite end. The shaft 1412 may be formed from metal material, composite material, or any other suitable material or combination of materials. The golf club grip 1430 may be formed from rubber material, polymer material, or any other suitable material or combination of materials. The apparatus, methods, and articles of manufacture described herein are not limited in this regard.

Any of the golf club heads described herein, such as the golf club head 1410 as illustrated in FIG. 14, may be considered to have four quadrant regions defined by a horizontal axis 1452 and a vertical axis 1454 intersecting at a center 1414 of a face portion 1415 of the golf club head 1410. The first region, which may be referred to herein as a toe-top region 1462 may be defined by an upper quadrant region that extends from the vertical axis 1454 toward the toe end of the golf club head 1410 and from the horizontal axis 1452 toward the top end of the golf club head 1410. The second region, which may be referred to herein as a toe-bottom region 1464 may be defined by a lower quadrant region that extends from the vertical axis 1454 toward the toe end of the golf club head 1410 and from the horizontal axis 1452 toward the bottom end of the golf club head. The third quadrant region, which may be referred to herein as a heel-bottom region 1466 may be defined by a lower quadrant region that extends from the vertical axis 1454 toward the heel end of the golf club head 1410 and from the horizontal axis 1452 toward the bottom end of the golf club head 1410. The fourth region, which may be referred to herein as a heel-top region 1468 may be defined by an upper quadrant region that extends from the vertical axis 1454 toward the heel end of the golf club head 1410 and from the horizontal axis 1452 toward the top end of the golf club head 1410. Accordingly, a toe portion of the golf club head 1410 may be defined by a combination of toe-top region 1462 and toe-bottom region 1464, a heel portion of the golf club head 1410 may be defined by a combination of heel-bottom region 1466 and heel-top region 1468, a top portion of the golf club head 1410 may be defined by a combination of toe-top region 1462 and heel-top region 1468, and a bottom portion of the golf club head 1410 may be defined by a combination of toe-bottom region 1464 and heel-bottom region 1466. The apparatus, methods, and articles of manufacture described herein are not limited in this regard.

In the example of FIGS. 15-19, a golf club head 1500 may include a body portion 1510 that may be hollow to define an interior cavity 1512. The body portion 1510 may include a top portion 1530, a crown portion 1535, a bottom portion 1540, a toe portion 1550, a heel portion 1560, a front portion 1570, and a rear portion 1580. The bottom portion 1540 may include a skirt portion 1590 defined as a side portion of the golf club head 1500 between the top portion 1530 and the bottom portion 1540 excluding the front portion 1570 and extending across a periphery of the golf club head 1500 from the toe portion 1550, around the rear portion 1580, and to the heel portion 1560. Alternatively, the golf club head 1500 may not include the skirt portion 1590. The front portion 1570 may include a face portion 1610 to engage a golf ball. The face portion 1610 may be integral to the body portion 1510 or may be partially or fully a separate piece that is coupled (e.g., welded) to the front portion 1570 to enclose an interior cavity 1512 of the body portion 1510. The body portion 1510 may also include a hosel portion 1565 configured to receive a shaft (in one example, a shaft 1412 is illustrated in FIG. 14). The materials of construction, methods of manufacturing and/or assembly of body portion 1510, the face portion 1610, and/or the hosel portion 1565 may be similar in many respects to any of golf club heads described herein or described in any of the incorporated by reference patent documents. The apparatus, methods, and articles of manufacture described herein are not limited in this regard.

The face portion 1610 may include a front surface 1620 having a plurality of grooves 1621 and a back surface 1630. The front surface 1620 and the grooves 1621 may be configured to strike a golf ball. The face portion 1610 may be attached to an opening in the front portion 1570 to close the opening and/or enclose the interior cavity 1512. The configuration of the face portion 1610 and the attachment thereof to the body portion 1510 may be similar in many respects to any of the configurations of the face portions and attachments thereof to the body portions described herein or in any of the incorporated by reference patent documents. The apparatus, methods, and articles of manufacture described herein are not limited in this regard.

The golf club head 1500 may include any number of weight port regions with each weight port region having any number of weight ports and/or weight portions similar to any of the golf club heads described herein or described in any of the incorporated by reference patent documents. Any of the weight ports and/or weight portions described herein may have any shape. In the illustrated example of FIGS. 15-19, the golf club head 1500 may include a weight port region 1656 on the bottom portion 1540 at or proximate to the front portion 1570. The weight port region 1656 may include a weight port 1666 configured to receive a weight portion 1676. In the example of FIGS. 15-19, the weight port 1666 may be cylindrical threaded bore to receive the weight portion 1676, which may also be cylindrical with corresponding outside threading. In one example, a port-face distance 1668 between a weight port center axis 1670 of the weight port 1666 and the back surface 1630 of the face portion 1610 may be greater than or equal to 0.5 inch (12.7 mm) and less than or equal to 1.5 inch (38.1 mm). In another example, the port-face distance 1668 may be greater than or equal to 0.75 inch (19.05 mm) and less than or equal to 1 inch (25.4 mm). In another example, the port-face distance 1668 may be greater than or equal to 0.85 inch (21.59 mm) and less than or equal to 0.95 inch (24.13 mm). In yet another example, the port-face distance 1668 may be greater than or equal to 0.87 inch (22.1 mm) and less than or equal to 1.2 inch (30.48 mm). The weight port 1666 and/or the weight portion 1676 may be similar in many respects to any of the weight ports and/or weight portions, respectively, described herein or described in any of the incorporated by reference patent documents. In another example, the weight portion 1676 may be an integral part of or a continuous one-piece part with the body portion 1510 (i.e., an integral and unremovable weight portion). In yet another example, the body portion 1510 may not include any weight ports or weight portions. In the illustrated example of FIGS. 15-19, the weight port 1666 may be at or proximate to a center portion of the bottom portion 1540 between the toe portion 1550 and the heel portion 1560. In another example, the weight port 1666 may be on the toe-portion side of the bottom portion 1540. In yet another example, the weight port 1666 may be on the heel-portion side of the bottom portion 1540. The apparatus, methods, and articles of manufacture described herein are not limited in this regard.

In one example, as illustrated in FIGS. 15-19, the golf club head 1500 may include a wall portion 1740 extending into the interior cavity 1512 (i.e., an internal wall portion, a rib portion, a projection) from an inner surface 1544 of the bottom portion 1540. The wall portion 1740 may be located aft of the weight port 1666 to define a gap 1780 between the wall portion 1740 and the weight port 1666. In one example, as illustrated in FIGS. 15-19, a wall-face distance 1750 between the wall portion 1740 and the back surface 1630 of the face portion 1610 may be substantially less than a wall-rear distance 1752 between the wall portion 1740 and the rear portion 1580. In another example, the wall portion 1740 may be located at or proximate to a halfway point on the bottom portion 1540 between the face portion 1610 and the rear portion 1580. In another example, the wall-face distance 1750 may be greater than the wall-rear distance 1752. In another example, the wall-face distance 1750 may be less than wall-rear distance 1752. In another example, the wall-face distance 1750 may be greater than or equal to 1.0 inch (25.4 mm) and less than or equal to 2.0 inch (50.8 mm). In another example, the wall-face distance 1750 may be greater than or equal to 1.25 inch (31.75 mm) and less than or equal to 1.75 inch (44.45 mm). In another example, the wall-face distance 1750 may be greater than or equal to 1.15 inch (29.21 mm) and less than or equal to 1.6 inch (40.64 mm). In another example, the wall-face distance 1750 may be greater than or equal to 1.35 inch (34.29 mm) and less than or equal to 1.55 inch (39.37 mm). In yet another example, the wall-face distance 1750 may be greater than or equal to 1.4 inch (35.56 mm) and less than or equal to 1.5 inch (38.1 mm). The apparatus, methods, and articles of manufacture described herein are not limited in this regard.

In one example, a wall-port distance 1753, which is the distance between the wall portion 1740 and the weight port center axis 1670, may be equal to the port-face distance 1668. In another example, the wall-port distance 1753 may be greater than the port-face distance 1668. In another example, as illustrated in FIGS. 15-19, the wall-port distance 1753 may be less than the port-face distance 1668. In another example, the wall-port distance 1753 may be greater than or equal to 0.1 inch (2.54 mm) and less than or equal to 1.0 inch (25.4 mm). In another example, the wall-port distance 1753 may be greater than or equal to 0.25 inch (6.35 mm) and less than or equal to 0.75 inch (19.05 mm). In yet another example, the wall-port distance 1753 may be greater than or equal to 0.45 inch (11.43 mm) and less than or equal to 0.65 inch (16.51 mm). The apparatus, methods, and articles of manufacture described herein are not limited in this regard.

In one example, as illustrated in FIGS. 15-19, the wall-face distance 1750 may be greater than the port-face distance 1668 (i.e., a ratio of wall-face distance 1750 to port-face distance 1668 may be greater than 1.0) to provide the gap 1780 between the wall portion 1740 and the weight portion 1676. In another example, a ratio of the wall-face distance 1750 to the port-face distance 1668 may be greater than or equal to 1.3. In another example, a ratio of the wall-face distance 1750 to the port-face distance 1668 may be greater than or equal to 1.5. In yet another example, a ratio of the wall-face distance 1750 to the port-face distance 1668 may be greater than or equal to 2.0. The apparatus, methods, and articles of manufacture described herein are not limited in this regard.

The wall portion 1740 may have any wall portion length 1742 that may extend in any direction or have any orientation relative to the face portion 1610. The wall portion 1740 may have a wall portion length 1742 that may extend between the toe portion 1550 and the heel portion 1560. The wall portion 1740 may extend in the same or substantially the same direction as the face portion 1610. In one example, the wall portion length 1742 may be greater than or equal to 1.0 inch (25.4 mm) and less than or equal to 3.0 inch (76.2 mm). In another example, the wall portion length 1742 may be greater than or equal to 1.55 inch (39.37 mm) and less than or equal to 2.15 inch (54.61 mm). In another example, the wall portion length 1742 may be greater than or equal to 1.35 inch (34.29 mm) and less than or equal to 2.0 inch (50.8 mm). In another example, the wall portion length 1742 may be greater than or equal to 1.75 inch (44.45 mm) and less than or equal to 2.25 inch (57.15 mm). In another example, the wall portion length 1742 may be greater than or equal to 1.9 inch (48.26 mm) and less than or equal to 2.1 inch (53.34 mm). In yet another example, the wall portion 1740 may extend to the skirt portion 1590 on the toe portion side and/or the skirt portion 1590 on the heel portion side. The apparatus, methods, and articles of manufacture described herein are not limited in this regard.

The wall portion 1740 may have any wall portion height 1744, which may be defined as a dimension of the wall portion 1740 that extends from the inner surface 1544 of the bottom portion 1540 toward the top portion 1530. As illustrated in FIG. 15-19, for example, the wall portion height 1744 may be greater than the height of the weight port 1666 (i.e., the height projecting into the interior cavity 1512) such that the wall portion 1740 extends above the weight port 1666. In one example, the wall portion height 1744 may be greater than or equal to 0.10 inch (2.54 mm) and less than or equal to 0.65 inch (16.51 mm). In one example, the wall portion height 1744 may be greater than or equal to 0.25 inch (6.35 mm) and less than or equal to 0.55 inch (13.97 mm). In one example, the wall portion height 1744 may be greater than or equal to 0.3 inch (7.62 mm) and less than or equal to 0.65 inch (16.51 mm). In one example, the wall portion height 1744 may be greater than or equal to 0.4 inch (10.16 mm) and less than or equal to 0.65 inch (16.51 mm). In one example, the wall portion height 1744 may be greater than or equal to 0.2 inch (5.08 mm) and less than or equal to 0.5 inch (12.7 mm). In one example, the wall portion height 1744 may be greater than or equal to 0.3 inch (7.62 mm) and less than or equal to 0.6 inch (15.24 mm). In one example, the wall portion height 1744 may be greater than or equal to 0.25 inch (6.35 mm) and less than or equal to 0.4 inch (10.16 mm). The wall portion height 1744 may be constant, vary, or have any height profile or shape along the wall portion length 1742. Accordingly, the wall portion height 1744 may be have one or more segments that may be concave, convex, and/or linearly inclined relative to the bottom portion 1540. In one example, a maximum value of the wall portion height 1744 may be at a center portion of the wall portion 1740. In another example, the wall portion height 1744 may diminish from a maximum value of the wall portion height 1744 at a center portion of the wall portion 1740 to the end portions (end portions of the wall portion length 1742) of the wall portion 1740. The apparatus, methods, and articles of manufacture described herein are not limited in this regard.

The wall portion 1740 may have any wall portion thickness 1746 at any portion of the wall portion 1740. In one example, the wall portion thickness 1746 may be greater than or equal to 0.01 inch (0.254 mm) and less than or equal to 0.1 inch (2.54 mm). In another example, the wall portion thickness 1746 may be greater than or equal to 0.025 inch (0.64 mm) and less than or equal to 0.075 inch (1.9 mm). In another example, the wall portion thickness 1746 may be greater than or equal to 0.03 inch (0.762 mm) and less than or equal to 0.06 inch (1.52 mm). In another example, the wall portion thickness 1746 may be greater than or equal to 0.02 inch (0.51 mm) and less than or equal to 0.07 inch (1.78 mm). In another example, the wall portion thickness 1746 may be uniform along the wall portion length 1742 and/or the wall portion height 1744. In another example, the wall portion thickness 1746 may vary along the wall portion length 1742 and/or along the wall portion height 1744. In another example, as illustrated in FIGS. 15-19, the wall portion thickness 1746 may taper in a direction from the bottom portion 1540 to the top portion 1530. In yet another example, the wall portion thickness 1746 may taper in a direction between the toe portion 1550 and the heel portion 1560. The apparatus, methods, and articles of manufacture described herein are not limited in this regard.

As described herein, the wall portion length 1742 may be greater or substantially greater than the wall portion height 1744. In one example, a ratio of the wall portion length 1742 to wall portion height 1744 may be greater than or equal to 2.0. In another example, a ratio of the wall portion length 1742 to wall portion height 1744 may be greater than or equal to 4.0. In another example, a ratio of the wall portion length 1742 to wall portion height 1744 may be greater than or equal to 5.0. In another example, a ratio of the wall portion length 1742 to wall portion height 1744 may be greater than or equal to 6.0. In yet another example, a ratio of the wall portion length 1742 to wall portion height 1744 may be greater than or equal to 10.0. The apparatus, methods, and articles of manufacture described herein are not limited in this regard.

As described herein, the wall portion height 1744 may be greater or substantially greater than the wall portion thickness 1746. In one example, a ratio of the wall portion height 1744 to wall portion thickness 1746 may be greater than or equal to 3.0. In another example, a ratio of the wall portion height 1744 to wall portion thickness 1746 may be greater than or equal to 5.0. In another example, a ratio of the wall portion height 1744 to wall portion thickness 1746 may be greater than or equal to 6.0. In another example, a ratio of the wall portion height 1744 to wall portion thickness 1746 may be greater than or equal to 8.0. In yet another example, a ratio of the wall portion height 1744 to wall portion thickness 1746 may be greater than or equal to 10.0. The apparatus, methods, and articles of manufacture described herein are not limited in this regard.

The wall portion 1740 may provide additional stiffness, impact energy transfer to different portions of the golf club head 1500, and/or structural support for the bottom portion 1540 aft of the ball strike zone of the face portion 1610. Accordingly, all or portions of the bottom portion 1540 may be made relatively thinner or have strategically constructed variable thicknesses to reduce the weight of the golf club head 1500, optimize the moment of inertia of the golf club head 1500, and/or to optimize the location of the center of gravity of the golf club head 1500. The apparatus, methods, and articles of manufacture described herein are not limited in this regard.

In one example, as illustrated in FIGS. 15-19, the golf club head 1500 may include an elastic insert 1902 between the wall portion 1740 and the weight port 1666. The elastic insert 1902 may fill the gap 1780 as illustrated in the example of FIGS. 15-19. The elastic insert 1902 may have a rear surface 1904 that may be planar or generally planar to contact or engage the wall portion 1740. Accordingly, the rear surface 1904 of the elastic insert 1902 may have the same shape and/or contour as the shape and/or contour, respectively, of the wall portion 1740. The elastic insert 1902 may include a front surface 1906 that may be shaped similar to a portion of the weight port 1666 to contact or engage portions of the weight port 1666. In one example, as illustrated in FIGS. 15-19, the front surface 1906 may include a semi-circular cutout portion 1908 configured to engagingly surround a corresponding portion of the weight port 1666. Accordingly, the front surface 1906 may have a shape that may at least partially correspond to the shape of the weight port 1666 for engagement with the weight port 1666. In one example, the elastic insert 1902 may be in the gap 1780 in an uncompressed state. In another example, the elastic insert 1902 may be inserted in the gap in a compressed state to frictionally engage the wall portion 1740 and the weight port 1666. Additionally, the elastic insert 1902 may be attached to the wall portion 1740 and/or the weight port 1666 with one or more adhesives or bonding agents. As illustrated in the example of FIGS. 15-19, the elastic insert 1902 may partially surround the weight port 1666 and engage a portion of the wall portion 1740. In another example, the elastic insert 1902 may surround a greater portion or all of the weight port 1666 and/or engage all of the wall portion 1740. In yet another example, the elastic insert 1902 may extend from the wall portion 1740 to the face portion 1610 to engage the face portion 1610 while surrounding all or portions of the weight port 1666. The apparatus, methods, and articles of manufacture described herein are not limited in this regard.

The elastic insert 1902 may be made from any polymer material or any of the filler or polymer materials described herein or in any of the incorporated by reference patent documents. The elastic insert 1902 may have any configuration similar to any of the elastic inserts described herein or in any of the incorporated by reference patent documents (e.g., having hexagonal recesses). In one example, as illustrated in FIGS. 15-19, the elastic insert 1902 may be a pre-manufactured insert that may be placed between the wall portion 1740 and the weight port 1666. In another example, the elastic insert 1902 may be manufactured by injecting a polymer material between the wall portion 1740 and the weight port 1666. The elastic insert 1902 may provide vibration dampening and control, and/or dampened energy transfer and dissipation from the face portion 1610 and/or the weight port 1666 to the wall portion 1740. The elastic insert 1902 may also provide noise dampening to provide a more pleasing sound for an individual using the golf club head 1500 when striking a golf ball. The apparatus, methods, and articles of manufacture described herein are not limited in this regard.

Figure 19:
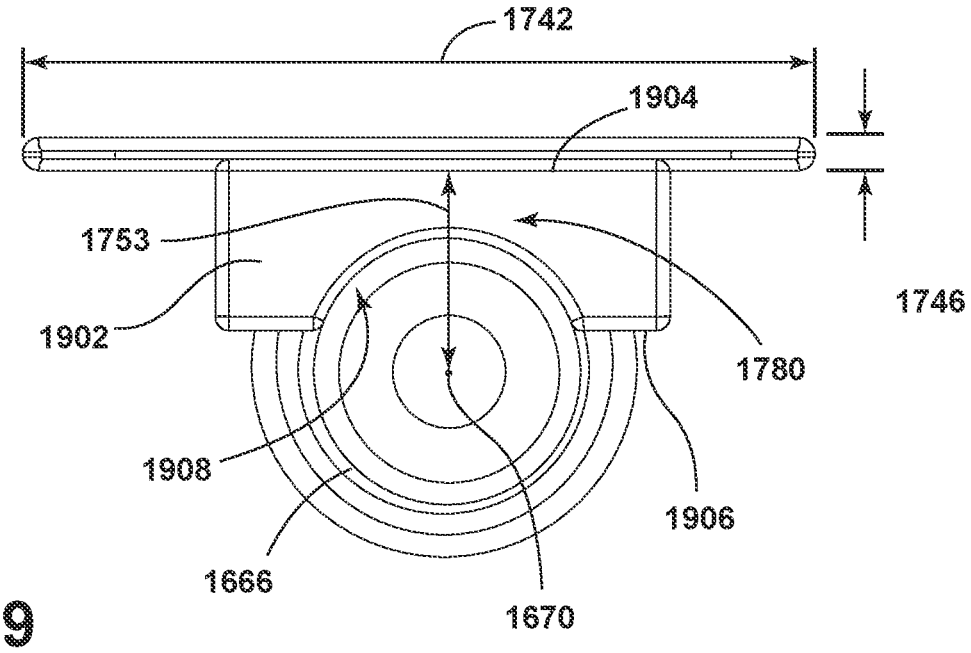
Figure 20:
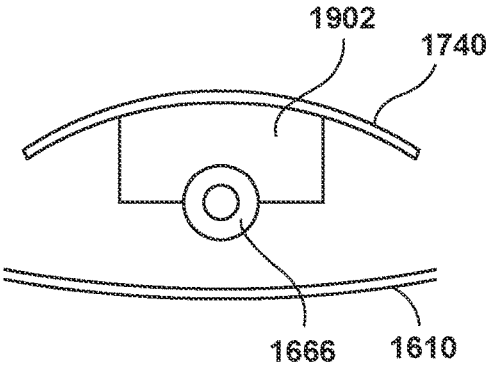
FIGS. 20, 21, 22, 23, 24, and 25 illustrate schematic views of interior portions of golf club heads according to embodiments of the apparatus, methods, and articles of manufacture described herein.
Figure 21:
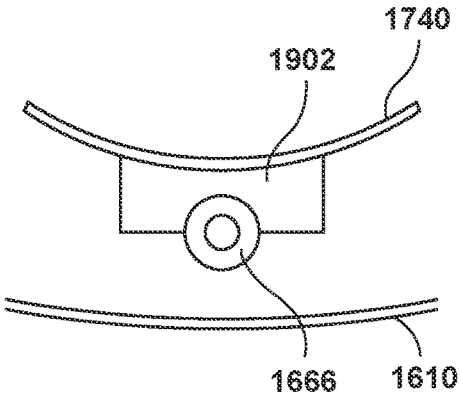
Figure 22:
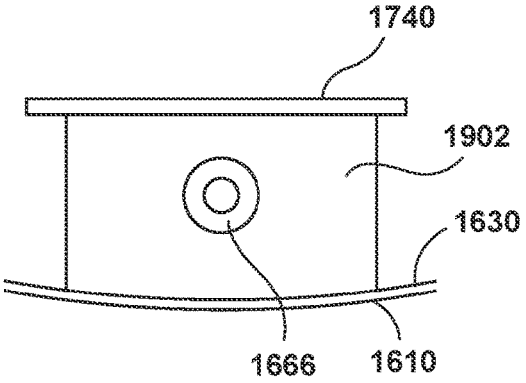
Figure 23:
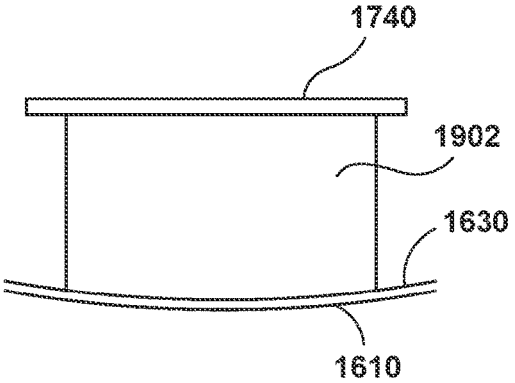
Figure 24:
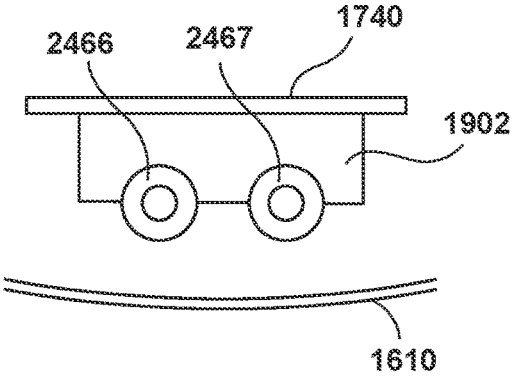
Figure 25:
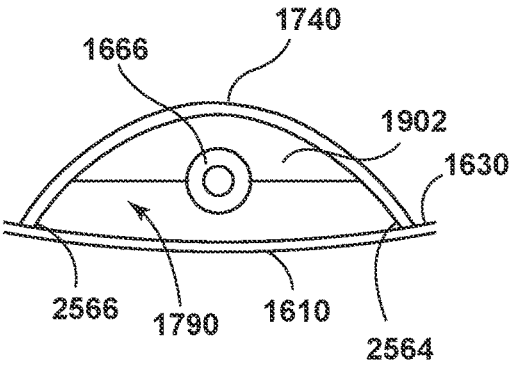
Figure 26:
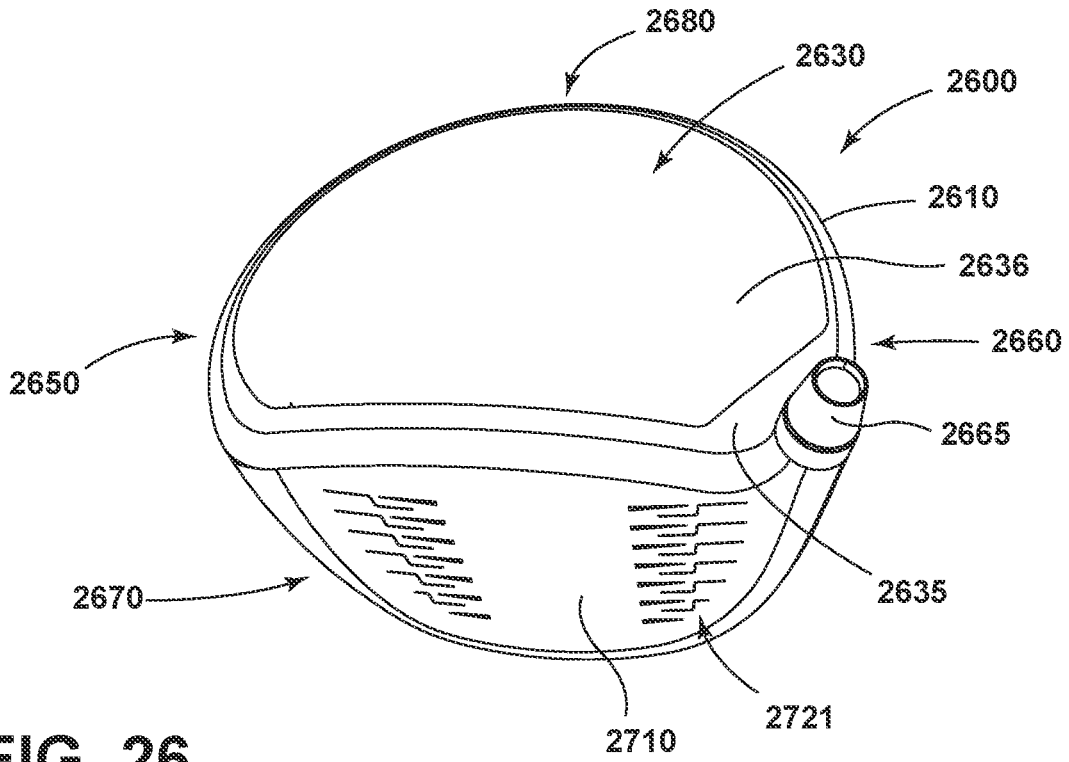
FIGS. 26, 27, 28, 29, 30, 31, 32, 33, 34, 35, and 36 illustrate a top and front perspective view, a bottom and rear perspective view, a bottom view, a rear view, a heel-side view, a toe-side view, a cross-sectional view taken at line 32-32 of FIG. 28, an enlarged view of area 33 of FIG. 32, a top cross-sectional view, an enlarged view of area 35 of FIG. 34, and a method of manufacturing, respectively, of an example golf club according to an embodiment of the apparatus, methods, and articles of manufacture described herein.
Figure 27:
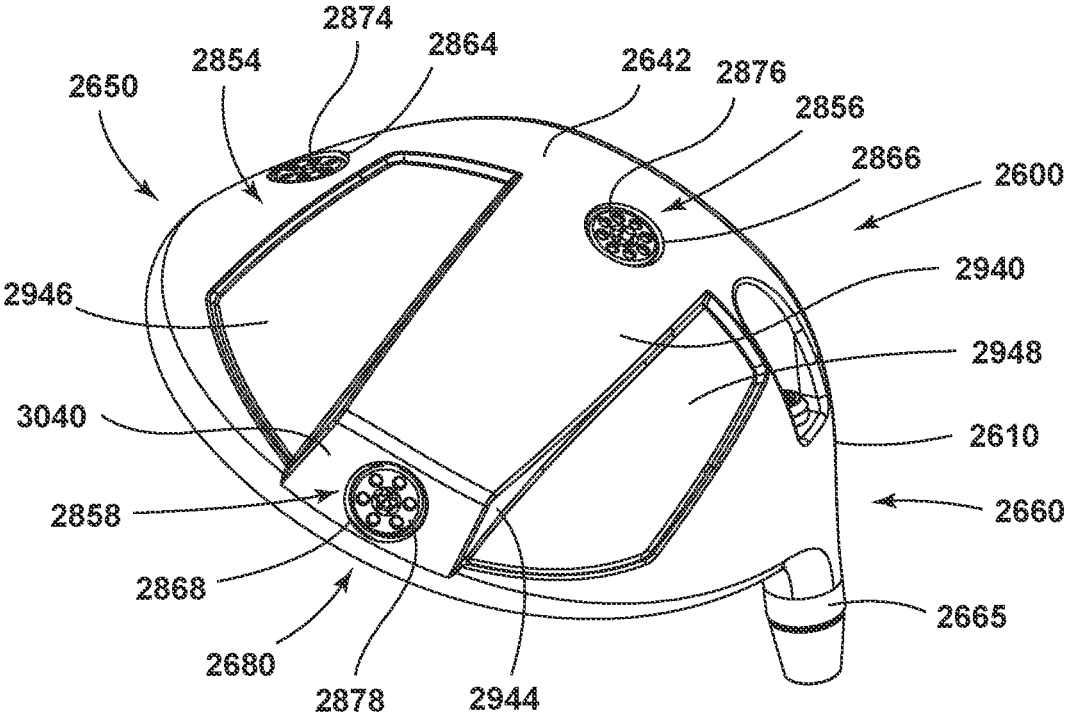
Figure 28:
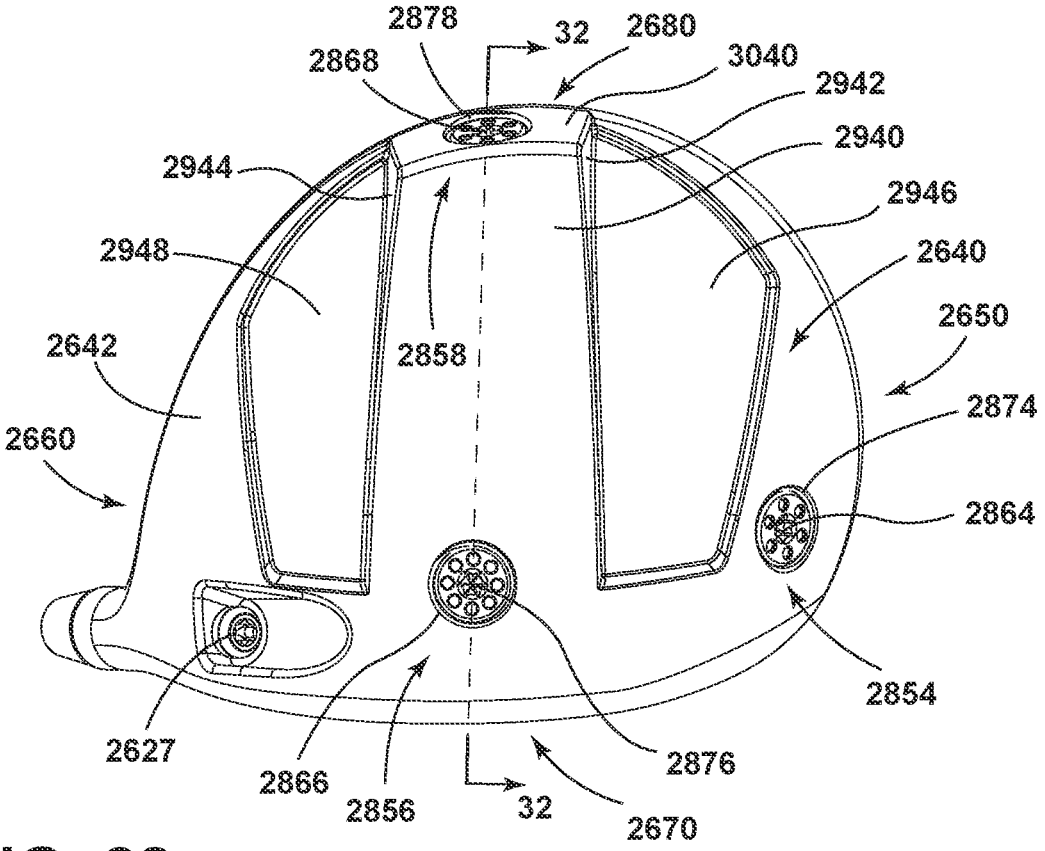
Figure 29:
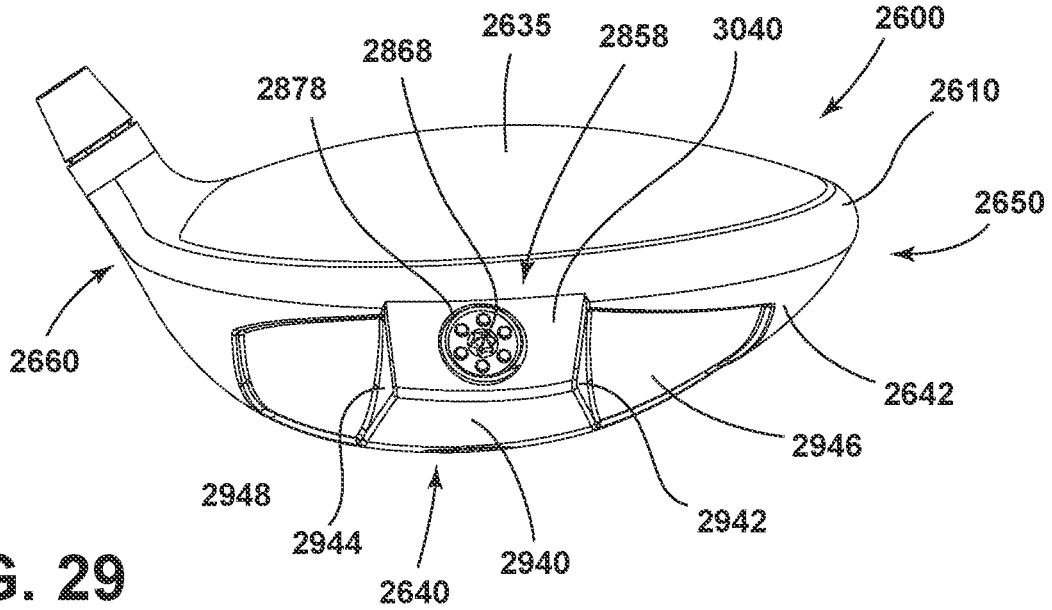
Figure 30:
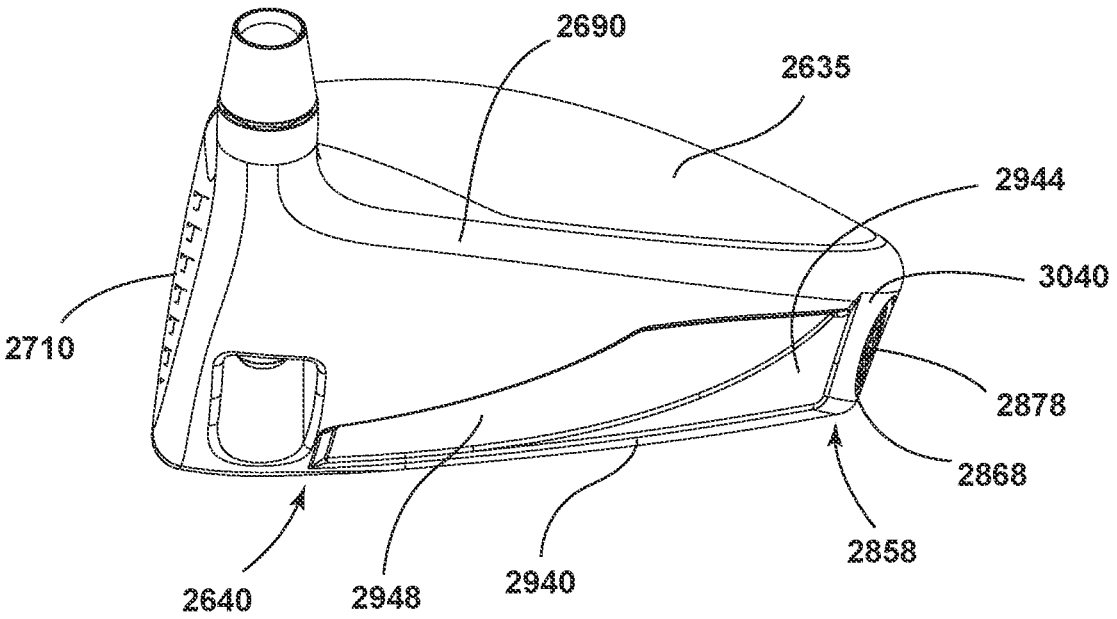
Figure 31:
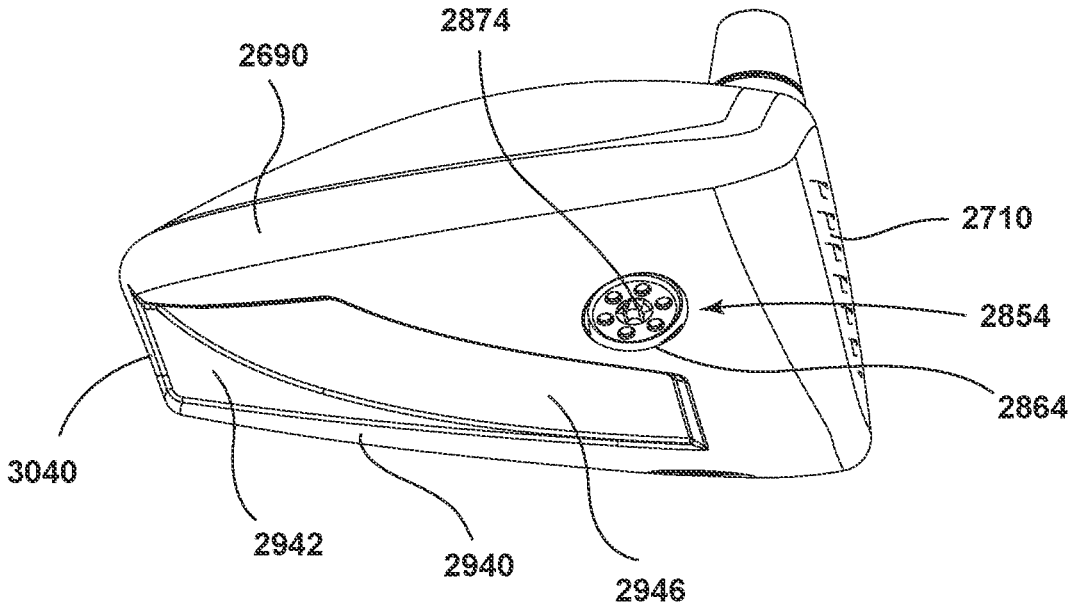
Figure 32:
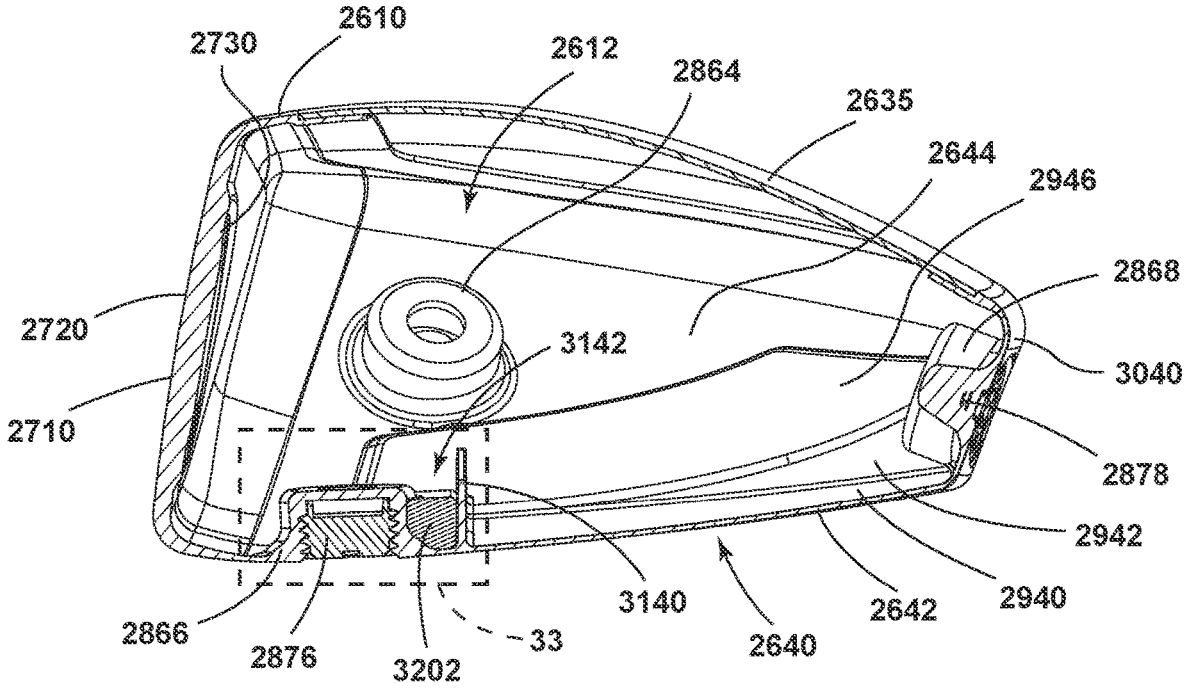
Figure 33:
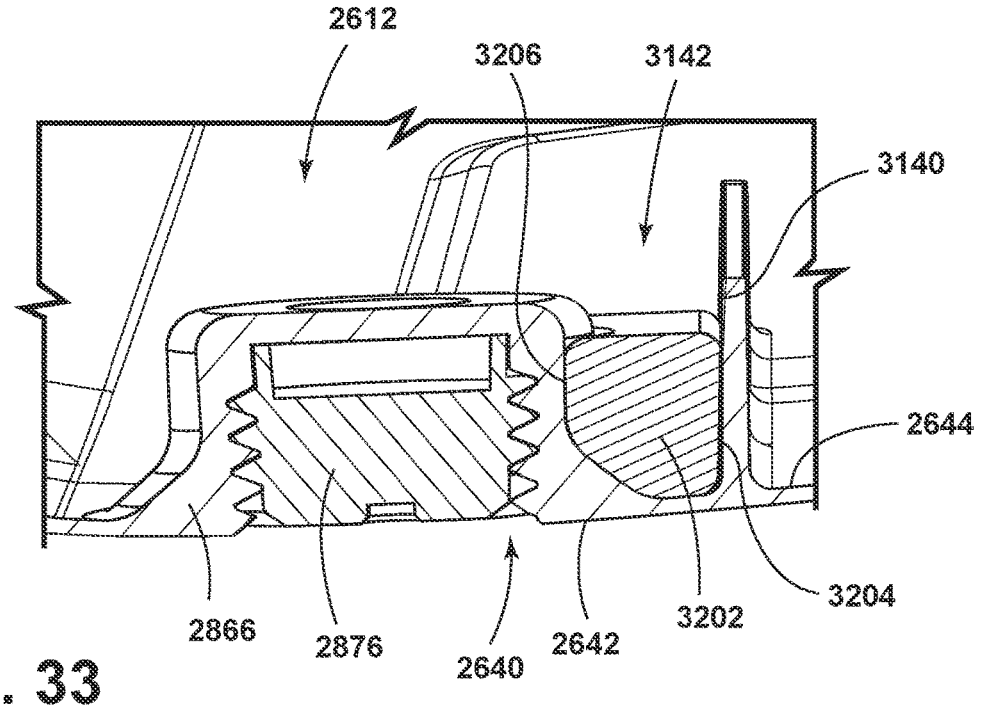
Figure 34:
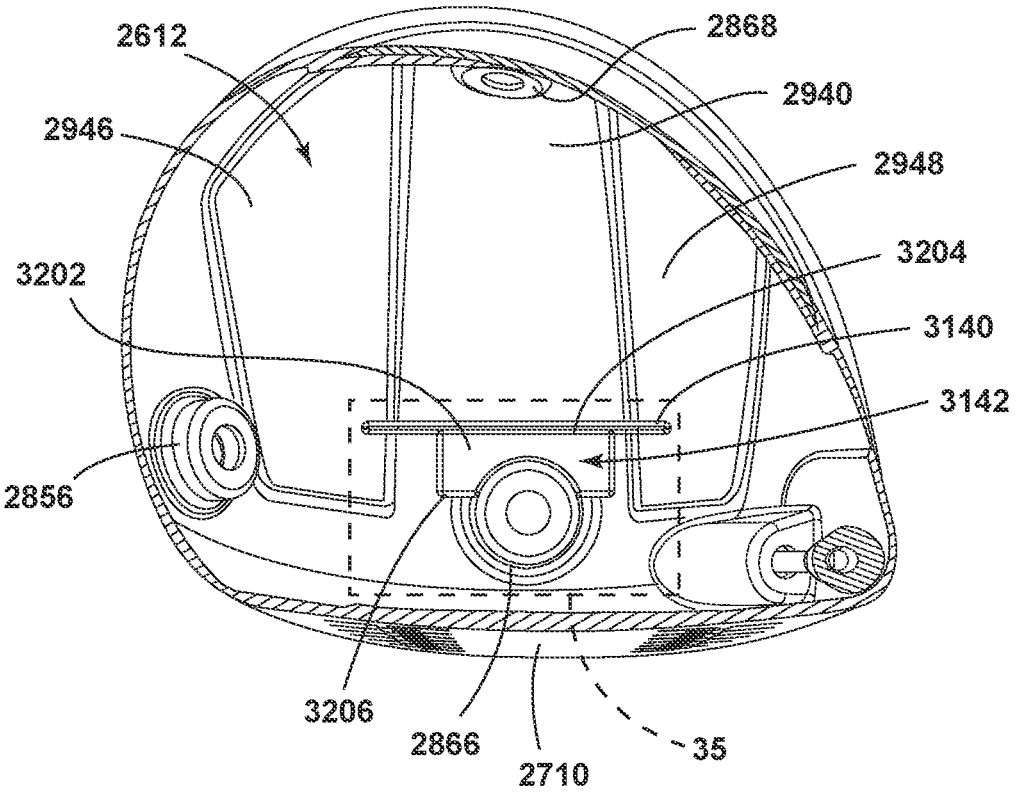
Figure 35:
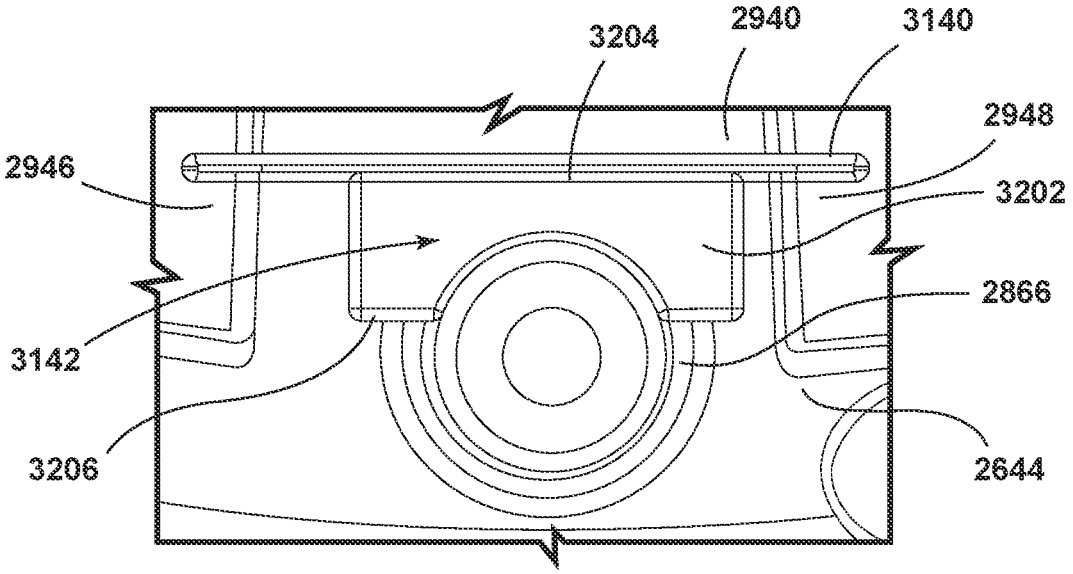
Figure 36:
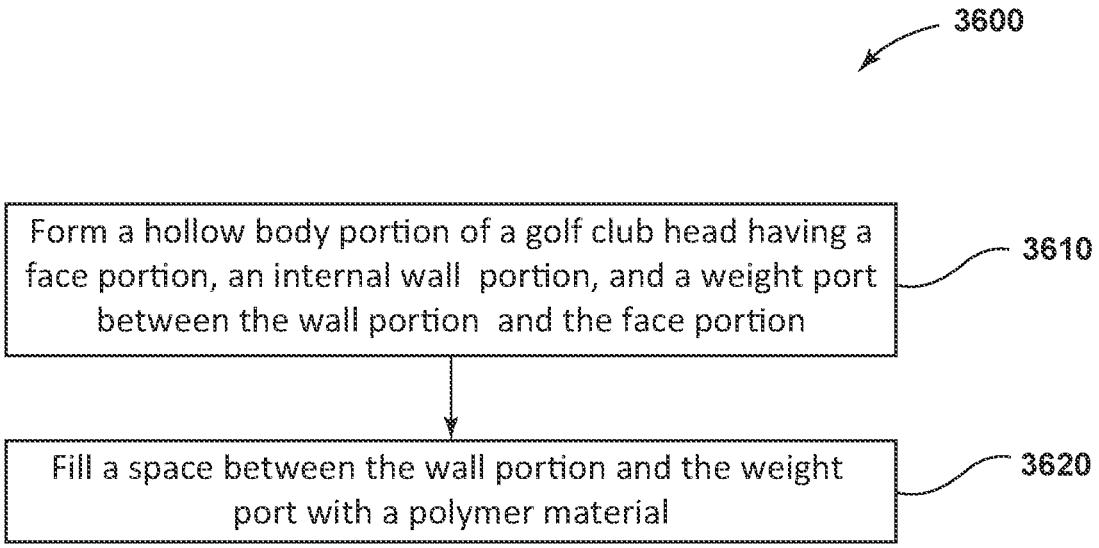
Figure 37:
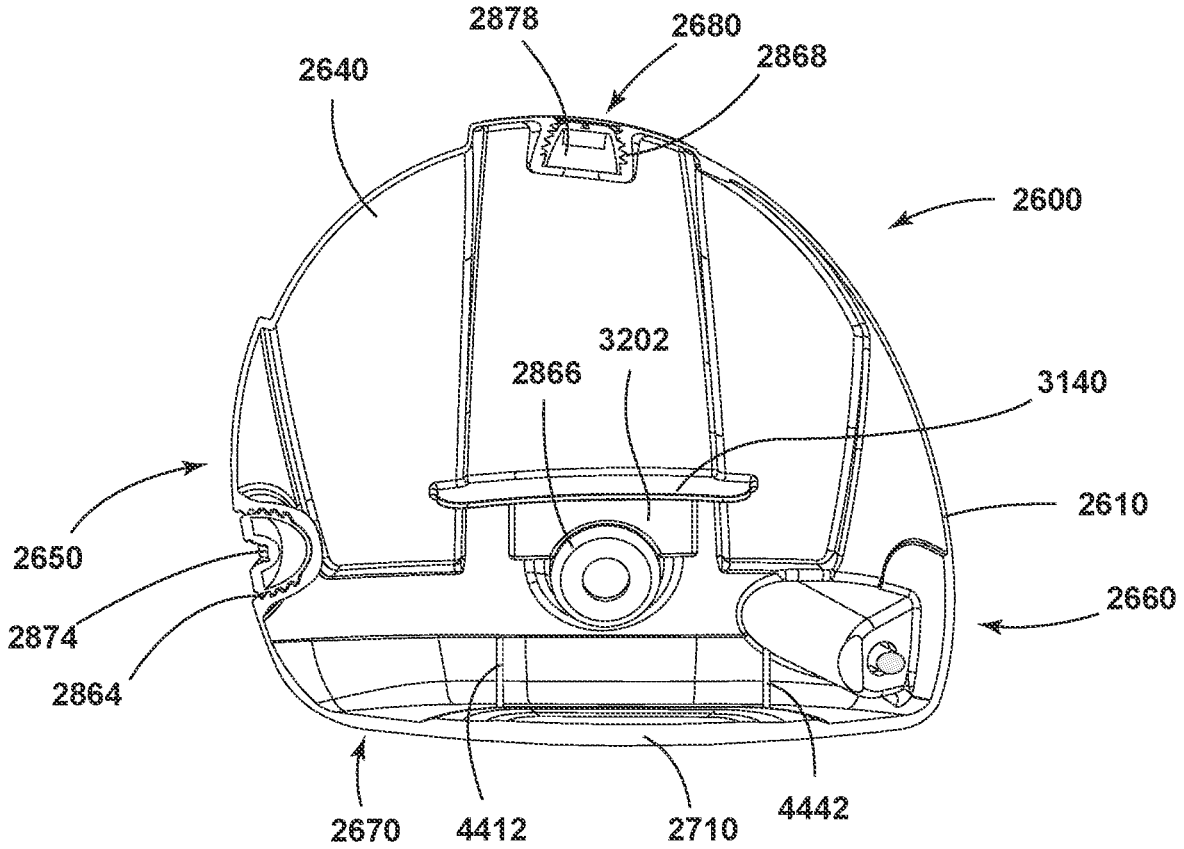
FIGS. 37, 38, 39, 40, 41, 42, 43, 44, 45, 46, 47, 48, 49, and 50 illustrate a top cross-sectional view, a bottom cross-sectional view, a toe side cross-sectional view, an enlarged view of area 40 of FIG. 39, a heel side cross-sectional view, an enlarged view of area 42 of FIG. 41, a rear cross-sectional view, an enlarged view of area 44 of FIG. 43, a top view without a crown portion, a rear view of without a crown portion, a top and side perspective cross-sectional view, a top and side view without a crown portion and without a face portion insert, a front view without a crown portion and without a face portion insert, and a method of manufacturing, respectively, of an example golf club according to an embodiment of the apparatus, methods, and articles of manufacture described herein.
Figure 38:
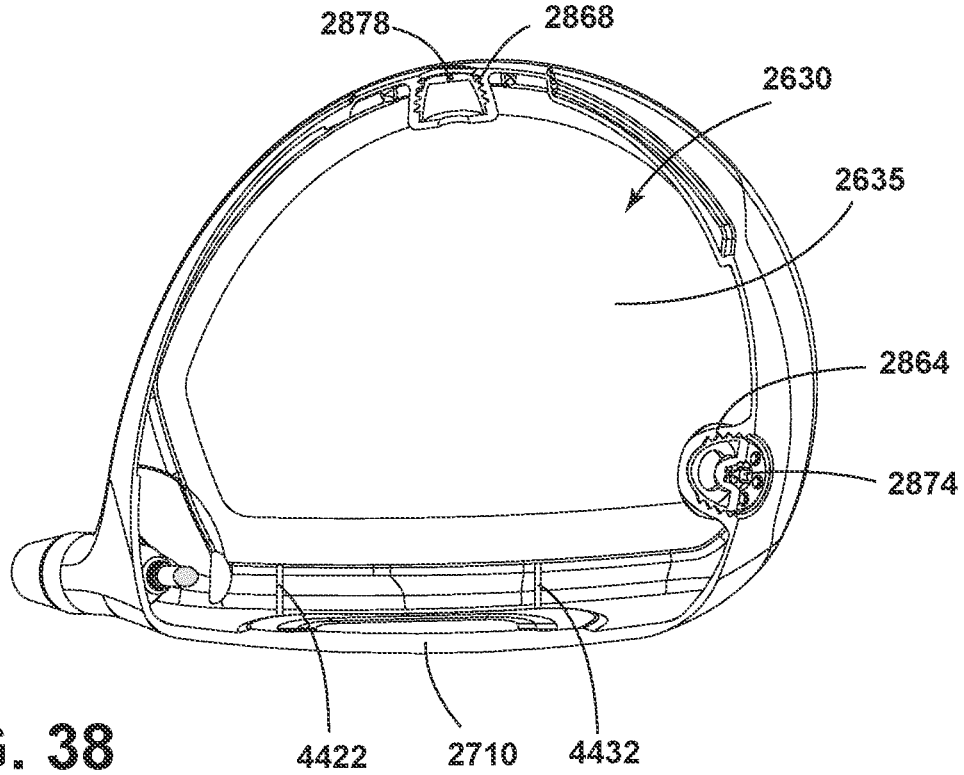
Figure 39:
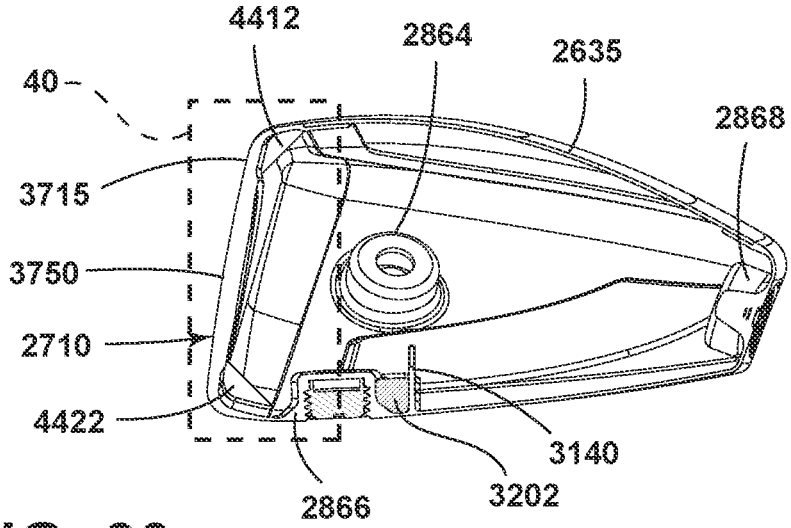
Figure 40:
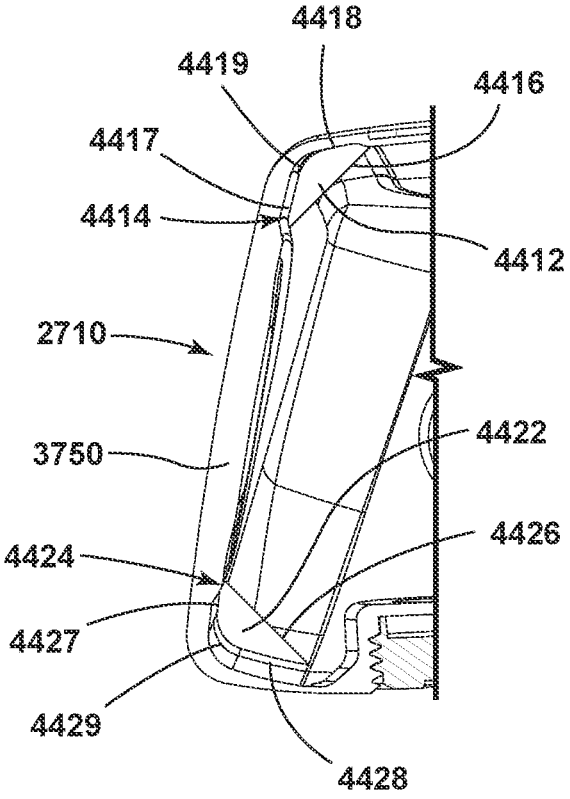
Figure 41:
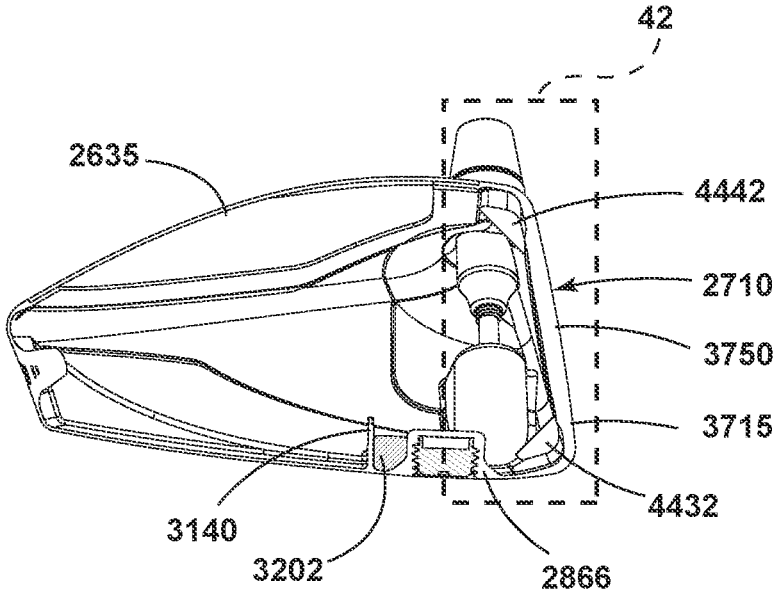
Figure 42:
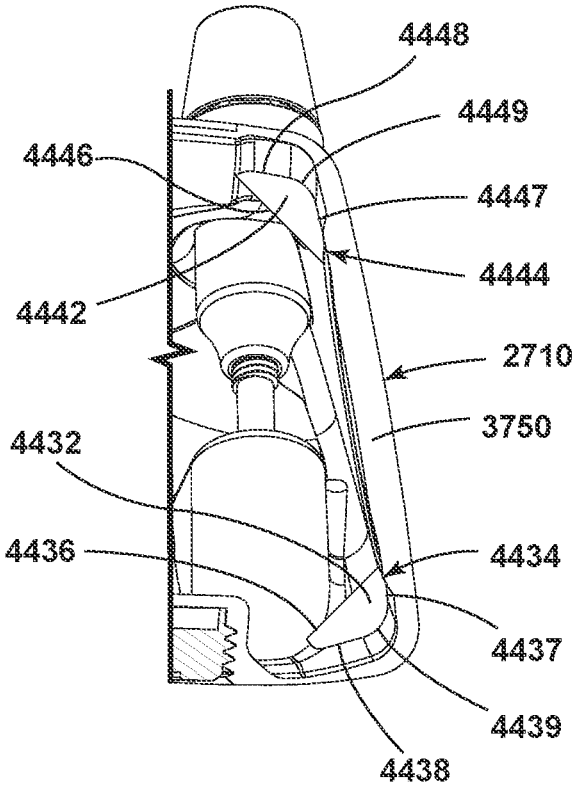
Figure 43:
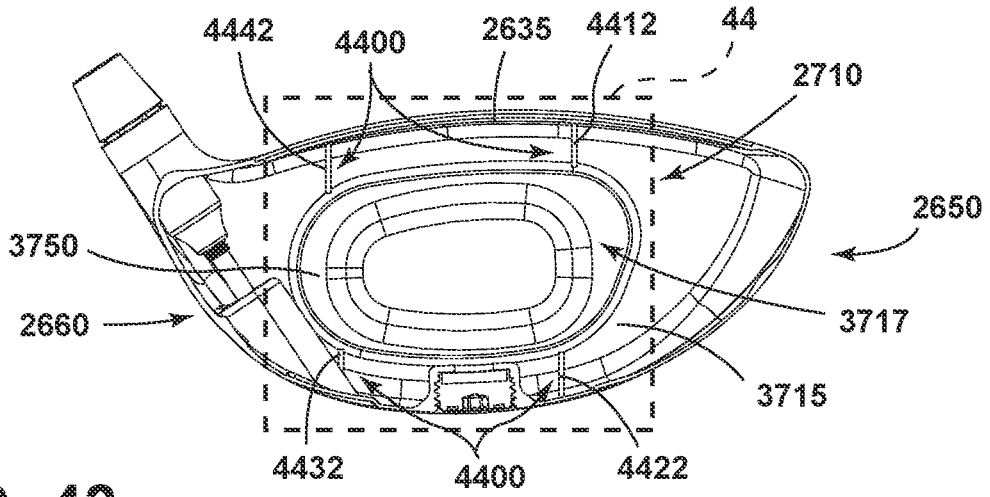
Figure 44:
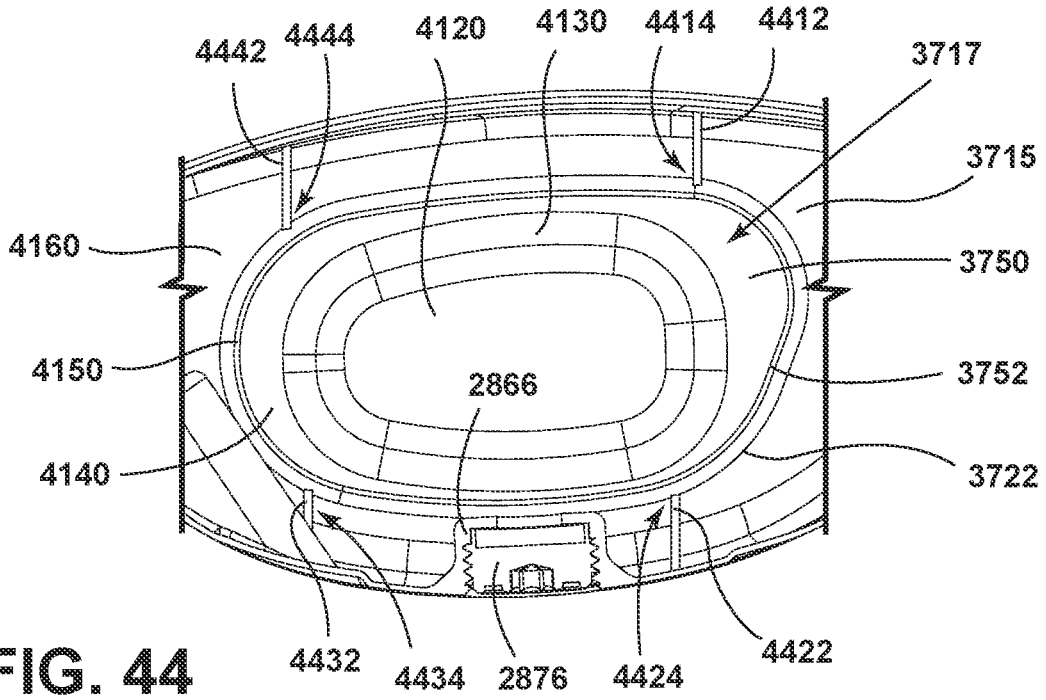
Figure 45:
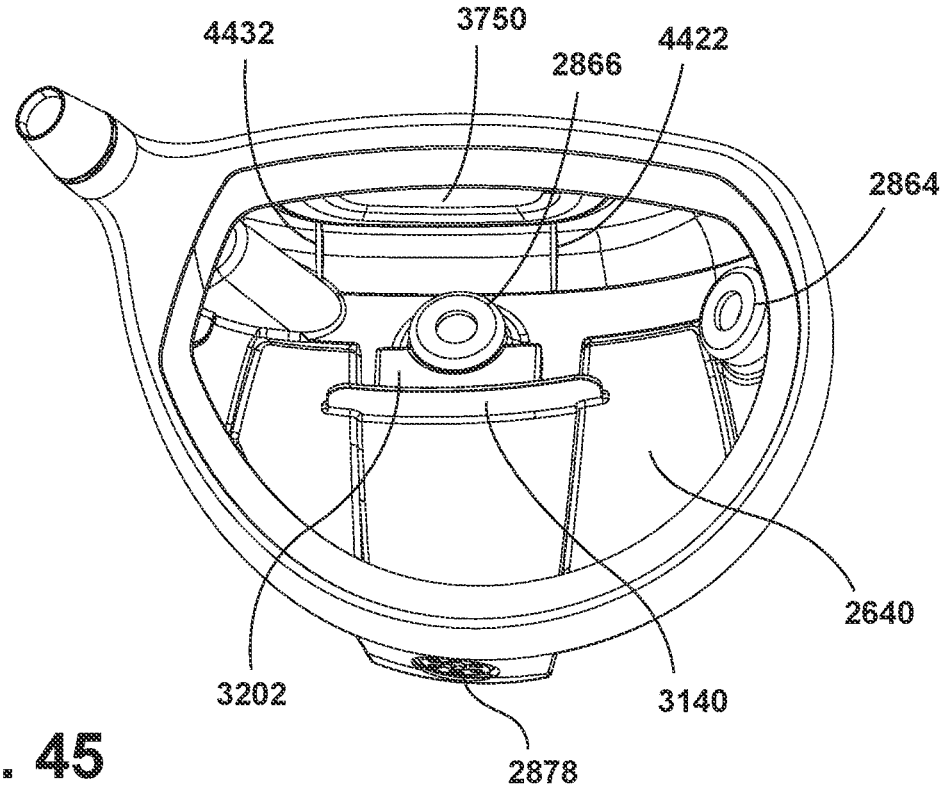
Figure 46:
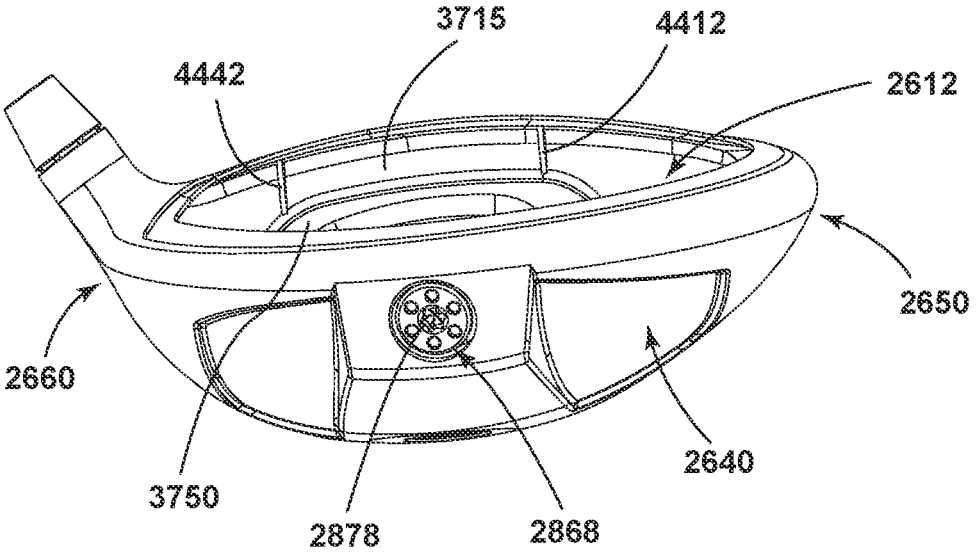
Figure 47:
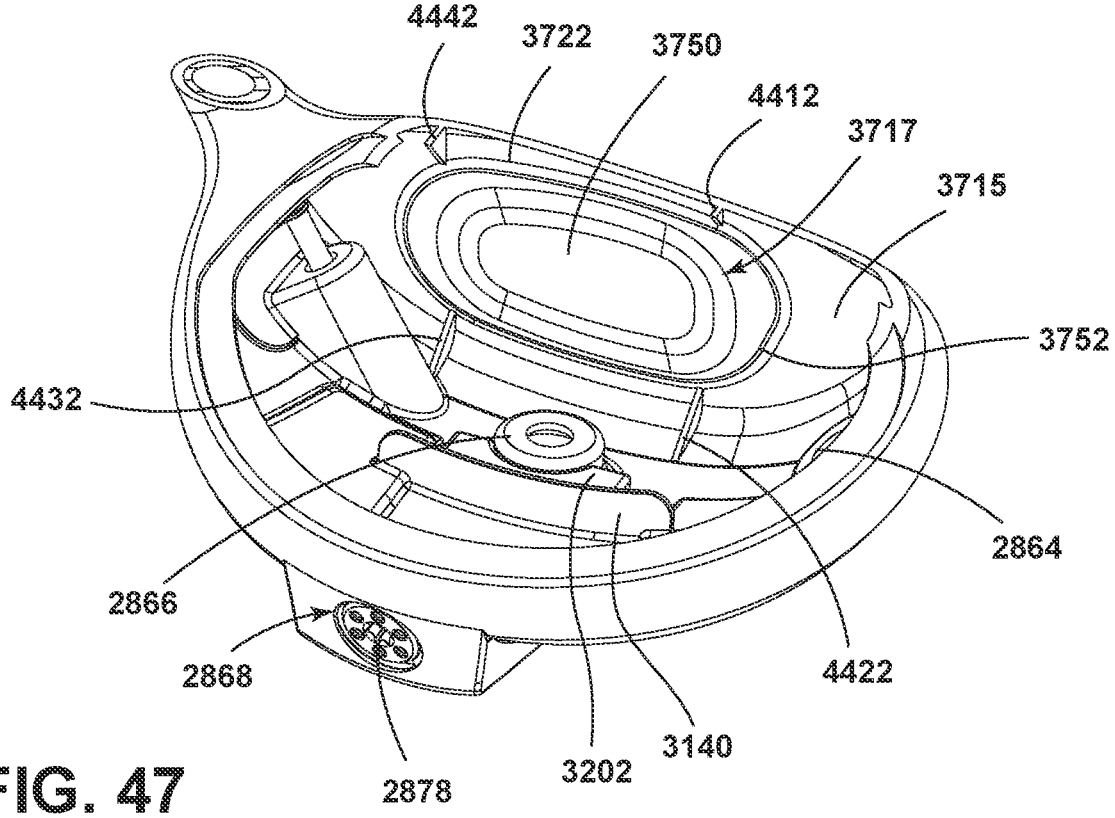
Figure 48:
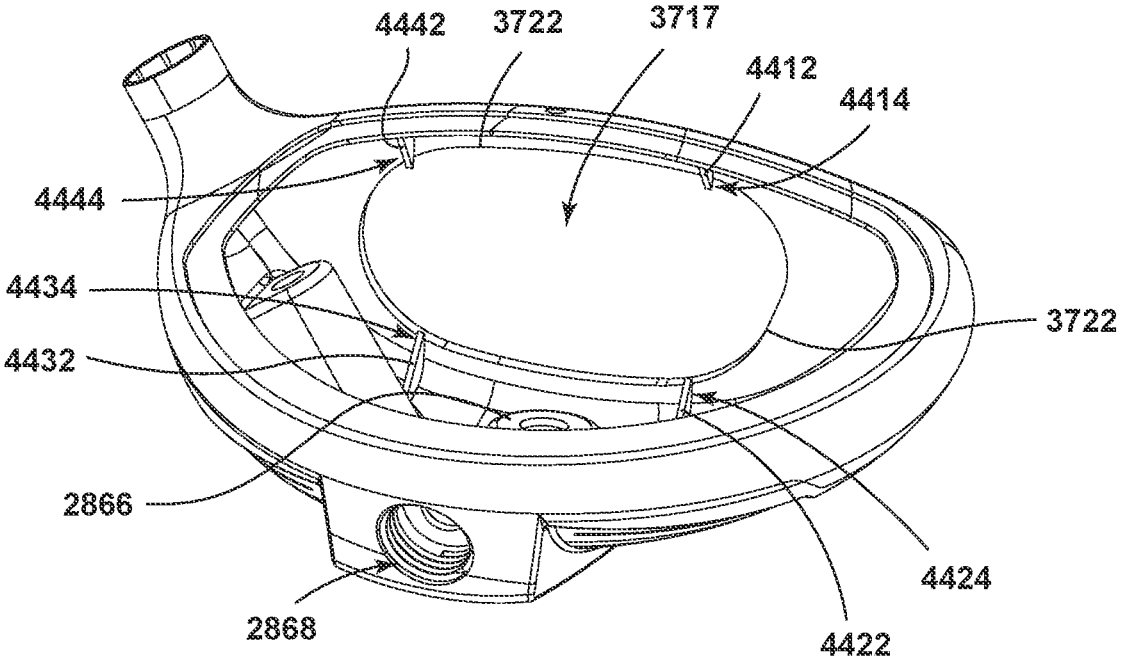

In one example, as illustrated in FIG. 20, the wall portion 1740 may be concave relative to the face portion 1610. In another example, as illustrated in FIG. 21, the wall portion 1740 may be convex relative to the face portion 1610. In another example, as illustrated in FIG. 22, the elastic insert 1902 may extend from the wall portion 1740 to the back surface 1630 of the face portion and engage the back surface 1630 of the face portion 1610. Accordingly, the elastic insert 1902 may completely surround the side walls of the weight port 1666. In another example, as may be illustrated in FIG. 23, the golf club head 1500 may not include the weight port 1666. Accordingly, the elastic insert 1902 may extend between and engage the wall portion 1740, the inner surface 1544 of the bottom portion 1540, and the back surface 1630 of the face portion 1610. In another example, as may be also illustrated in FIG. 23, the elastic insert 1902 may extend between and engage the wall portion 1740 and the back surface 1630 of the face portion 1610 while completely enveloping the weight port 1666. Accordingly, the weight port 1666 is not visible in the schematic view represented in FIG. 23. In another example, as illustrated in FIG. 24, the golf club head 1500 may include a first weight port 2466 and a second weight port 2467 disposed between the wall portion 1740 and the face portion 1610. An elastic insert 1902 may engage and partially surround the first weight port 2466 and the second weight port 2467 similar to the configuration illustrated in FIGS. 15-19 and described herein. In yet another example, as illustrated in FIG. 25, the wall portion 1740 may be concave relative to the face portion 1610 and include a first end portion 2564 and a second end portion 2566 that may be attached to the face portion 1610 to define an enclosure 1790. An elastic polymer material may partially or fully fill the enclosure 1790. In one example, as illustrated in FIG. 25, an elastic insert 1902 may be located between the wall portion 1740 and the weight port 1666 in a similar configuration as illustrated in FIG. 19. Thus, as illustrated in the examples of FIGS. 20-25, the wall portion 1740, the weight port 1666, and/or the elastic insert 1902 may have any configuration to provide certain performance characteristics for the golf club head 1500. The apparatus, methods, and articles of manufacture described herein are not limited in this regard.

In the example of FIGS. 26-36, a golf club head 2600 may include body portion 2610 which may be hollow to define an interior cavity 2612. The body portion 2610 may include a top portion 2630 having a crown portion 2635, a bottom portion 2640, a toe portion 2650, a heel portion 2660, a front portion 2670, and a rear portion 2680. The golf club head 2600 may also include a skirt portion 2690 defined as a side portion of the golf club head 2600 between the top portion 2630 and the bottom portion 2640 excluding the front portion 2670 and extending across a periphery of the golf club head 2600 from the toe portion 2650, around the rear portion 2680, and to the heel portion 2660. Alternatively, the golf club head 2600 may not include the skirt portion 2690. The front portion 2670 may include a face portion 2710 to engage a golf ball. The face portion 2710 may be integral to the body portion 2610 or may be partially or fully a separate piece that is coupled (e.g., welded) to the front portion 2670 to enclose an interior cavity 2612 of the body portion 2610. The body portion 2610 may also include a hosel portion 2665 configured to receive a shaft (in one example, a shaft 1412 is illustrated in FIG. 14). The hosel portion 2665 may be similar in many respects to any of the hosel portions described herein. The hosel portion may include an interchangeable hosel sleeve (not illustrated) and a fastener 2627. Alternatively, the body portion 2610 may include a bore instead of the hosel portion 2665. The body portion 2610 may be made partially or entirely from any of the materials of any of the golf club heads described herein or described in any of the incorporated by reference patent documents. The apparatus, methods, and articles of manufacture described herein are not limited in this regard.

The crown portion 2635 may define include a crown portion insert 2636 that may be separate component that is attached to the top portion 2630. The crown portion insert 2636 may enclose an opening in the top portion 2630. The configuration of the top portion 2630, the crown portion 2635, and/or the crown portion insert 2636 may be similar to any of the configurations of top portions and crown portions that are described herein or in any of the incorporated by reference patent documents. In another example, the body portion 2610 and the crown portion 2635 may be a one piece co-manufactured part. Accordingly, the crown portion 2635 and the body portion may be integral parts made from the same material. The apparatus, methods, and articles of manufacture described herein are not limited in this regard.

The golf club head 2600 may include a plurality of weight port regions with each weight portion region having one or more weight ports and weight portions that may be similar in many respects to any of the weight port regions, weight ports and weight portions described herein or in any of the incorporated by reference patent documents. In the example of FIGS. 26-36, the golf club head 2600 may include a first weight port region 2854 on the bottom portion 2640 at or proximate to the toe portion 2650. The first weight port region 2854 may include a first weight port 2864 configured to receive a first weight portion 2874. The golf club head 2600 may further include a second weight port region 2856 on the bottom portion 2640 at or proximate to the front portion 2670. The second weight port region 2856 may include a second weight port 2866 configured to receive a second weight portion 2876. The golf club head 2600 may also include a third weight port region 2858 on the bottom portion 2640 at or proximate to the rear portion 2680. The third weight port region 2858 may include a third weight port 2868 configured to receive a third weight portion 2878. The weight ports may be sized to interchangeably receive any of the weight portions. The first weight port 2864, the second weight port 2866, and the third weight port 2868 may be similar in many respects to any of the weight ports described herein or in any of the incorporated by reference patent documents. The first weight portion 2874, the second weight portion 2876, and the third weight portion 2878 may be similar in many respects to any of the weight portions described herein or described in any of the incorporated by reference patent documents. In another example, the body portion 2610 may not include any weight ports or removable weight portions. The apparatus, methods, and articles of manufacture described herein are not limited in this regard.

The face portion 2710 may include a front surface 2720 having a plurality of grooves 2721 and a back surface 2730. The front surface 2720 and the grooves 2721 may be configured to strike a golf ball. The face portion 2710 may be attached to an opening in the front portion 2670 to close the opening and/or enclose the interior cavity 2612. The configuration of the face portion 2710 and the attachment thereof to the body portion 2610 may be similar in many respects to any of the configurations of the face portions and attachments thereof to the body portions described herein or in any of the incorporated by reference patent documents. The apparatus, methods, and articles of manufacture described herein are not limited in this regard.

The bottom portion 2640 may include an outer surface 2642 and an inner surface 2644. The bottom portion 2640 may include a center portion 2940 that extends from the front portion 2670 or the second weight port region 2856 to the rear portion 2680. The center portion 2940 may progressively rise (i.e., increasingly extend outward from the outer surface 2642) relative to the outer surface 2642 of the bottom portion 2640 surrounding or adjacent to the center portion 2940 in a direction from the front portion 2670 to the rear portion 2680. Accordingly, the vertical distance between the center portion 2940 and the outer surface 2642 of the bottom portion 2640 surrounding the center portion 2940 may increase in a direction from the front portion 2670 to the rear portion 2680. As illustrated for example in FIGS. 26-36, the rising configuration of the center portion 2940 defines a toe-side wall 2942 and a heel-side wall 2944 of the bottom portion that may extend vertically or transversely relative to the center portion 2940 from the center portion 2940 to the outer surface 2642 of the bottom portion 2640 surrounding the center portion 2940. The bottom portion 2640 may also include a toe-side recessed portion 2946 adjacent the toe-side wall 2942 and a heel-side recessed portion 2948 adjacent the heel-side wall 2944. The toe-side wall 2942 may connect the center portion 2940 to the toe-side recessed portion 2946. The heel-side wall 2944 may connect the center portion 2940 to the heel-side recessed portion 2948. The center portion 2940, the toe-side wall 2942, the heel-side wall 2944, the toe-side recessed portion 2946, and/or the heel-side recessed portion 2948 may provide additional stiffness, impact energy transfer to different portions of the golf club head 2600, and/or structural support for the bottom portion 2640 aft of the ball strike zone of the face portion 2710. Accordingly, all or portions of the bottom portion 2640 may be made relatively thinner (i.e., such as the toe-side recessed portion 2946 and/or the heel-side recessed portion 2948) or have strategically constructed variable thicknesses to reduce the weight of the golf club head 2600, optimize the moment of inertia of the golf club head 2600, and/or to optimize the location of the center of gravity of the golf club head 2600. The apparatus, methods, and articles of manufacture described herein are not limited in this regard.

As illustrated in FIGS. 26-36, for example, the golf club head 2600 may include a back wall portion 3040 that extends transversely from the center portion 2940 to the top portion 2630 to define the rear boundaries of the center portion 2940, the toe-side wall 2942, and the heel-side wall 2944. As illustrated in FIGS. 26-36, for example, the back wall portion 3040 may partially or fully define the third weight port region 2858. Accordingly, the back wall portion 3040 may include the third weight port 2868 and the third weight portion 2878. As illustrated in FIGS. 26-36, for example, the third weight port 2868 may extend from the back wall portion 3040 toward the face portion 2710. In other words, a center axis of the third weight port 2868 may extend through the face portion 2710 or extend through a transition region between the face portion 2710 and the top portion 2630. Accordingly, as illustrated in FIG. 26-36, for example, the third weight portion 2878 may be visible to an individual viewing the rear portion 2680 of the golf club head 2600. The location of the third weight portion 2878 may shift the center of gravity of the golf club head 2600 rearward to improve performance of the golf club head 2600. The apparatus, methods, and articles of manufacture described herein are not limited in this regard.

In one example, as illustrated in FIGS. 26-36, the golf club head 2600 may include a wall portion 3140 extending into the interior cavity 2612 (i.e., an internal wall portion, a rib portion, a projection) from the inner surface 2644 of the bottom portion 2640. The wall portion 3140 may be located aft of the second weight port 2866 to define a gap 3142 between the wall portion 3140 and the second weight port 2866. The wall portion 3140 may extend in the same or substantially the same direction as the face portion 2710 or in a direction extending between the toe portion 2650 and the heel portion 2660. Accordingly, the wall portion 3140 may be oriented transverse to the center portion 2940 or perpendicular to the center portion 2940. The wall portion 3140 may be planar or curved. In the example of FIGS. 26-36, the internal wall may be planar and may extend from the toe-side recessed portion 2946 to the heel-side recessed portion 2948. Accordingly, the length of the wall portion 3140 may be greater than a width of the center portion 2940. As illustrated in FIGS. 26-36, for example, the height of the wall portion 3140 may be greater than the height of the second weight port 2866 such that the wall portion 3140 extends above the second weight port 2866. The wall portion 3140 may provide additional stiffness, impact energy transfer to different portions of the golf club head 2600, and/or structural support for the bottom portion 2640 aft of the ball strike zone of the face portion 2710. Accordingly, all or portions of the bottom portion 2640 may be made relatively thinner or have strategically constructed variable thicknesses to reduce the weight of the golf club head 2600, optimize the moment of inertia of the golf club head 2600, and/or to optimize the location of the center of gravity of the golf club head 2600. The length, height, thickness, location relative to the second weight port 2866, location relative to the back surface 2730 of the face portion 2710, or any other property and/or configuration of the wall portion 3140 may be similar in many respects to the same properties and configurations, respectively, of the wall portion 1740 of the golf club head 1500 as described herein. The location relative to the wall portion 3140 and the configurations and/or properties of the weight port 2866 and/or the weight portion 2876 may be similar in many respects to similar configurations and/or properties the wall portion 1740, the weight port 1666, and the weight portion 1676, respectively, of the golf club head 1500. The apparatus, methods, and articles of manufacture described herein are not limited in this regard.

In one example, as illustrated in FIGS. 26-36, the golf club head 2600 may include an elastic insert 3202 filling the gap 3142. The elastic insert 3202 may have a planar or generally planar rear surface 3204 configured to contact or engage the wall portion 3140. The elastic insert 3202 may include a front surface 3206 that may be shaped similar to a portion of the second weight port 2866 to contact or engage the portion of the second weight port 2866. In one example, the elastic insert 3202 may be in the gap 3142 in an uncompressed state. In another example, the elastic insert 3202 may be inserted in the gap in a compressed state to frictionally engage the wall portion 3140 and the second weight port 2866. Additionally, the elastic insert 3202 may be attached to the wall portion 3140 and/or the second weight port 2866 with an adhesive. As illustrated in the example of FIGS. 26-36, the elastic insert 3202 may partially surround the second weight port 2866 and engage a portion of the wall portion 3140. In another example, the elastic insert 3202 may surround a greater portion or all of the second weight port 2866 and/or engage all of the wall portion 3140. In yet another example, the elastic insert 3202 may extend from the wall portion 3140 to the face portion 2710 to engage the face portion 2710 while surrounding the second weight port 2866. The apparatus, methods, and articles of manufacture described herein are not limited in this regard.

The elastic insert 3202 may be made from any polymer material or any of the filler or polymer materials described herein or in any of the incorporated by reference patent documents. The elastic insert 3202 may have any configuration similar to any of the elastic inserts described herein or in any of the incorporated by reference patent documents (e.g., having hexagonal recesses). The elastic insert 3202 may provide vibration dampening and control, and/or dampened energy transfer and dissipation from the face portion 2710 and/or the second weight port 2866 to the wall portion 3140 and/or the center portion 2940. The elastic insert 3202 may also provide noise dampening to provide a more pleasing sound for an individual using the golf club head 2600 when striking a golf ball. The configurations of the wall portion 3140, the gap 3142, and/or the elastic insert 3202 and coupling thereof with the second weight port 2866 may be similar to the configurations of the wall portion 1740 (i.e., length, height width, position, location relative to other components of the golf club head 2600, orientation, etc.), the gap 1780, the elastic insert 1902, and the weight port 1666, respectively, of the golf club head 1500 or any other configurations illustrated for example in FIGS. 20-25 and/or described herein. The apparatus, methods, and articles of manufacture described herein are not limited in this regard.

In one example, a method 3600 of manufacturing the golf club head 2600 or any of the golf club heads described herein may include forming a body portion 2610 (block 3610) having a wall portion and a weight port between the wall portion and the face portion to define the gap or space between the wall portion and the weight port. The body portion 2610 may include an opening in the top portion 2630, an opening in the front portion 2670, or both an opening in the top portion 2630 and an opening in the front portion 2670. As described herein, the opening in the top portion 2630 may be closed with the crown portion insert 2636 to enclose the interior cavity 2612 at the top portion 2630, and the opening in the front portion 2670 may be closed with the face portion 2710 to enclose the interior cavity 2612 at the front portion 2670. The space or gap between the wall portion and the weight port may be filled with a polymer material (block 3620). In one example, as described herein, an elastic insert 3202 may be inserted in the gap 3142 in an uncompressed state or a compressed state from any one of the opening in the top portion 2630 or the opening in the front portion 2670. Additionally, the elastic insert 3202 may be attached to the golf club head 2600 with an adhesive. In other words, the gap 3142 may be filled with a polymer material. The interior cavity 2612 may then be enclosed as described herein. The first weight portion 2874, the second weight portion 2876, and the third weight portion 2878 may then be interchangeably inserted into the first weight port 2864, the second weight port 2866, and the third weight port 2868. In one example, the method 3600 may not include attaching a crown portion insert 2636 to the body portion 2610 if the crown portion insert 2636 and the body portion are co-manufactured as a one-piece part. Accordingly, the elastic insert 3202 may be inserted in the gap 3142 prior to attaching the face portion 2710 to the front portion 2670. In another example, a polymer may be injected into the gap 3142 from other openings in the body portion 2610, such as from the second weight port 2866. Further, the method 3600 may not include inserting weight portions in weight ports as the body portion 2610 may not include any weight ports. The method 3600 may be applicable to any of the golf club heads described herein with fewer or additional processes as described herein. The apparatus, methods, and articles of manufacture described herein are not limited in this regard.

In another example of the golf club head 2600, as illustrated in FIGS. 37-50, the face portion 2710 may include an outer face portion 3715 that may be integral with the body portion 2610 and surround a face portion opening 3717 in the face portion. A face insert portion 3750 may be attached to the outer face portion 3715 to close the face portion opening 3717 and enclose the interior cavity 2612. The face portion opening 3717 may include a perimeter edge 3722 and the face insert portion 3750 may include a perimeter edge 3752. A gap (not illustrated) may exist between the perimeter edge 3752 of the face insert portion 3750 and the perimeter edge 3722 of the face portion opening 3717. In one example, the gap may be a V-shaped gap to enhance weld penetration. During manufacturing, the gap may be entirely or partially filled with weld material during a welding process in which the face insert portion 3750 is joined to the outer face portion 3715. A sanding or polishing process may follow by which excess weld material is removed to produce a smooth surface across the front portion 2670 of the golf club head 2600 and any excess weld material from the back surface 2730 of the face portion 2710. While the above example may describe the body portion 2610 and the face insert portion 3750 as separate components of the golf club head 2600, the apparatus, methods, and articles of manufacture described herein may include golf club heads with the face portion being an integral part of the body portion (i.e., not separate components). In another example, the outer face portion 3715 and the face insert portion 3750 may be a one-piece part. Accordingly, the face portion 2710 may be attached to the front portion 2670 as described herein or in any of the incorporated by reference patent documents to enclose the interior cavity 2612. The apparatus, methods, and articles of manufacture described herein are not limited in this regard.

In one example, as illustrated in FIGS. 37-50, the face insert portion 3750 may include a first portion 4120 having a first thickness, a second portion 4130 having a second thickness, a third portion 4140 having a third thickness, a fourth portion 4150 having a fourth thickness, and a fifth portion 4160 having a fifth thickness. The configuration of the face insert portion 3750, including the configurations of the first portion 4120, the second portion 4130, the third portion 4140, the fourth portion 4150, and the fifth portion 4160 may be similar in many respect to any of the face portions and configurations thereof disclosed in U.S. patent application Ser. No. 17/528,436, filed Nov. 17, 2021, the disclosure of which is entirely incorporated by reference. In another example, the face insert portion 3750 may have a constant or substantially constant thickness. In yet another example, the face insert portion 3750 may have any variable thickness configuration. The apparatus, methods, and articles of manufacture described herein are not limited in this regard.

Figure 49:
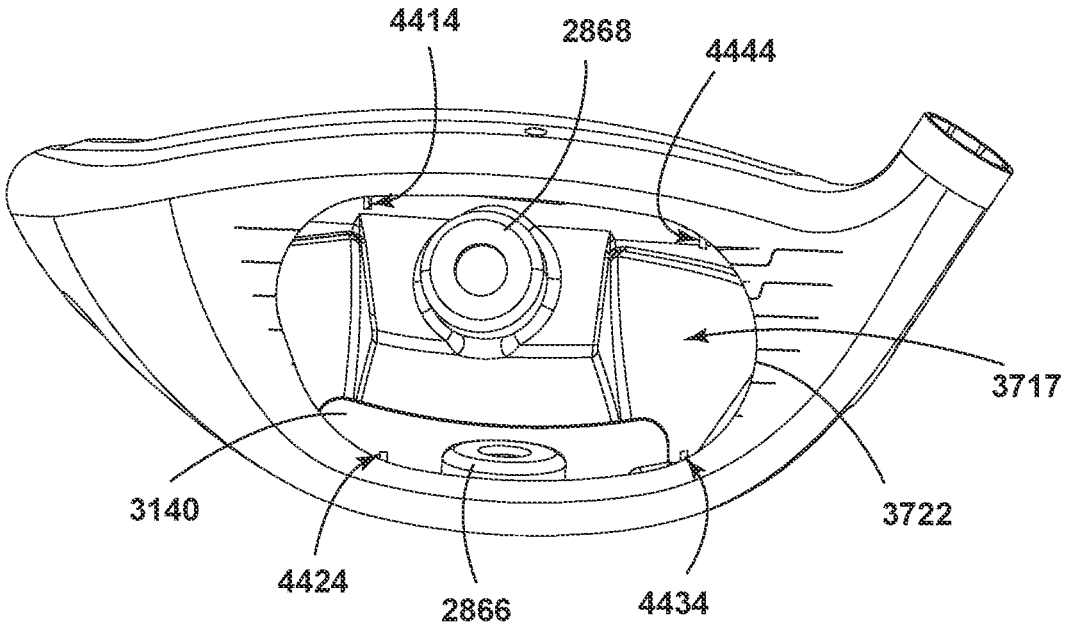

In one example, as illustrated in FIGS. 37-50, the body portion 2610 may include a plurality of rib portions 4400 in the interior cavity 2612 located at the face portion opening 3717 and/or surrounding the face portion opening 3717. The plurality of rib portions 4400 may include any number of rib portions. In the illustrated example of FIGS. 37-50, the plurality of rib portions 4400 may include a first rib portion 4412, a second rib portion 4422, a third rib portion 4432, and a fourth rib portion 4442. The first rib portion 4412 may be located in an upper toe side region of the face portion 2710. The second rib portion 4422 may be located in a lower toe side region of the face portion 2710. The third rib portion 4432 may be located in a lower heel side region of the face portion 2710. The fourth rib portion 4442 may be located in an upper heel side region of the face portion 2710. In one example, each rib portion of the plurality of rib portions 4400 may include a tip portion that may extend from an inner surface of the outer face portion 3715 past the perimeter edge 3722 of the face portion opening 3717 as illustrated in FIGS. 37-50 such as to be positioned in the interior cavity 2612 behind the face portion opening 3717. In other words, the tip portions may be visible through the face portion opening 3717 (i.e., without the face insert portion 3750) when the golf club head 2600 is viewed from the front as illustrated in FIG. 49. Accordingly, the first rib portion 4412 may include a first tip portion 4414 that may extend past the perimeter edge 3722 of the face portion opening 3717 at an upper toe side region of the face portion opening 3717. The second rib portion 4422 may include a second tip portion 4424 that may extend past the perimeter edge 3722 of the face portion opening 3717 at a lower toe side region of the face portion opening 3717. The third rib portion 4432 may include a third tip portion 4434 that may extend past the perimeter edge 3722 of the face portion opening 3717 at the lower heel side region of the face portion opening 3717. The fourth rib portion 4442 may include a fourth tip portion 4444 that may extend past the perimeter edge 3722 of the face portion opening 3717 at the upper heel side region of the face portion opening 3717. The apparatus, methods, and articles of manufacture described herein are not limited in this regard.

In one example, as illustrated in FIGS. 37-50, the first tip portion 4414, the second tip portion 4424, the third tip portion 4434, and the fourth tip portion 4444 may assist in positioning and supporting the face insert portion 3750 in the face portion opening 3717 during manufacturing of the golf club head 2600. To attach the face insert portion 3750 to the outer face portion 3715, the face insert portion 3750 may be placed in the face portion opening 3717 and supported on the first tip portion 4414, the second tip portion 4424, the third tip portion 4434, and the fourth tip portion 4444. As illustrated in the example of FIGS. 37-50, the first tip portion 4414, the second tip portion 4424, the third tip portion 4434, and the fourth tip portion 4444 may assist in positioning and support four opposing sides of the face insert portion 3750 in the face portion opening 3717 so that the outer surface of the face insert portion 3750 is flush or level with the outer surface of the outer face portion 3715. In other words, without the first tip portion 4414, the second tip portion 4424, the third tip portion 4434, and the fourth tip portion 4444, the face insert portion 3750 may fall through the face portion opening 3717 and into the interior cavity 2612. In one example, the first tip portion 4414, the second tip portion 4424, the third tip portion 4434, and the fourth tip portion 4444 may also function as initial weld points to weld the face insert portion 3750 to the outer face portion 3715. Accordingly, upon placement and positioning of the face insert portion 3750 in the face portion opening 3717, the face insert portion 3750 may be welded to the outer face portion 3715 at the locations of the first tip portion 4414, the second tip portion 4424, the third tip portion 4434, and the fourth tip portion 4444. Subsequently, all or portions of the gap between the between the perimeter edge 3722 of the outer face portion 3715 and the perimeter edge 3752 of the face insert portion 3750 may be welded to secure the face insert portion 3750 to the outer face portion 3715 and to close the face portion opening 3717. The apparatus, methods, and articles of manufacture described herein are not limited in this regard.

In one example, as illustrated in FIGS. 37-50, each of the first rib portion 4412, the second rib portion 4422, the third rib portion 4432, and the fourth rib portion 4442 may be generally triangular in shape (i.e., a three-sided shape with linear or curved sides). The first rib portion 4412 may include a first free side 4416 facing the interior cavity 2612, a first face portion side 4417 attached to the face portion 2710, a first top portion side 4418 attached to the top portion 2630, and a first top-face transition portion 4419 attached to the body portion 2610 that follows the inner contour of the body portion 2610 between the top portion 2630 and the face portion 2710. The second rib portion 4422 may include a second free side 4426 facing the interior cavity 2612, a second face portion side 4427 attached to the face portion 2710, a second bottom portion side 4428 attached to the bottom portion 2640, and a second bottom-face transition portion 4429 attached to the body portion 2610 that follows the inner contour of the body portion 2610 between the bottom portion 2640 and the face portion 2710. The third rib portion 4432 may include a third free side 4436 facing the interior cavity 2612, a third face portion side 4437 attached to the face portion 2710, a third bottom portion side 4438 attached to the bottom portion 2640, and a third bottom-face transition portion 4439 attached to the body portion 2610 that follows the inner contour of the body portion 2610 between the bottom portion 2640 and the face portion 2710. The fourth rib portion 4442 may include a fourth free side 4446 facing the interior cavity 2612, a fourth face portion side 4447 attached to the face portion 2710, a fourth top portion side 4448 attached to the top portion 2630, and a fourth top-face transition portion 4449 that is attached to the body portion 2610 and follows the inner contour of the body portion 2610 between the top portion 2630 and the face portion 2710. In one example, each the first rib portion 4412, the second rib portion 4422, the third rib portion 4432, and the fourth rib portion 4442 may be manufactured with the body portion 2610. In another example, each of the first rib portion 4412, the second rib portion 4422, the third rib portion 4432, and the fourth rib portion 4442 may be a separate piece that may be attached to the body portion 2610 by welding or other attachment methods, such as with an adhesive. In another example, one or more of the rib portions may be generally rectangular in shape. In another example, one or more of the rib portions may be curved or circular in shape. In another example, one or more of the rib portions may have any shape to provide the functions of the rib portions as described herein. In another example, one or more rib portions may extend farther aft into the interior cavity than other rib portions. In yet another example, one or more rib portions may extend from the face portion 2710 to any location between the face portion 2710 and the rear portion 2680. The apparatus, methods, and articles of manufacture described herein are not limited in this regard.

In the illustrated example of FIGS. 37-50, the first rib portion 4412, the second rib portion 4422, the third rib portion 4432, and the fourth rib portion 4442 may provide structural support for the face portion 2710 and the body portion 2610. As described herein, the first rib portion 4412 and the fourth rib portion 4442 may be attached to the face portion 2710 and the top portion 2630. The first rib portion 4412 and the fourth rib portion 4442 may function as support braces between the top portion 2630 and the face portion 2710. Accordingly, the first rib portion 4412 and the fourth rib portion 4442 may structurally support the face portion by providing additional stiffness to the face portion 2710 and by further distributing the impact forces from the face portion 2710 to the top portion 2630. As described herein, the second rib portion 4422 and the third rib portion 4432 may be attached to the face portion 2710 and the bottom portion 2640. The second rib portion 4422 and the third rib portion 4432 may function as support braces between the bottom portion 2640 and the face portion 2710. Accordingly, the second rib portion 4422 and the third rib portion 4432 may structurally support the face portion by providing additional stiffness to the face portion 2710 and by further distributing the impact forces from the face portion 2710 to the bottom portion 2640. In one example, the first rib portion 4412, the second rib portion 4422, the third rib portion 4432, and the fourth rib portion 4442 may have similar thicknesses and sizes. In another example, any one of the rib portions may have a different thickness and/or size compared to another one of the rib portions. In another example, the first rib portion 4412 and the fourth rib portion 4442 may have similar thicknesses and/or sizes that may be different from the thicknesses and/or sizes of the second rib portion 4422 and the third rib portion 4432. In yet another example, the first rib portion 4412 and the second rib portion 4422 may have similar thicknesses and/or sizes that may be different from the thicknesses and/or sizes of the third rib portion 4432 and the fourth rib portion 4442. As illustrated in the example of FIGS. 37-50, the first rib portion 4412, the second rib portion 4422, the third rib portion 4432, and the fourth rib portion 4442 may be relatively thin and oriented perpendicular or transverse to the face portion to provide the structural support function and/or the face insert portion positioning and support function as described herein without detrimentally affecting the overall weight and performance of the golf club head 2600. Accordingly, the thickness, size, shape, length, width, and/or orientation relative to the face portion of any rib portion may be determined to provide the structural support function and/or the face insert portion positioning and support function as described herein without detrimentally affecting the overall weight and performance of the golf club head 2600. The apparatus, methods, and articles of manufacture described herein are not limited in this regard.

Figure 50:
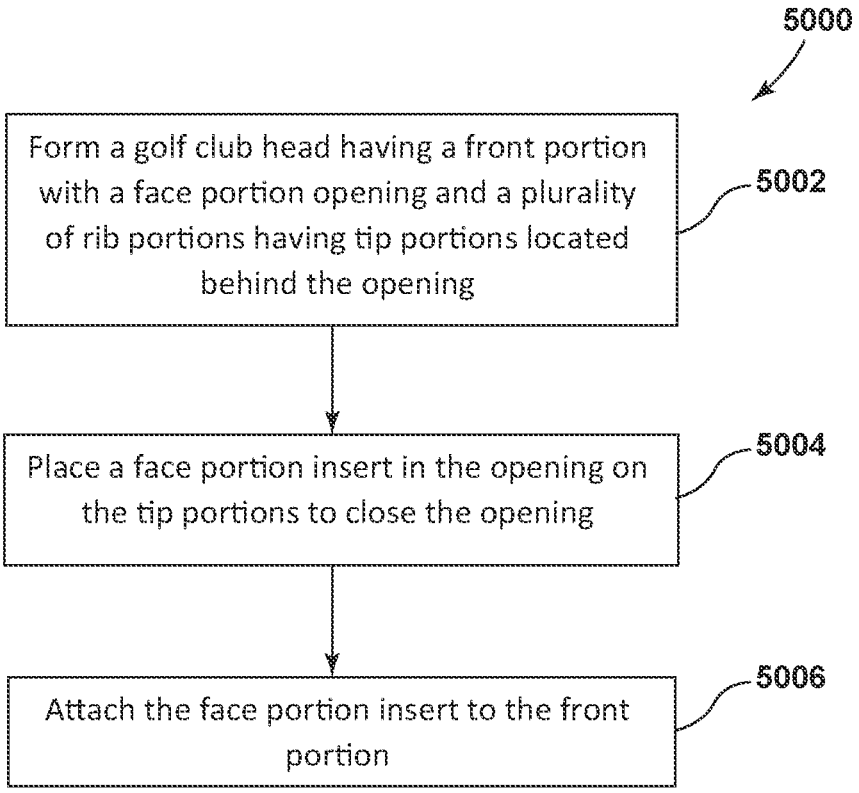

In one example, as illustrated in FIG. 50, a method 5000 for manufacturing the golf club head 2600 may include forming the golf club head 2600 with the face portion opening 3717 and a plurality of rib portions 4400 (block 5002). In one example, the rib portions 4400 and the golf club head 2600 may be co-manufactured. In another example, the rib portions 4400 may be separately manufactured and attached to the golf club head 2600 by, for example, welding. In another example, one or more rib portions 4400 and the body portion 2610 may be manufactured from the same material, such as any of the materials described herein (e.g., steel, titanium, aluminum). In yet another example, one or more rib portions 4400 and the body portion 2610 may be manufactured from different materials, such as any of the materials described herein. The face insert portion 3750 may then be placed on the first tip portion 4414, the second tip portion 4424, the third tip portion 4434, and the fourth tip portion 4444 of the first rib portion 4412, the second rib portion 4422, the third rib portion 4432, and the fourth rib portion 4442 (block 5004), respectively, as described herein. The face insert portion 3750 may then be attached to the front portion 2670 of the body portion 2610 (block 5006) as described herein. The apparatus, methods, and articles of manufacture described herein are not limited in this regard.

Figure 51:
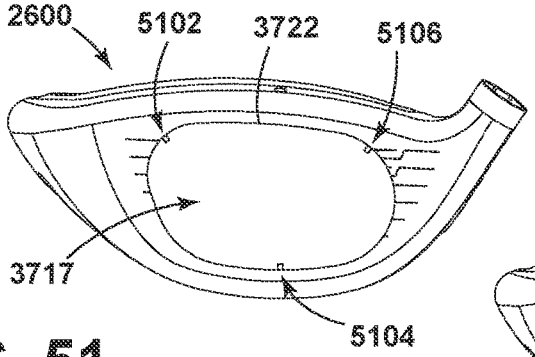
FIGS. 51, 52, 53, 54, 55, and 56 each illustrates an example of a golf club head, respectively, according to embodiment of the apparatus, methods, and articles of manufacture described herein.
Figure 52:
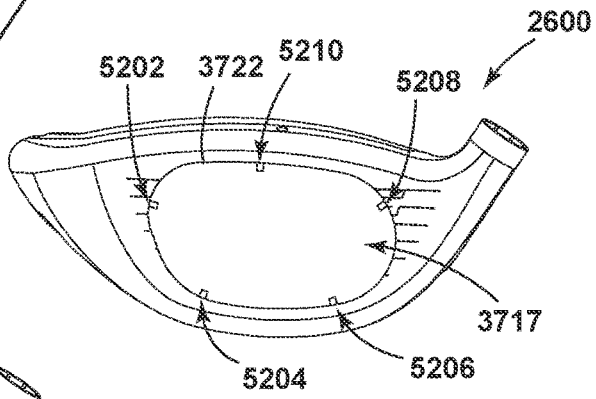
Figure 53:
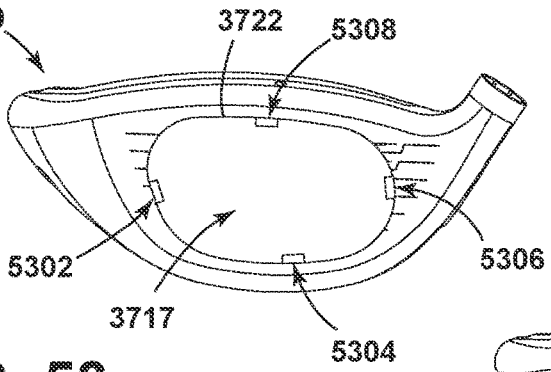
Figure 54:
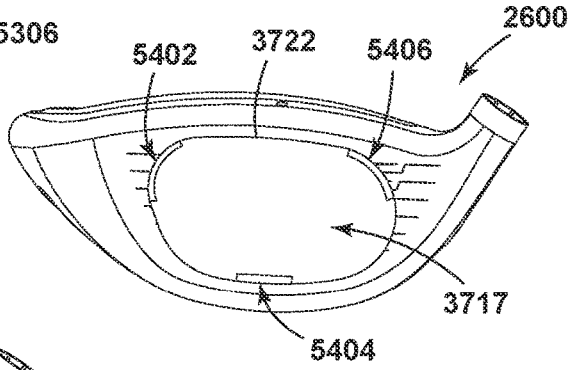
Figure 55:
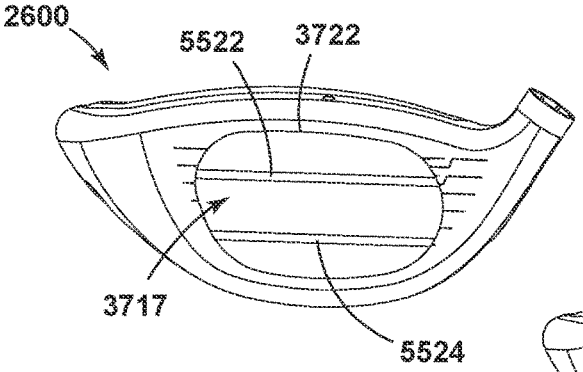
Figure 56:
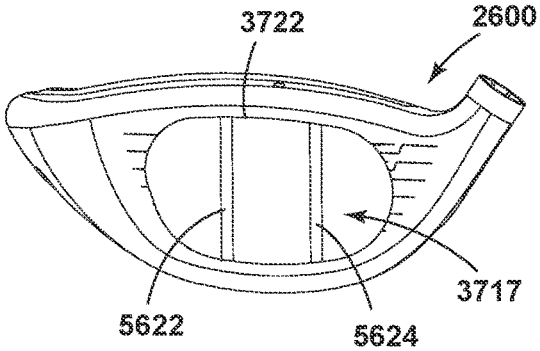

The plurality of rib portions 4400 may include any number of rib portions. In one example, as illustrated in FIG. 51, the plurality of rib portions may include three rib portions, which are illustrated for example as rib portion 5102, rib portion 5104, and rib portion 5106 that may be uniformly or substantially uniformly positioned or spaced apart at the face portion opening 3717. In another example, as illustrated in FIG. 52, the plurality of rib portions may include five rib portions, which are illustrated for example as rib portion 5202, rib portion 5204, rib portion 5206, rib portion 5208, and rib portion 5210 that may be uniformly or substantially uniformly positioned or spaced apart at the face portion opening 3717. As described herein, each rib portion may include a tip portion that may assist is positioning and supporting the face insert portion 3750. In another example, as illustrated in FIG. 53, the face portion 2710 may include a plurality of tab portions, which are illustrated for example as tab portion 5302, tab portion 5304, tab portion 5306, and tab portion 5308, and which may have similar or varying sizes and configurations (i.e., lengths, widths, thicknesses, orientation, etc.) that may assist in positioning and supporting the face insert portion 3750 as described herein. In another example, as illustrated in FIG. 54, the face portion 2710 may include a plurality of tab portions, which are illustrated for example as tab portion 5402, tab portion 5404, and tab portion 5406, which may have similar or varying sizes and configurations (i.e., lengths, widths, thicknesses, orientation, etc.) that may assist in positioning and supporting the face insert portion 3750 as described herein. The tab portions of the plurality of tab portions of FIG. 54 may have greater widths than the tab portions of the plurality of tab portions of FIG. 53. Additionally, the tab portions illustrated in FIG. 54 may be shaped to follow the corresponding contours of the face portion opening 3717. Any one or more tab portions of the plurality of tab portions of FIG. 53 or the plurality of tab portions of FIG. 54 may be associated with structural support portions, such as rib portions as described herein, or may not be associated with any rib portions or other structural support portions and only function to assist in positioning and supporting the face insert portion 3750. In yet another example, as illustrated in FIGS. 55 and 56, the face portion 2710 may include a plurality of horizontal rib portions, which are illustrated for example as rib portion 5522 and rib portion 5524 in FIG. 55, a plurality of vertical rib portions, which are illustrated for example as rib portion 5622 and rib portion 5624 in FIG. 56, and/or a plurality of diagonal rib portions (not illustrated) that may extend across the face portion opening 3717 to assist in positioning and supporting the face insert portion 3750 and/or providing structural support for the face portion 2710 as described herein. Accordingly, the face portion 2710 may have any number of support portions (ribs, tabs, bars, etc.) and in any configuration to assist in positioning and supporting the face insert portion 3750 during attachment of the face insert portion 3750 in the face portion opening 3717 and/or providing structural support for the face portion 2710 as described herein. The apparatus, methods, and articles of manufacture described herein are not limited in this regard.

In one example, any of the rib portions or similar structures as described herein may only assist in positioning and supporting the face insert portion 3750 during attachment of the face insert portion 3750 in the face portion opening 3717 as described herein. In another example, the rib portions or similar structures as described herein may only provide structural support for the face portion 2710. In yet another example, as illustrated in FIGS. 37-50 and described herein, any of the rib portions or similar structures described herein may assist in positioning and supporting the face insert portion 3750 and provide structural support for the face portion 2710 as described herein. Accordingly, the shapes, sizes, materials of constructions, thicknesses, positions on the face portion, orientations relative to the face portion, and other properties of one or more rib portions of the plurality of rib portions may depend on the particular functions of the rib portions. The apparatus, methods, and articles of manufacture described herein are not limited in this regard.

Any of the weight portions (i.e., mass portions) described herein may include a material having a higher density than the density of the material of the corresponding golf club head. For example, one or more components of a golf club head may be made from steel, whereas one or more of the weight portions may be made from tungsten or tungsten-based alloys. Accordingly, a greater amount of mass may be strategically concentrated at various locations of any of the golf club heads described here by using one or more weight portions to improve performance of the golf club head as described herein.

A weight portion as described herein may be defined by a separate mass portion that may be attached to the golf club head, by for example, being received in a correspondingly sized port as described herein. Any of the weight portions described herein may also be an integral portion of the corresponding golf club head and for a one-piece part with the body portion. In one example, a weight portion may be defined by a relatively thicker portion of one or more portions of the golf club head. In another example, a weight portion on the bottom portion of a golf club head may be defined by a thicker portion of the bottom portion projecting into the interior cavity. Accordingly, a weight portion may be defined by any portion of the golf club head that may include a larger local concentration of mass relative to the surrounding regions. The apparatus, methods, and articles of manufacture described herein are not limited in this regard.

In one example, a filler material as described herein may include an elastic polymer or an elastomer material (e.g., a viscoelastic urethane polymer material such as Sorbothane® material manufactured by Sorbothane, Inc., Kent, Ohio), a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties (e.g., one or more adhesive or epoxy materials). A material may also absorb shock, isolate vibration, and/or dampen noise when a golf club head as described herein strikes a golf ball. Further, a filler material may be an epoxy material that may be flexible or slightly flexible when cured. In another example, a filler material may include any of the 3M™ Scotch-Weld™ DP100 family of epoxy adhesives (e.g., 3M™ Scotch-Weld™ Epoxy Adhesives DP100, DP100 Plus, DP100NS and DP100FR), which are manufactured by 3M corporation of St. Paul, Minnesota. In another example, a filler material may include 3M™ Scotch-Weld™ DP100 Plus Clear adhesive. In another example, a filler material may include low-viscosity, organic, solvent-based solutions and/or dispersions of polymers and other reactive chemicals such as MEGUM™, ROBOND™, and/or THIXON™ materials manufactured by the Dow Chemical Company, Auburn Hills, Michigan. In yet another example, a filler material may be LOCTITE® materials manufactured by Henkel Corporation, Rocky Hill, Connecticut. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. For example, the ethylene copolymer may include any of the ethylene copolymers associated with DuPont™ High-Performance Resin (HPF) family of materials (e.g., DuPont™ HPF AD1172, DuPont™ HPF AD1035, DuPont® HPF 1000 and DuPont™ HPF 2000), which are manufactured by E.I. du Pont de Nemours and Company of Wilmington, Delaware. The DuPont™ HPF family of ethylene copolymers are injection moldable and may be used with conventional injection molding equipment and molds, provide low compression, and provide high resilience, i.e., relatively high coefficient of restitution (COR). In another example, any one or more of the filler materials described herein may be formed from one or more metals or metal alloys, such as aluminum, copper, zinc, magnesium, and/or titanium. A filler material not specifically described in detail herein may include one or more similar or different types of materials described herein and in any of the incorporated by reference patent documents. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

The apparatus, methods, and articles of manufacture described herein may include one or more club identifiers (e.g., a serial number, a matrix barcode, a brand name, a model, a club number, a loft angle, a character, etc.). For example, the golf club head may include a visual indicator such as a club number to identify the type of golf club. In one example, the club number may correspond to the loft angle of the golf club head (e.g., 3, 4, 5, 6, 7, 8, or 9). In one example, a 7-iron type golf club head may be marked with "7". In another example, the golf club head may include the loft angle. For example, a 54-degree wedge type golf club head may be marked "54." In yet another example, a 10.5-degree driver type golf club head may be marked "10.5." The club identifier may be a trademark to identify a brand or a model of the golf club head. The club identifier may be another type of visual indicator such as a product number or a serial number to identify the golf club head 100 as authentic equipment, to track inventory, or to distinguish the golf club head from fake or counterfeit products. Alternatively, the club identifier may be a digital signature or a machine-readable optical representation of information or data about the golf club head (e.g., numeric character(s), alphanumeric character(s), byte(s), a one-dimensional barcode such as a Universal Product Code (UPC), a two-dimensional barcode such as a Quick Response (QR) code, etc.). The club identifier may be placed at various locations on the golf club head (e.g., the hosel portion, the face portion, the sole portion, etc.) using various methods (e.g., laser etched, stamped, cast, or molded onto the golf club head). For example, the club identifier may be a serial number laser etched onto the hosel portion of the golf club head. Instead of being an integral part of the golf club head, the club identifier may be a separate component coupled to the golf club head (e.g., a label adhered via an adhesive or an epoxy).

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club or the golf club head.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc.

Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a hollow body portion defining an interior cavity, the hollow body portion including a front portion with a face portion, a rear portion, a toe portion, a heel portion, a bottom portion having an inner surface and an outer surface, and a top portion, the hollow body portion comprising a first material having a first density;

a wall portion extending into the interior cavity from the inner surface of the bottom portion, the wall portion having a wall-portion length extending between the toe portion and the heel portion, a wall-portion height extending between the bottom portion and the top portion, and a wall-portion thickness extending between the front portion and the rear portion, the wall-portion length being substantially greater than the wall-portion height, and the wall-portion height being substantially greater than the wall-portion thickness;

a weight portion comprising a second material having a second density different from the first density;

a weight port extending into the interior cavity from the bottom portion at a weight-port height, the weight port located between the wall portion and the face portion, the weight port configured to receive the weight portion; and a polymer material between the weight port and the wall portion, the polymer material having a rear portion coupled to the wall portion and a front portion coupled to the weight port, wherein a height of the polymer material extending between the toe portion and the heel portion is less than or equal to the weight-port height.

2. A golf club head as defined in claim 1, wherein the wall-portion length is greater than or equal to 1.0 inch (25.4 millimeters) and less than or equal to 3.0 inch (76.2 millimeters), and wherein a ratio of the wall-portion length to the wall-portion height is greater than or equal to 3.0.

3. A golf club head as defined in claim 1, wherein the wall-portion height is greater than or equal to 0.10 inch (2.54 millimeters) and less than or equal to 0.65 inch (16.51 millimeters), and wherein a ratio of the wall-portion height to the wall-portion thickness is greater than or equal to 4.0.

4. A golf club head as defined in claim 1, wherein a ratio of a distance between the wall portion and the face portion to a distance between the weight port and the face portion is greater than or equal to 1.2.

5. A golf club head as defined in claim 1, wherein a distance between an opening of the weight port on the outer surface of the bottom portion and the face portion is the same or similar to the distance between an opening of the weight port inside the interior cavity and the face portion.

6. A golf club head as defined in claim 1, wherein the polymer material is an insert configured to fit between the weight port and the wall portion.

7. A golf club head as defined in claim 1, wherein the wall portion extends in a same direction or substantially a same direction as the face portion.

8. A golf club head comprising:

a body portion comprising an interior cavity, a front portion having a front opening, a rear portion, a toe portion, a heel portion, a top portion, and a bottom portion comprising an inner surface and an outer surface, the bottom portion comprising:

toe-side portion;

a heel-side portion;

a center portion between the toe-side portion and the heel-side portion, the center portion increasing in height in a front-to-rear direction relative to the toe-side portion and relative to the heel-side portion;

a toe-side wall extending transversely from center portion to the toe-side portion;

a heel-side wall extending transversely from center portion to the heel-side portion; and a back wall portion extending transversely from the center portion to the top portion;

a face portion attached to the front portion to close the front opening;

a first weight portion;

a second weight portion;

a first weight port on the bottom portion extending into the interior cavity and configured to receive the first weight portion, a distance between the first weight port and the face portion being less than a distance between the first weight port and the rear portion;

a second weight port on the back wall portion extending into the interior cavity and configured to receive the second weight portion;

a wall portion extending from the inner surface of the bottom portion into the interior cavity, a distance between the wall portion and the face portion being greater than the distance between the first weight port and the face portion to define a gap between the wall portion and the first weight port; and a polymer material in the gap, the polymer material having a rear surface coupled to the wall portion and a front surface coupled to the first weight port, wherein a distance between the first weight port and the face portion is greater than a distance between the first weight port and the wall portion.

9. A golf club head as defined in claim 8, wherein the second weight port is a cylindrical weight port, and wherein a center axis of the cylindrical weight port extends through the face portion.

10. A golf club head as defined in claim 8, wherein the first weight port and the second weight port are axially aligned on the center portion.

11. A golf club head as defined in claim 8, wherein the first weight port and the second weight port are on the center portion, and wherein a center axis of the second weight port extends through the face portion.

12. A golf club head as defined in claim 8, wherein the first weight port extends into the interior cavity at first weight-port height;

wherein the first weight port and the second weight port are on the center portion, and wherein a height of the wall portion is greater than or equal to the first weight-port height.

13. A golf club head as defined in claim 8, wherein the wall portion extends in a same direction or substantially a same direction as the face portion.

14. A golf club head as defined in claim 8, wherein a length of the wall portion is greater than a width of the center portion.

15. A golf club comprising:

a shaft having a first end portion and a second end portion opposite the first end portion;

a grip coupled to the first end portion of the shaft;

a golf club head coupled to the second end portion of the shaft, the golf club head comprising:

a body portion comprising an interior cavity, a front portion having a front opening, a rear portion, a toe portion, a heel portion, a top portion, and a bottom portion comprising an inner surface and an outer surface, the bottom portion comprising:

a toe-side portion;

a heel-side portion;

a center portion between the toe-side portion and the heel-side portion, the center portion increasing in height in a front-to-rear direction relative to the toe-side portion and relative to the heel-side portion;

a toe-side wall extending transversely from center portion to the toe-side portion;

a heel-side wall extending transversely from center portion to the heel-side portion; and a back wall portion extending transversely from the center portion to the top portion;

a face portion attached to the front portion to close the front opening;

a first weight portion;

a second weight portion;

a first weight port on the center portion of the bottom portion and extending into the interior cavity at a first weight-port height and configured to receive the first weight portion;

a second weight port on the back wall portion of the bottom portion and extending into the interior cavity and configured to receive the second weight portion, a wall portion extending from the inner surface of the bottom portion into the interior cavity, a distance between the wall portion and the face portion being greater than the distance between the first weight port and the face portion to define a gap between the wall portion and the first weight port; and a polymer material in the gap, the polymer material having a rear surface coupled to the wall portion and a front surface coupled to the first weight port, wherein the first weight port and the second weight port are axially aligned along the center portion.

16. A golf club as defined in claim 15, wherein a center axis of the second weight port extends through the face portion.

17. A golf club as defined in claim 15, wherein a height of the wall portion is greater than or equal to the first weight-port height.

18. A golf club as defined in claim 15, wherein a height of the polymer material is less than or equal to the first weight-port height.

19. A golf club as defined in claim 15, wherein the wall portion extends in a same direction or substantially a same direction as the face portion.

20. A golf club as defined in claim 15, wherein a length of the wall portion is greater than a width of the center portion.

* * * * *